US009060565B2

(12) United States Patent
Kosta

(10) Patent No.: US 9,060,565 B2
(45) **Date of Patent: *Jun. 23, 2015**

(54) SUPPORT SYSTEM FOR FOOTWEAR PROVIDING SUPPORT AT OR BELOW THE SUSTENTACULUM TALI

(75) Inventor: Cheryl Sherwood Kosta, Lake Oswego, OR (US)

(73) Assignee: ALIGN FOOTWEAR, LLC, Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/458,894

(22) Filed: Apr. 27, 2012

(65) Prior Publication Data

US 2012/0266495 A1 Oct. 25, 2012

Related U.S. Application Data

(63) Continuation of application No. 12/066,256, filed as application No. PCT/US2006/035311 on Sep. 11, 2006, now Pat. No. 8,196,318.

(60) Provisional application No. 60/715,620, filed on Sep. 9, 2005.

(51) Int. Cl.

| | |
|---|---|
| ***A43B 7/14*** | (2006.01) |
| ***A43B 7/16*** | (2006.01) |
| ***A43B 7/24*** | (2006.01) |

(52) U.S. Cl.

CPC ..... *A43B 7/1495* (2013.01); *A43B 7/16* (2013.01); *A43B 7/24* (2013.01)

(58) Field of Classification Search

CPC .... A43B 7/141; A43B 7/1415; A43B 7/1495; A43B 7/18; A43B 7/142; A43B 7/143; A43B 7/19; A43B 7/20; A43B 7/22; A43B 7/223; A43B 7/226; A43B 7/24

USPC ..... 36/89, 91, 108, 68, 140, 174, 148, 149, 36/76 R, 76 C, 58.5, 76 HH, 69, 180, 150, 36/142–144, 155–157, 166–177, 107

See application file for complete search history.

(56) References Cited

U.S. PATENT DOCUMENTS

| | | | |
|---|---|---|---|
| 545,006 | A | 8/1895 | Baird |
| 1,335,981 | A | 4/1920 | Morton |

(Continued)

FOREIGN PATENT DOCUMENTS

| | | | |
|---|---|---|---|
| AU | 655267 | B3 | 2/1993 |
| DE | 543868 | C | 2/1932 |

(Continued)

OTHER PUBLICATIONS

Japanese Office Actino (in Japanese) Dated Mar. 13, 2012 With English Letter of Explanation.

(Continued)

*Primary Examiner* — Ted Kavanaugh

(74) *Attorney, Agent, or Firm* — Mark T. Vogelbacker; Reed Smith LLP

(57) ABSTRACT

A foot has a medial side, a lateral side, a sustentaculum tali, a lateral calcaneus, a fifth metatarsal ray and a forefoot. The support system for a foot comprises of the following. A first portion configured to support an underside portion of the sustentaculum tali at or below the sustentaculum tali on the medial side of the foot to provide a force on the sustentaculum tali. A second portion configured to support the lateral calcaneus on the lateral side of the foot. A third portion configured to support the fifth metatarsal ray on the lateral side of the foot.

19 Claims, 71 Drawing Sheets

(56) References Cited

U.S. PATENT DOCUMENTS

| | | | | | |
|---|---|---|---|---|---|
| 1,803,554 | A | | 5/1931 | Knilans | |
| 2,086,999 | A | * | 7/1937 | Hack et al. | 36/180 |
| 2,156,086 | A | | 4/1939 | Hack | |
| 2,943,405 | A | | 7/1960 | Olson | |
| 3,058,240 | A | * | 10/1962 | Osgood | 36/91 |
| 3,414,988 | A | | 12/1968 | Mattos | |
| 3,464,125 | A | | 9/1969 | Conway | |
| 3,806,145 | A | | 4/1974 | Czeiszperger | |
| 3,834,044 | A | * | 9/1974 | McAusland et al. | 36/117.6 |
| 4,232,457 | A | | 11/1980 | Mosher | |
| 4,348,821 | A | | 9/1982 | Daswick | |
| 4,523,394 | A | | 6/1985 | Lindh | |
| 4,597,199 | A | | 7/1986 | Hong | |
| 4,610,101 | A | | 9/1986 | Brown | |
| 4,620,376 | A | | 11/1986 | Talarico | |
| 4,766,679 | A | | 8/1988 | Bender | |
| 4,910,887 | A | | 3/1990 | Turner | |
| 4,924,605 | A | | 5/1990 | Spademan | |
| 4,947,560 | A | | 8/1990 | Fuerst | |
| 5,174,052 | A | | 12/1992 | Schoenhaus | |
| 5,184,409 | A | | 2/1993 | Brown | |
| 5,243,772 | A | | 9/1993 | Francis | |
| 5,317,820 | A | | 6/1994 | Bell | |
| 5,379,530 | A | | 1/1995 | Bell | |
| 5,404,659 | A | | 4/1995 | Burke | |
| 5,449,005 | A | * | 9/1995 | Echols | 36/89 |
| 5,465,509 | A | | 11/1995 | Fuerst | |
| 5,661,864 | A | | 9/1997 | Valiant | |
| 6,018,892 | A | * | 2/2000 | Acheson et al. | 36/89 |
| 6,092,314 | A | | 7/2000 | Rothbart | |
| 6,233,847 | B1 | | 5/2001 | Brown | |
| 6,401,366 | B2 | | 6/2002 | Foxen | |
| 6,497,058 | B2 | | 12/2002 | Dietrich et al. | |
| 6,594,922 | B1 | | 7/2003 | Mansfield | |
| 6,618,960 | B2 | | 9/2003 | Brown | |
| 6,692,454 | B1 | | 2/2004 | Townsend et al. | |
| D497,472 | S | | 10/2004 | Vasyli | |
| D517,291 | S | | 3/2006 | Vasyli | |
| D518,945 | S | | 4/2006 | Vasyli | |
| D555,341 | S | | 11/2007 | Vasyli | |
| D578,285 | S | | 10/2008 | Vasyli | |
| D584,494 | S | | 1/2009 | Vasyli | |
| 2002/0050080 | A1 | | 5/2002 | Vasyli | |
| 2002/0139011 | A1 | | 10/2002 | Kerrigan | |

FOREIGN PATENT DOCUMENTS

| | | | |
|---|---|---|---|
| DE | 658414 | C | 4/1938 |
| EP | 0820706 | A3 | 1/1998 |
| JP | 2002262907 | | 9/2002 |
| WO | 9107152 | A1 | 5/1991 |
| WO | 9219191 | A1 | 11/1992 |

OTHER PUBLICATIONS

Fish, et al. Lower Extremity Orthoses and Application for Rehabilitation Populiations, Foot and Ankle Clinics Website, 2001, 1 Pg.

Dufek, et al "Mechanical Gait Analysis of Transfermoral Amputees: Sach Foot Versus the Flex-Foot." JPO 1997, Vol. 9, No. 4, p. 152-157.

Fish, et al. "Genu Recurvatum: Identification of Three Distinct Mechanical Profiles." JPO 1998, vol. 10, No. 2, p. 26-34.

Fish, et al. "Walking Impediments and Gait Inefficiencies in the CVA Patient." JPO 1999, vol. 11, No. 2, p. 33-36.

Photographs of an Orthotic Device Taken by Applicant Prior to Sep. 2005, 6 Pgs.

Photograph of Illustrated Comparison of Tri Planar Protocol That Applicant Believes Existed Prior to Sep. 2005, 1 Pg.

English Translation of German Patent No. DE658414C, Granted Apr. 2, 1938 to Anton Leisten Sen. Initially Submitted via an Information Disclosure Statement to the USPTO in the German Language on Oct. 30, 2009.

English Translation of German Patent No. SE543868C, Granted Feb. 10, 1932 to Max Neubert. Initially Submitted via an Information Disclosure Statement to the USPTO in the German Language on Oct. 30, 2009.

Extended European Search Report and Written Opinion, Sep. 28, 2009, for Corresponding European National Phase Application No. 06803332; 8 Pgs.

Office Action From the Patent Office of the People's Republic of China, Nov. 13, 2009, for Corresponding China National Phase Patent Application No. 200680033061.1, 15 Pgs.

PCT International Search Report and Written Opinion for Partent PCT Application No. PCT/US06/35311, Filed Sep. 11, 2006; 11 Pgs.

PCT Invitation to Pay Additional Fees for Parents PCT Application No. PCT/US/06/35311, Filed Sep. 11, 2006; 2 Pgs.

* cited by examiner

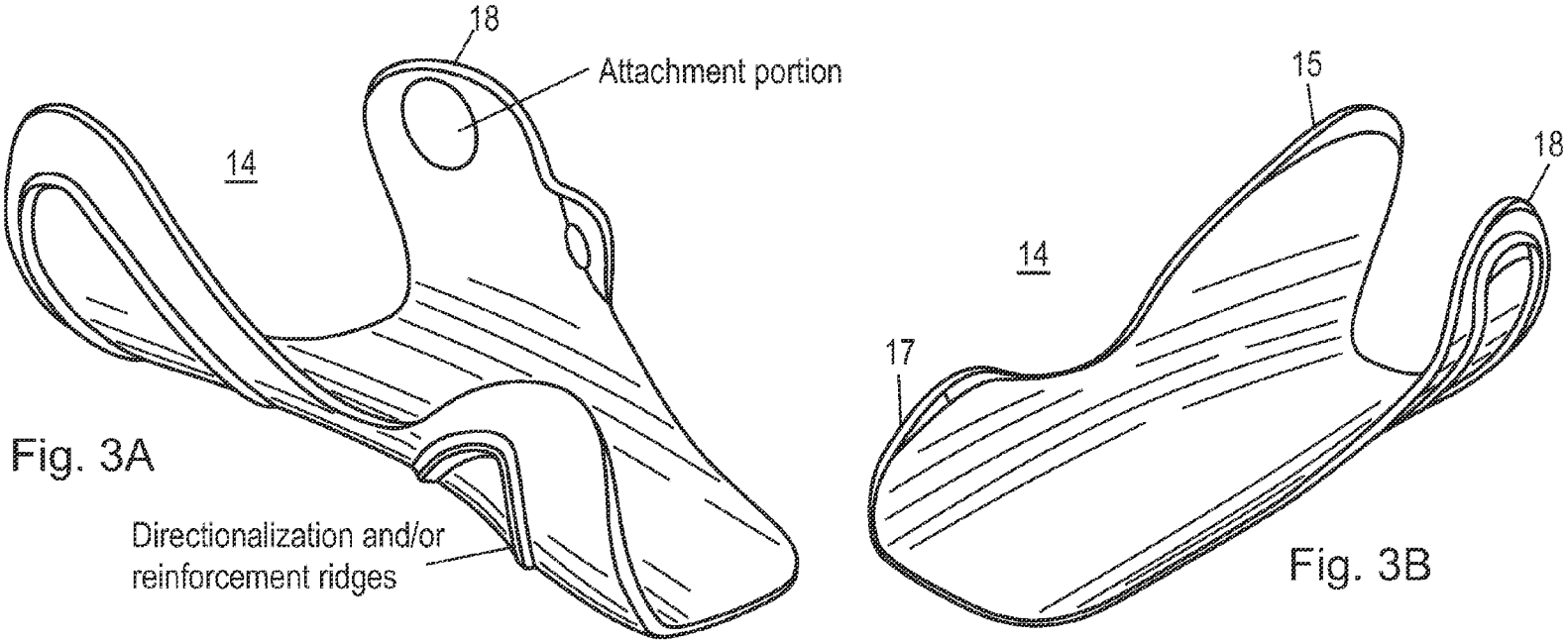
Fig. 3A
Fig. 3B
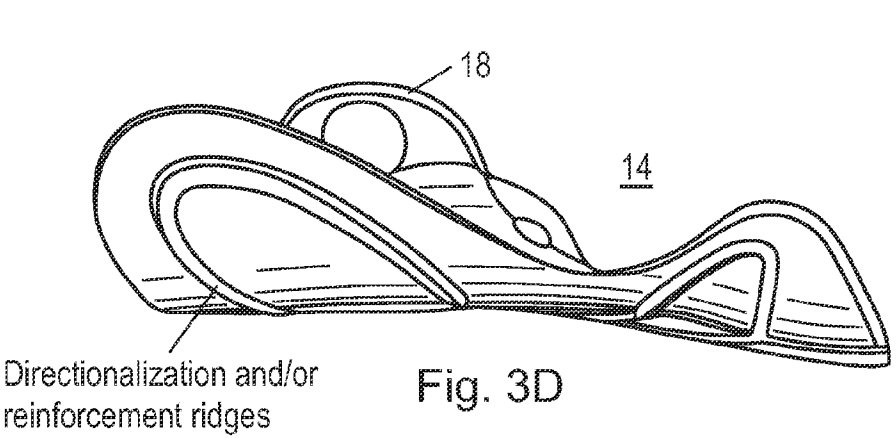
Fig. 3D
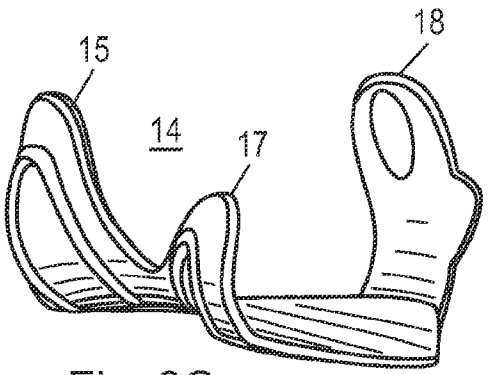
Fig. 3C 18
20
16
18

14
18
16

18
15
14
17
16

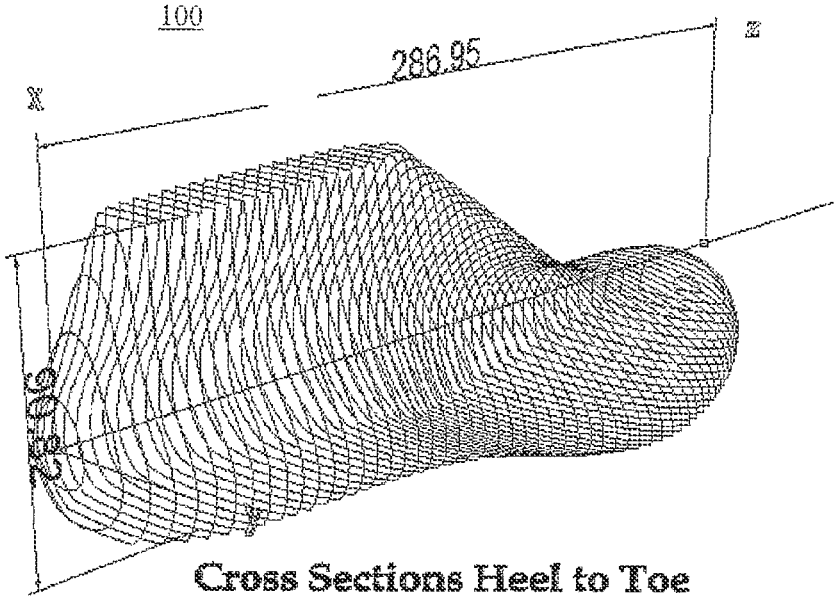
Shown individually in sequence in Figs. 10.1-10.58 and Figs. 11.1-11.58
Fig. 9.1
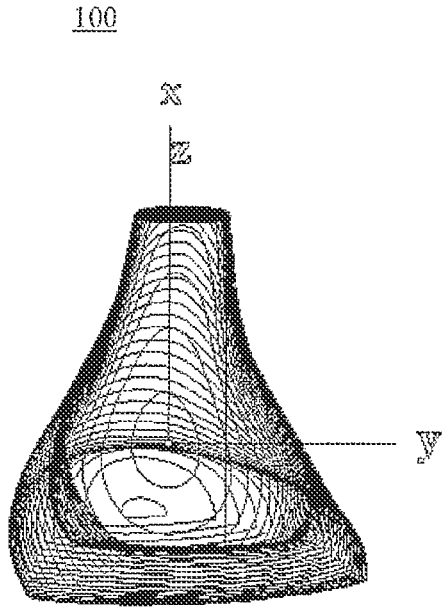
Fig. 9.2

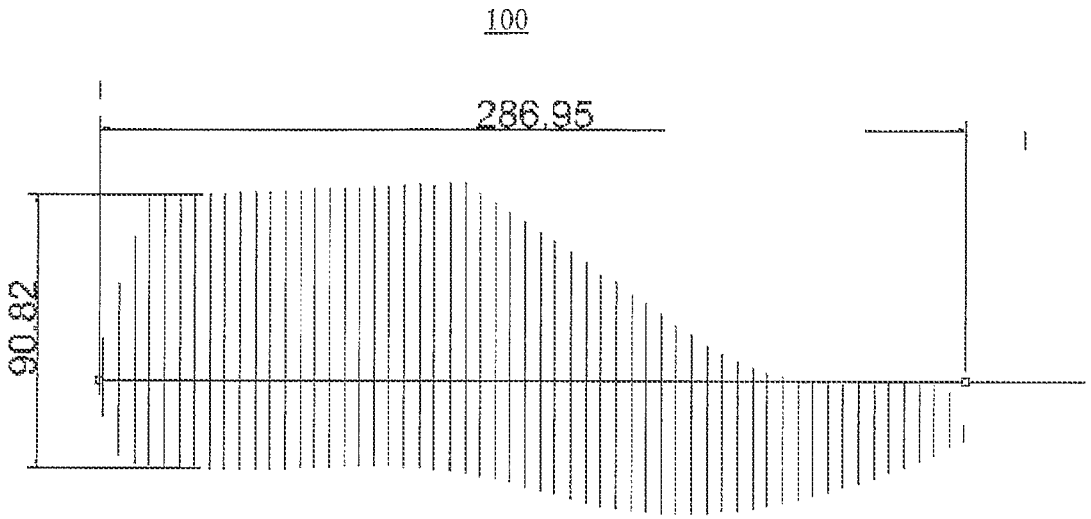
Fig. 9.3
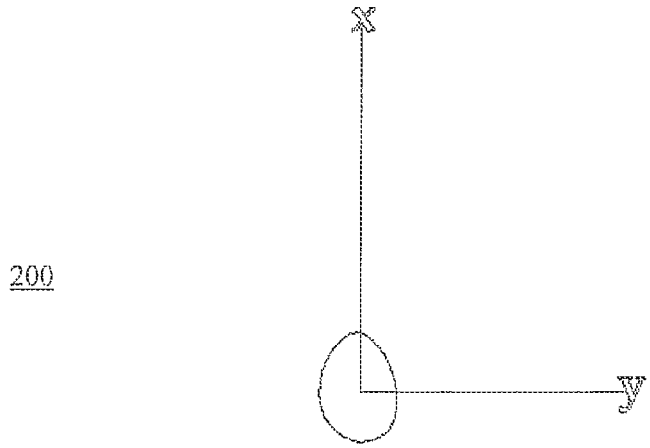
Fig. 10.1

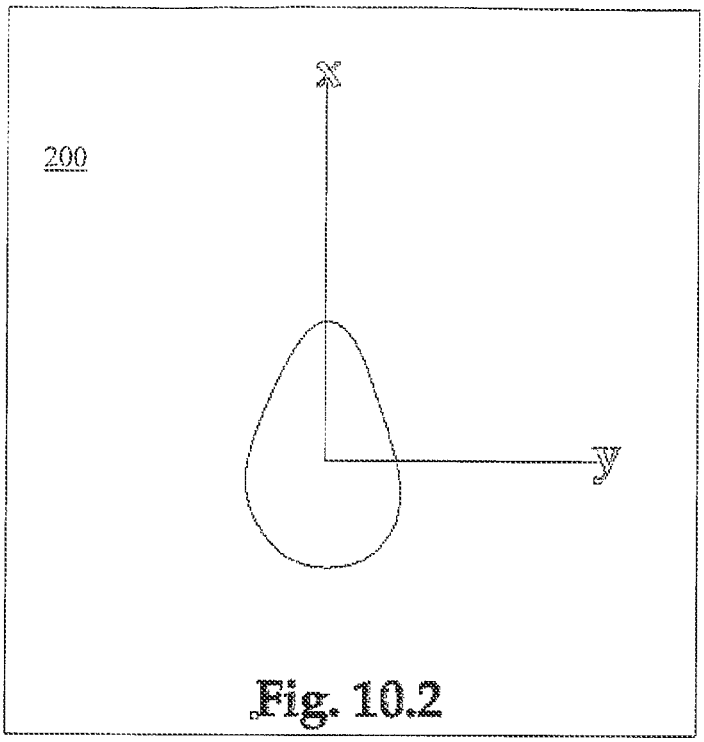
Fig. 10.2
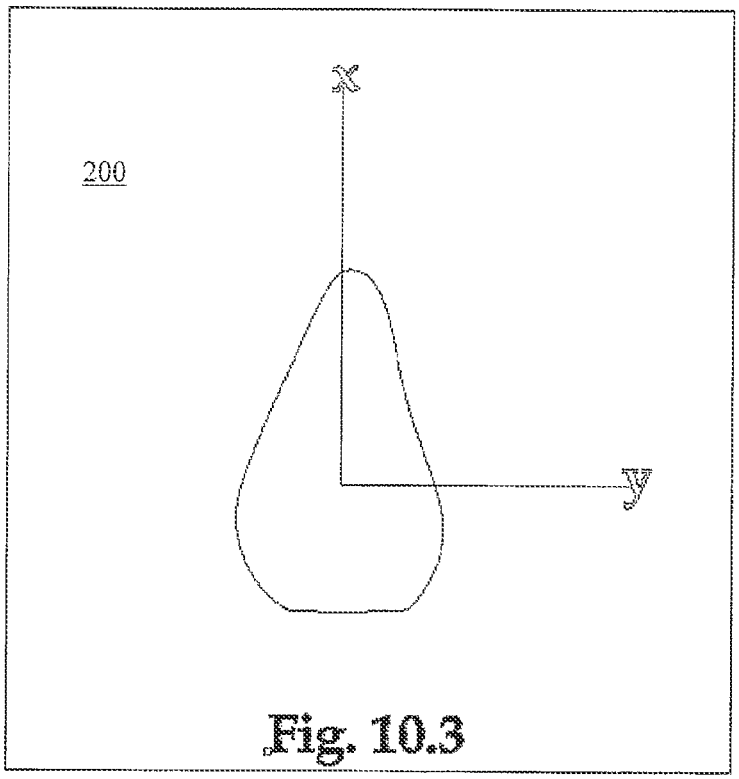
Fig. 10.3

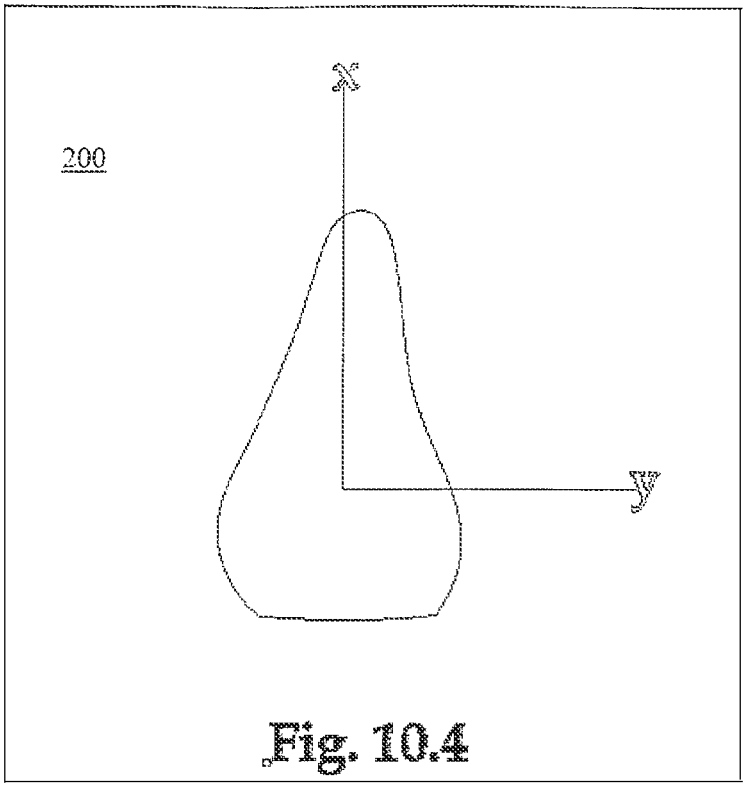
Fig. 10.4
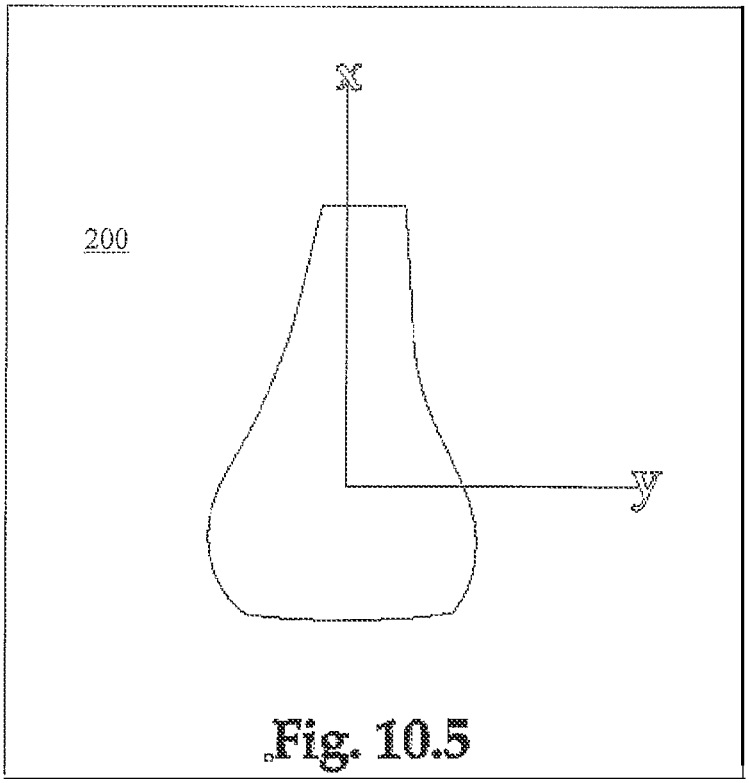
Fig. 10.5

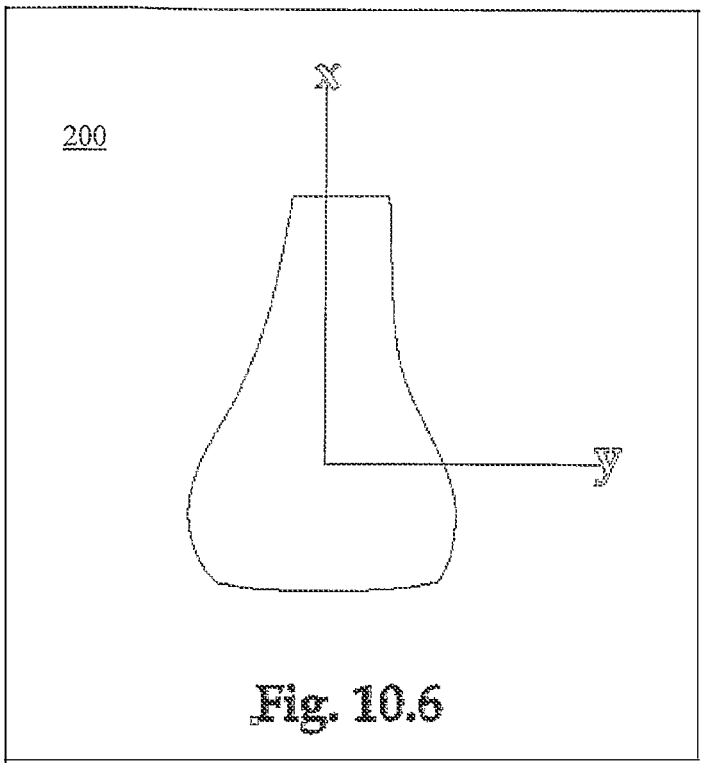
Fig. 10.6
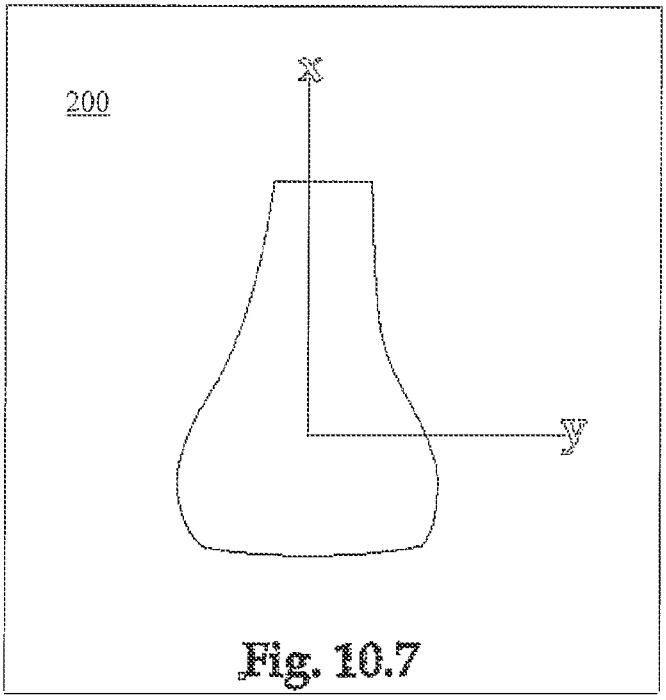
Fig. 10.7

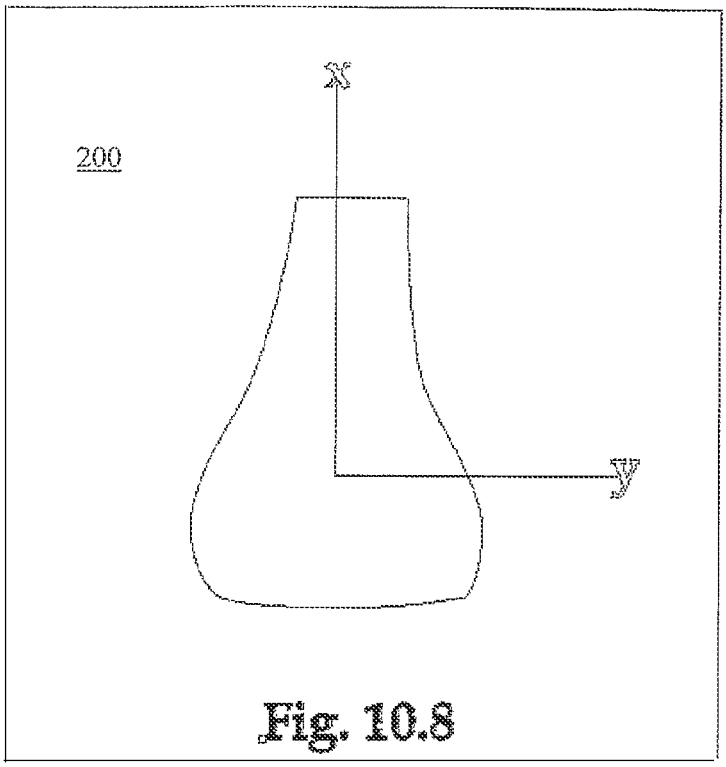
Fig. 10.8
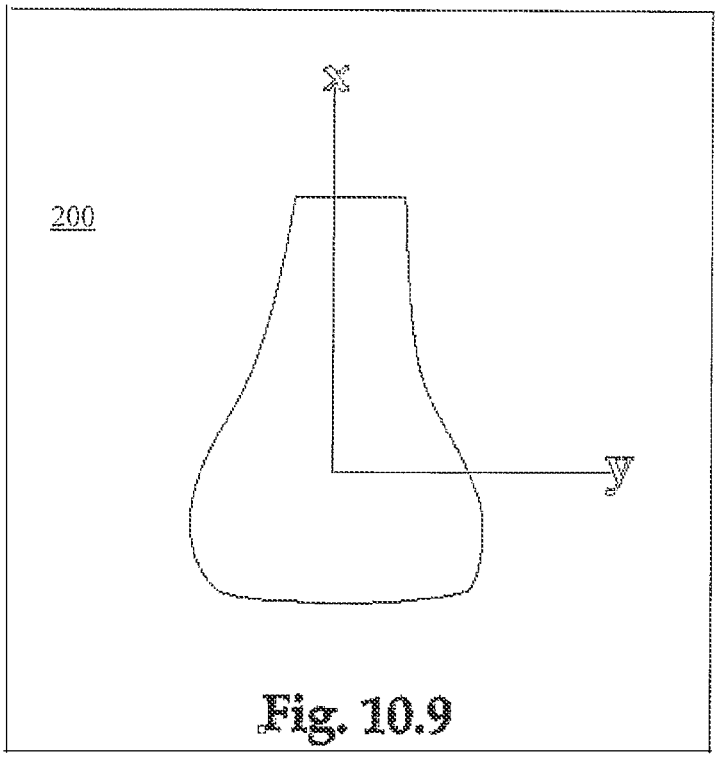
Fig. 10.9

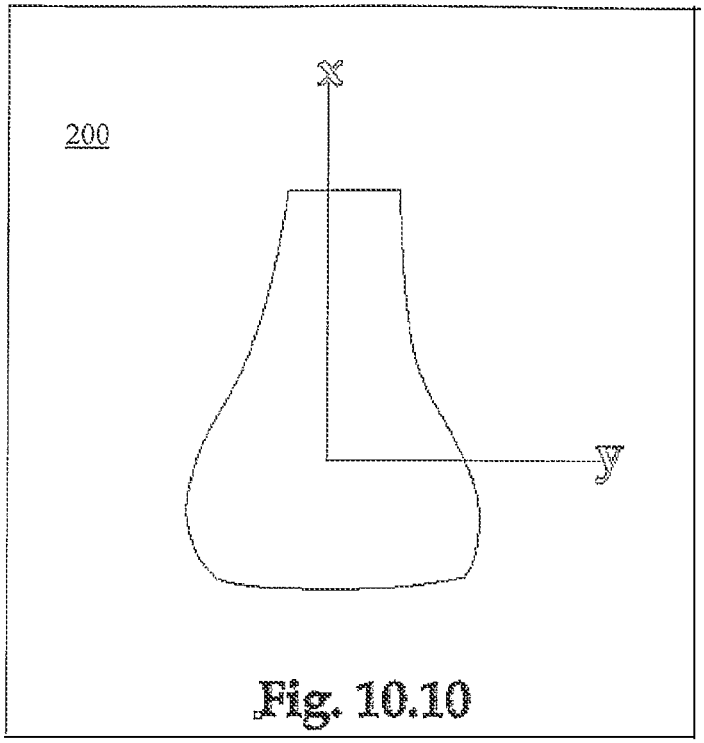
Fig. 10.10
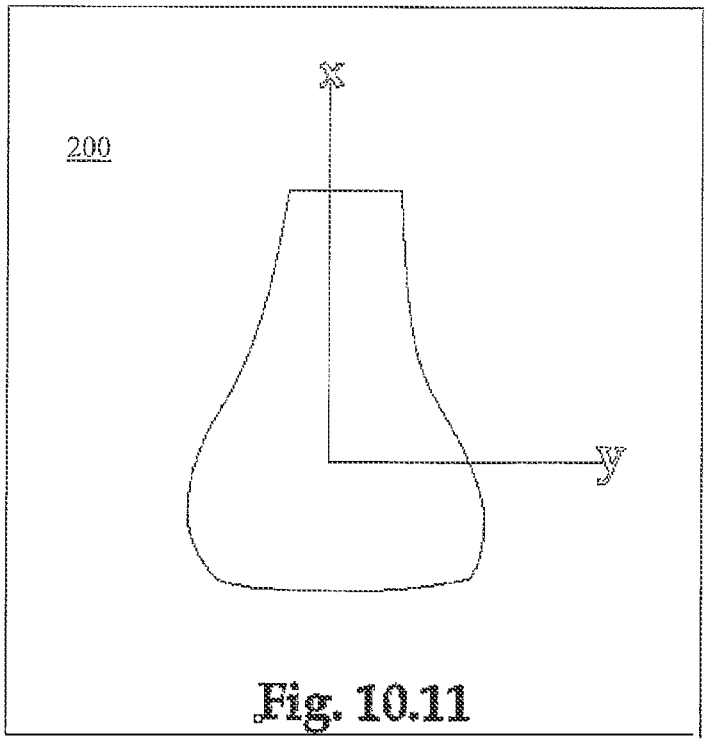
Fig. 10.11

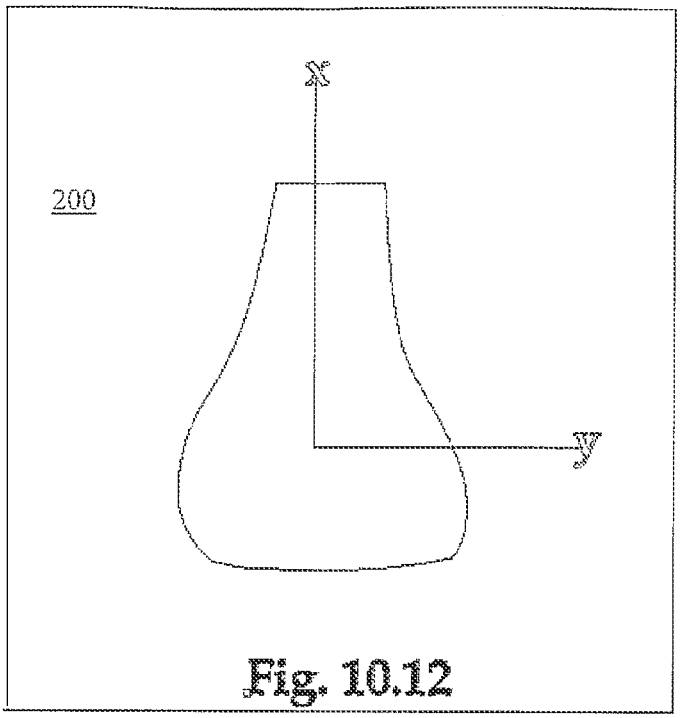
Fig. 10.12
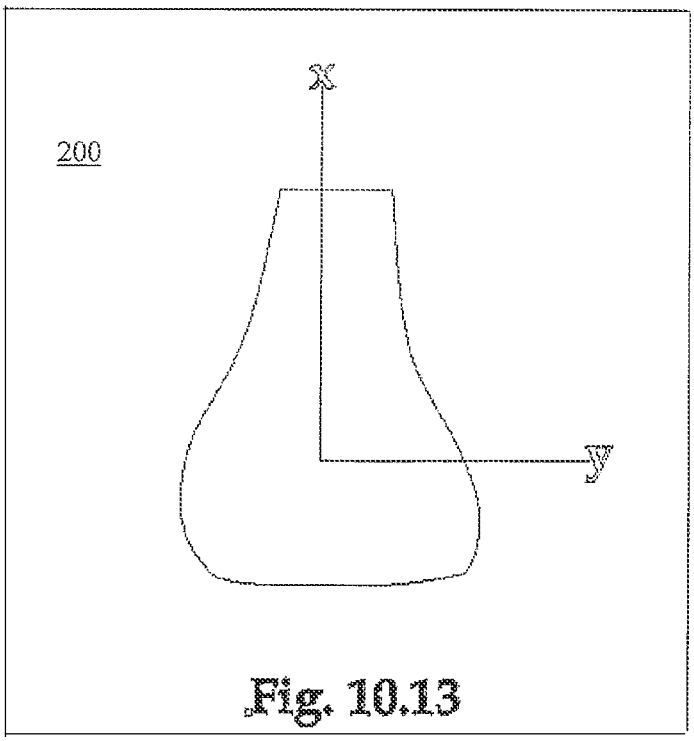
Fig. 10.13

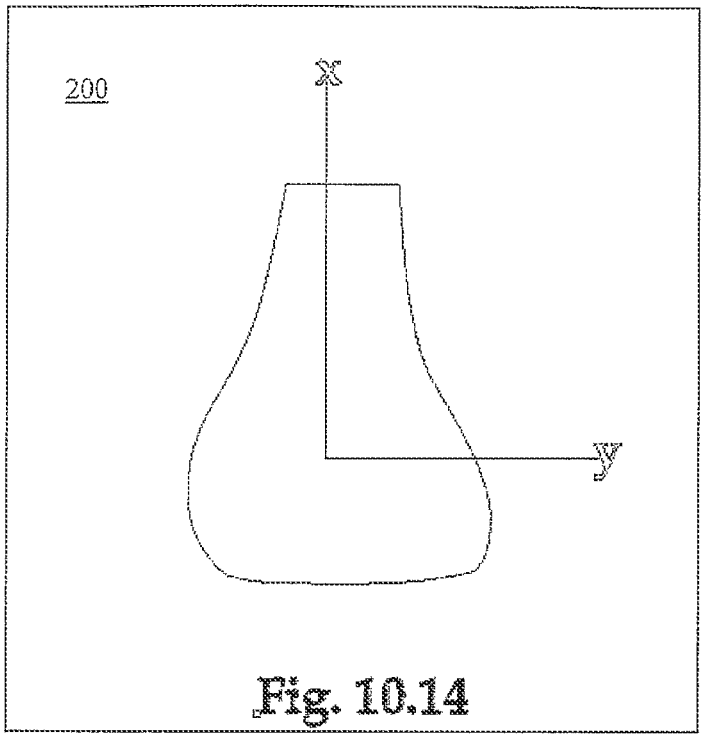
Fig. 10.14
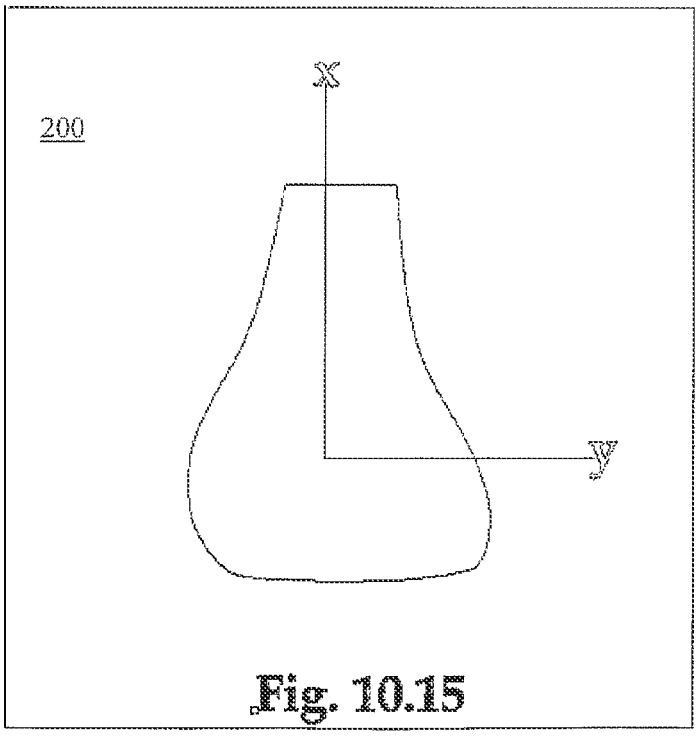
Fig. 10.15

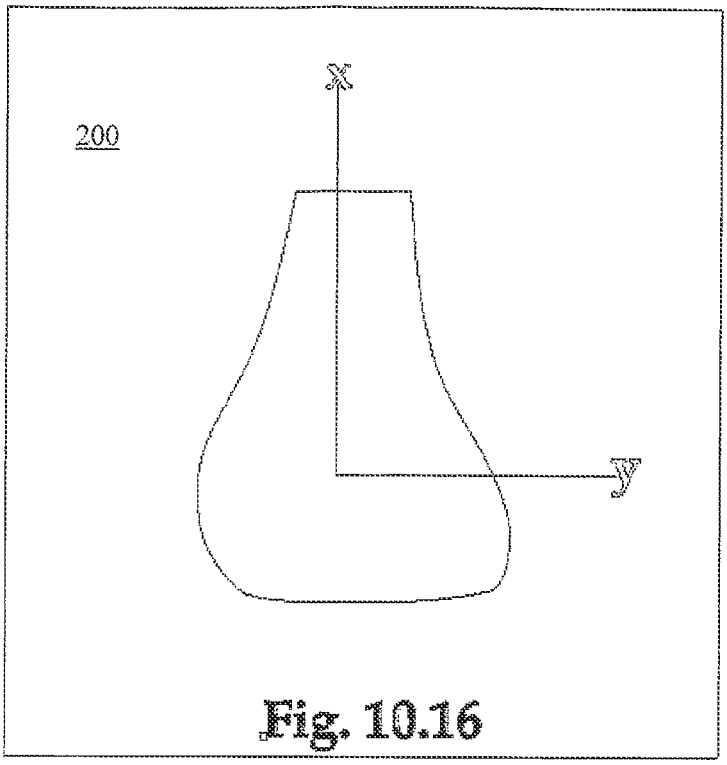
Fig. 10.16
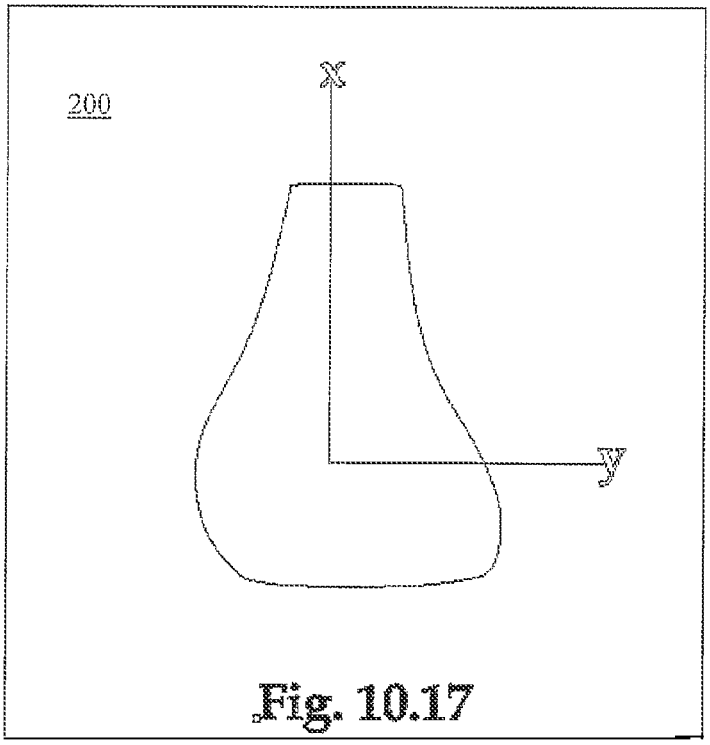
Fig. 10.17

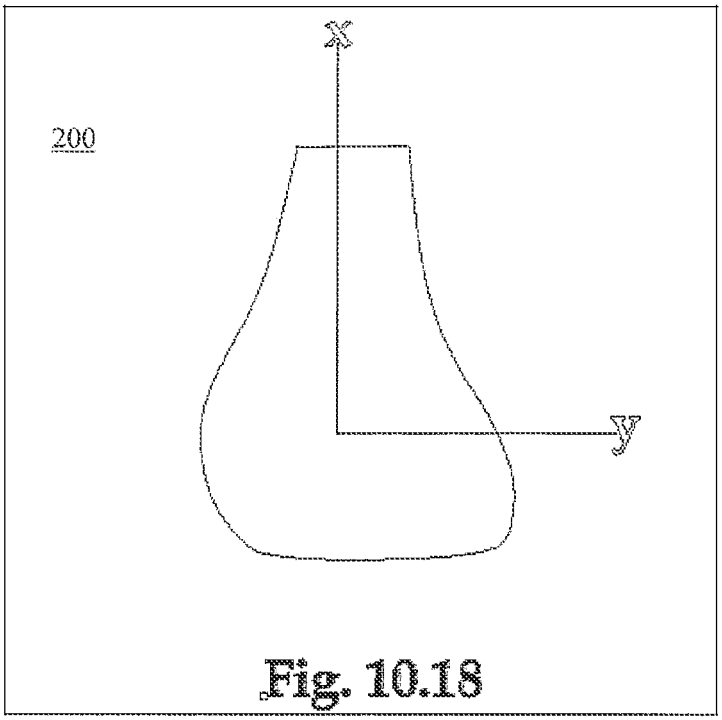
Fig. 10.18
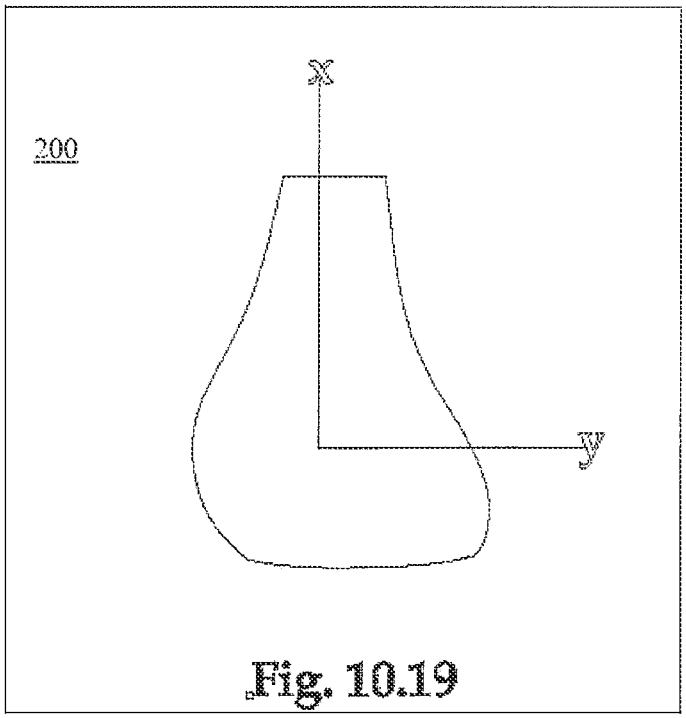
Fig. 10.19

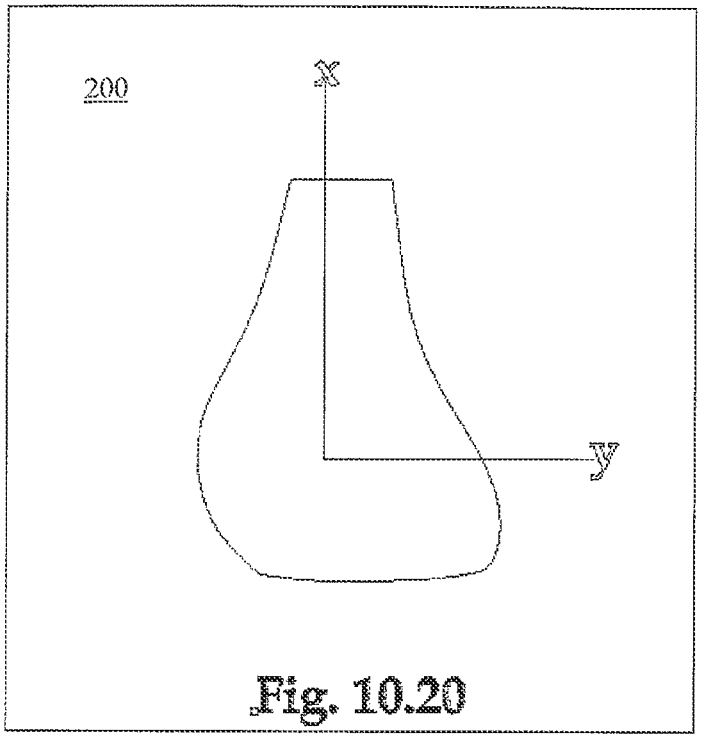
Fig. 10.20
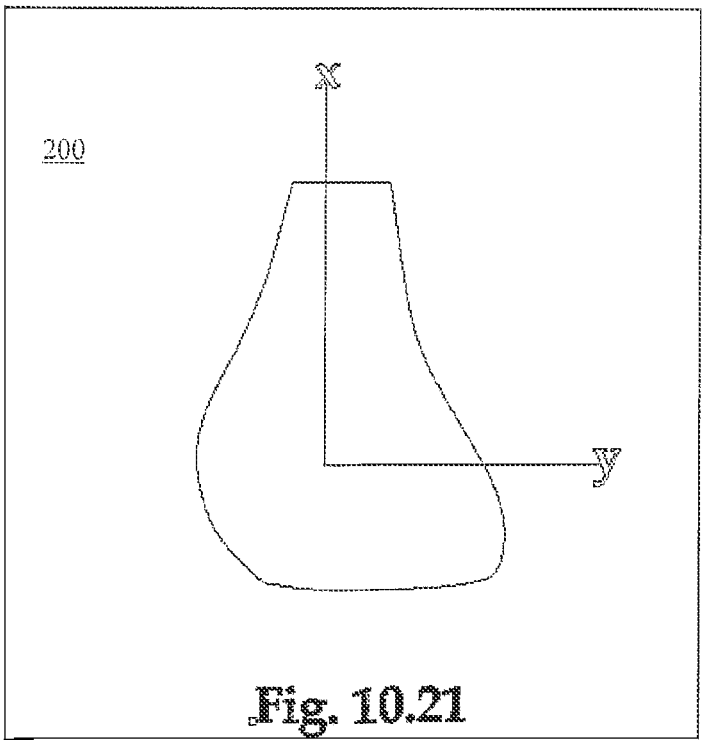
Fig. 10.21

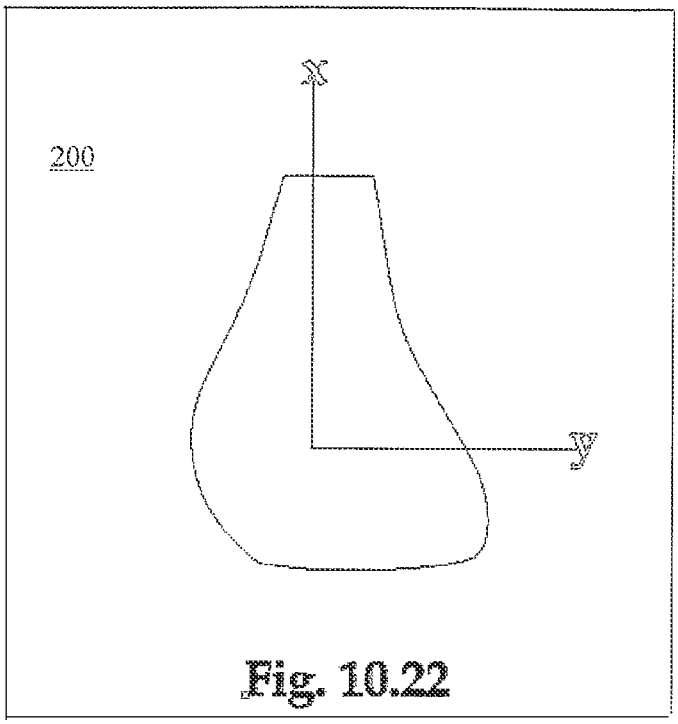
Fig. 10.22
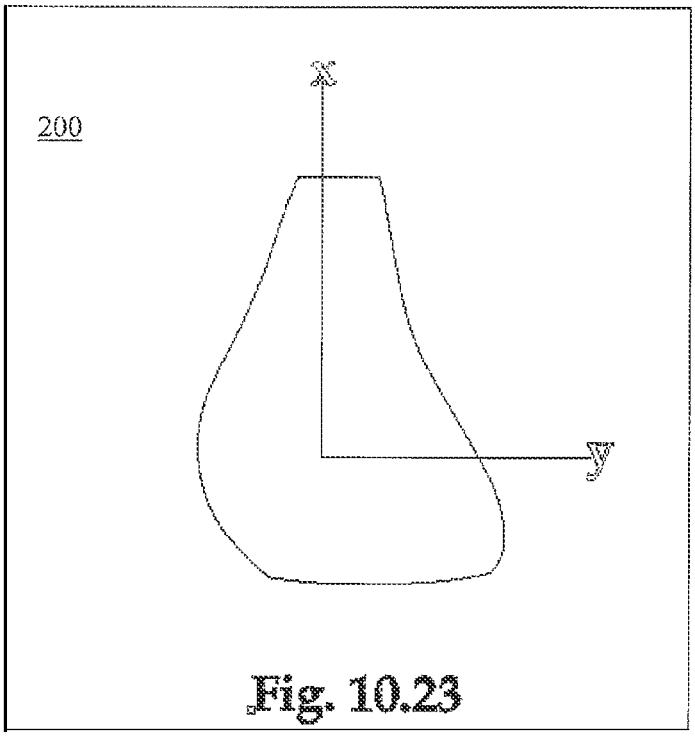
Fig. 10.23

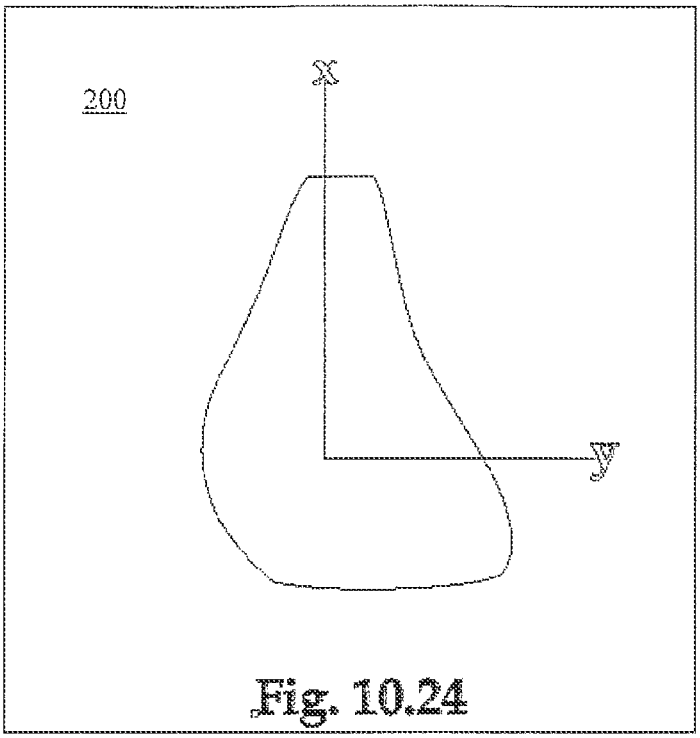
Fig. 10.24
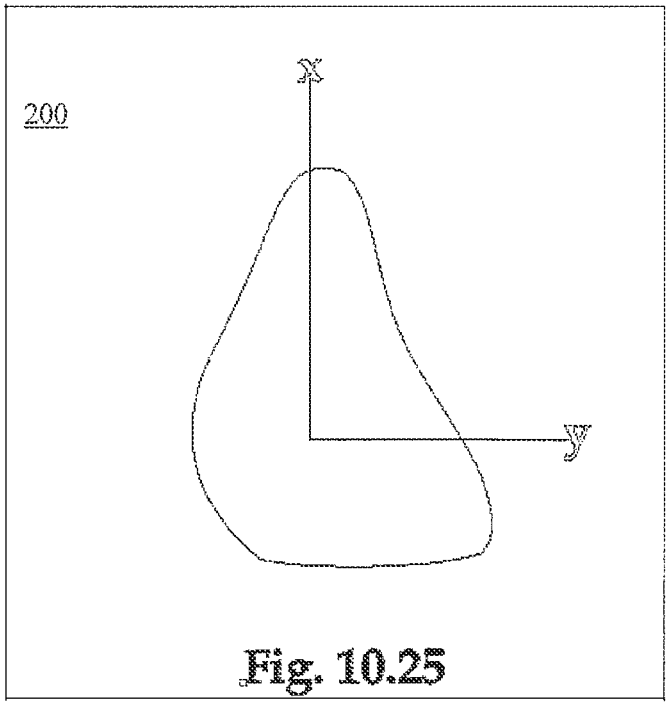
Fig. 10.25

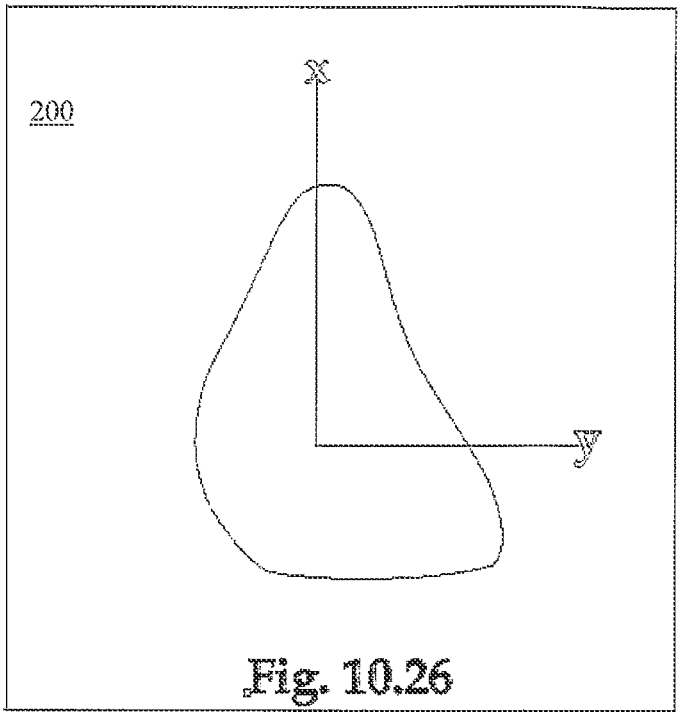
Fig. 10.26
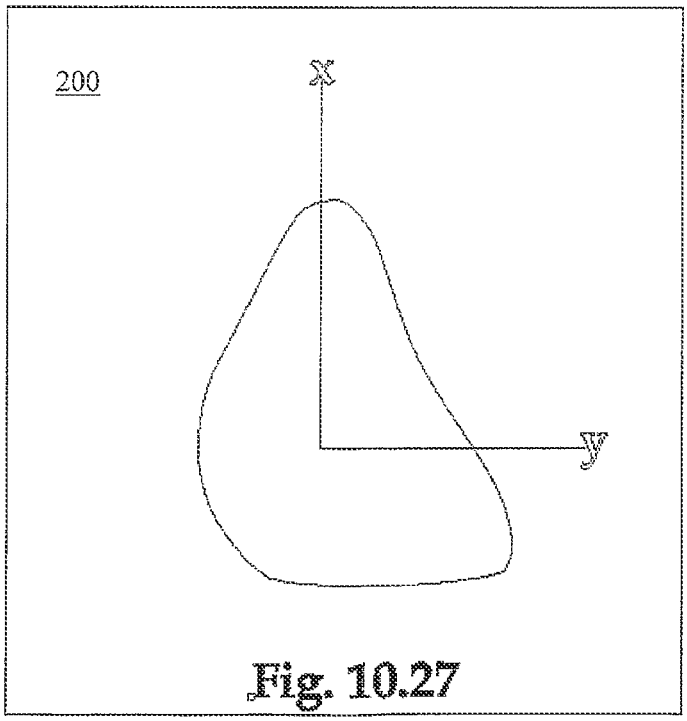
Fig. 10.27

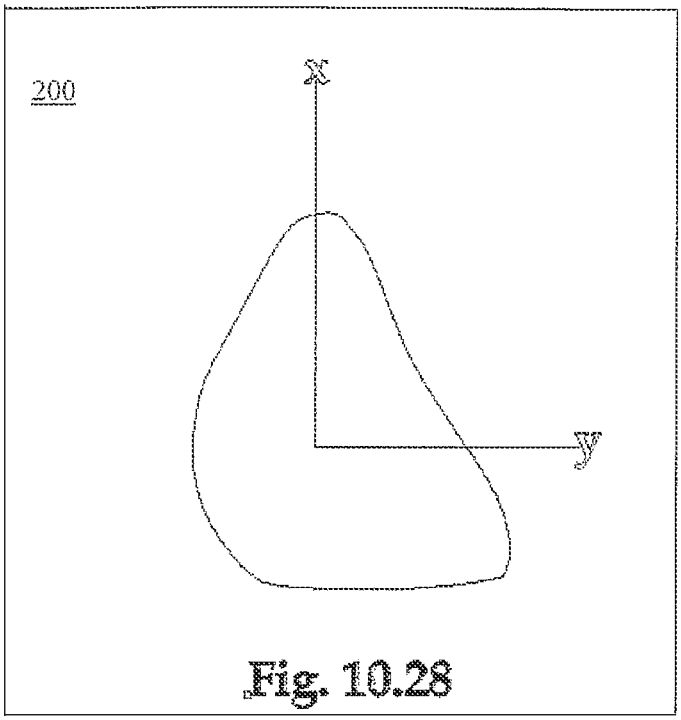
Fig. 10.28
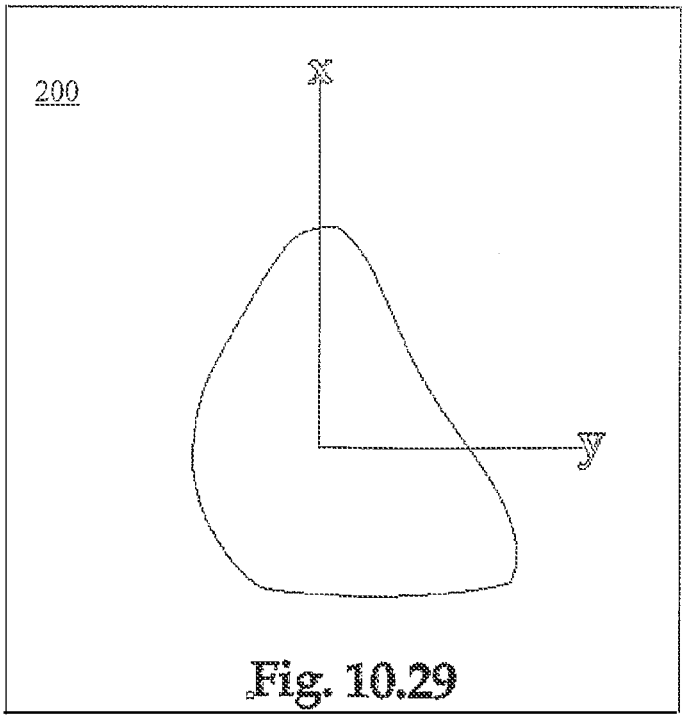
Fig. 10.29

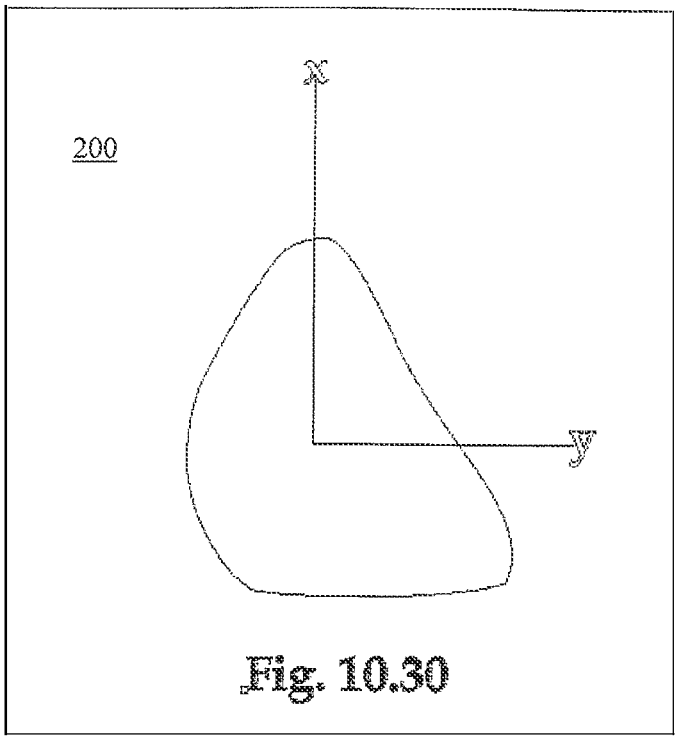
Fig. 10.30
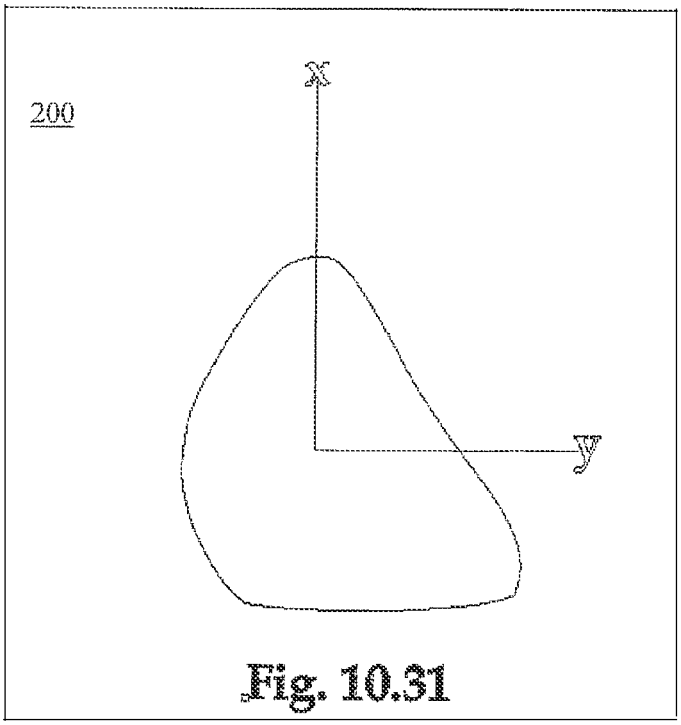
Fig. 10.31

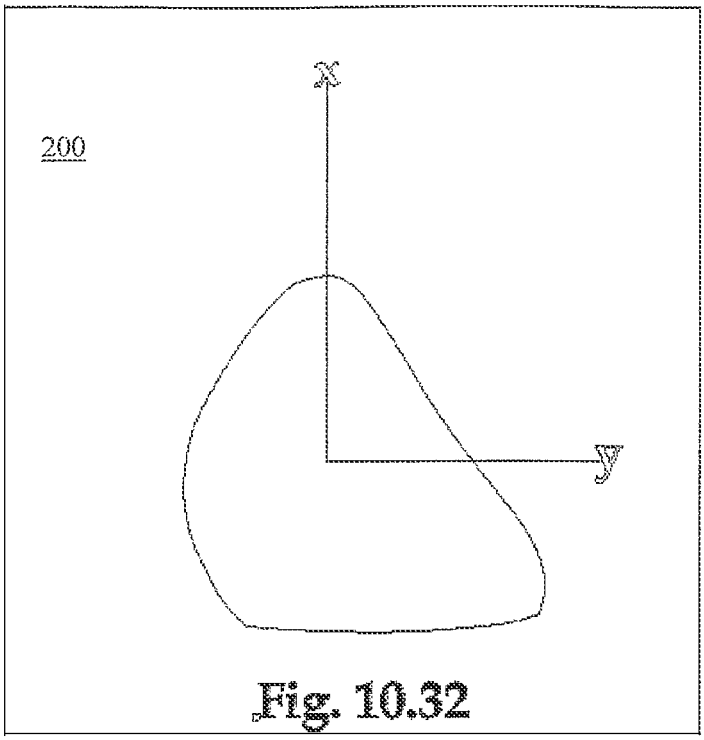
Fig. 10.32
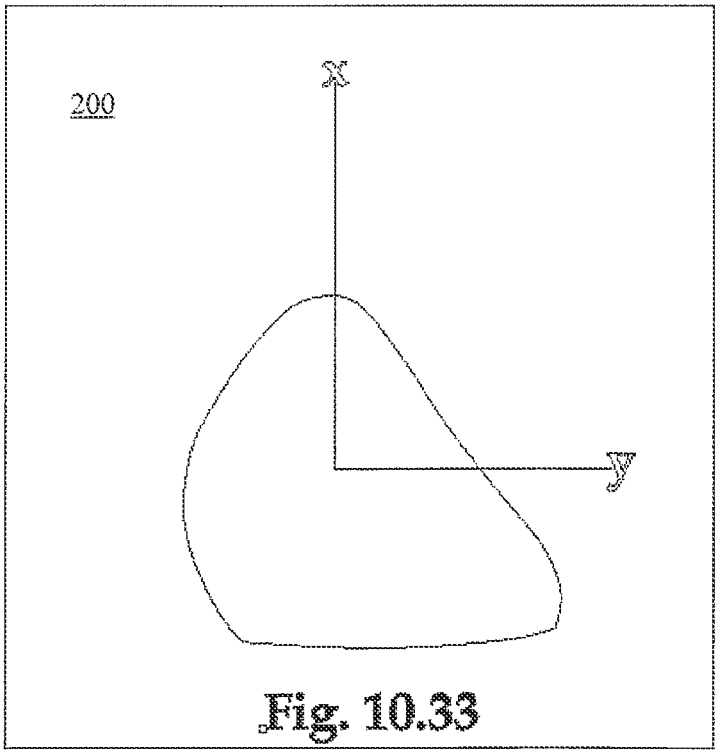
Fig. 10.33

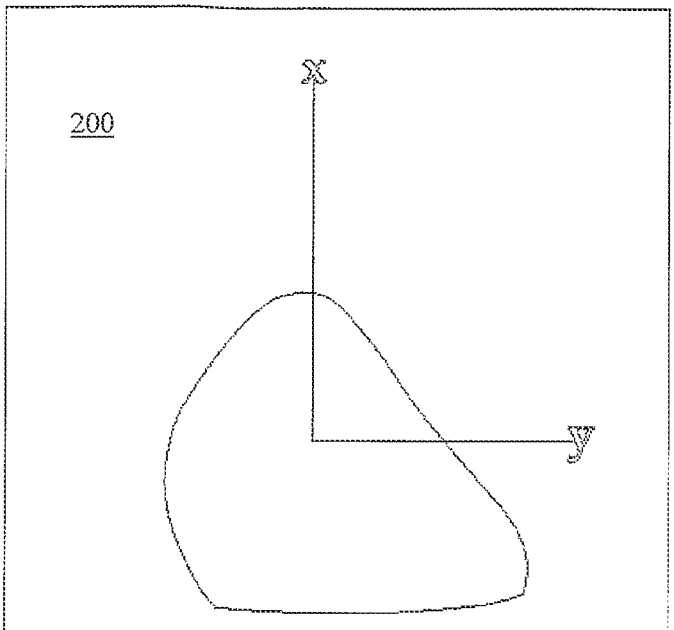
Fig. 10.34
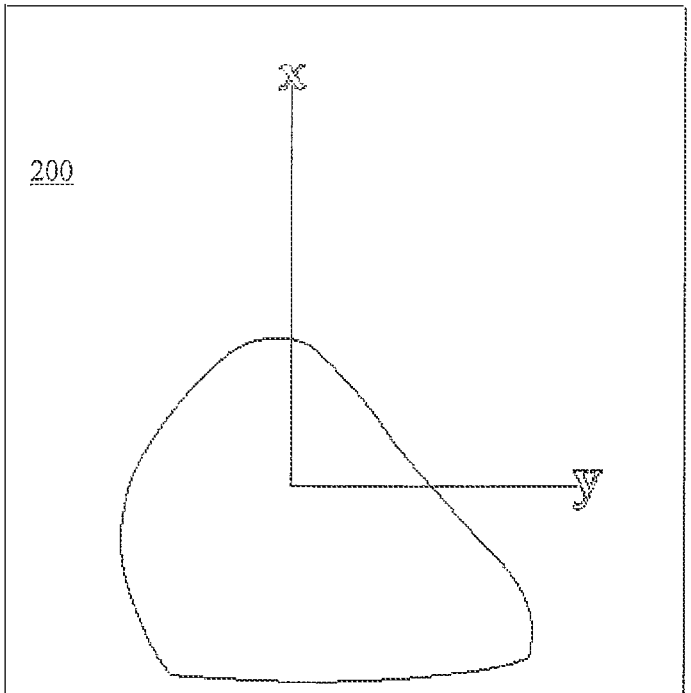
Fig. 10.35

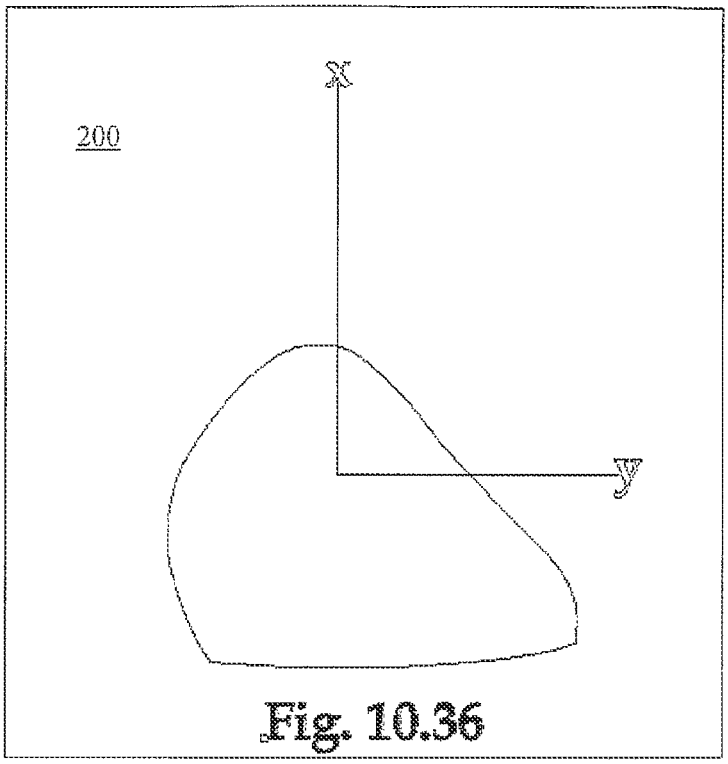
Fig. 10.36
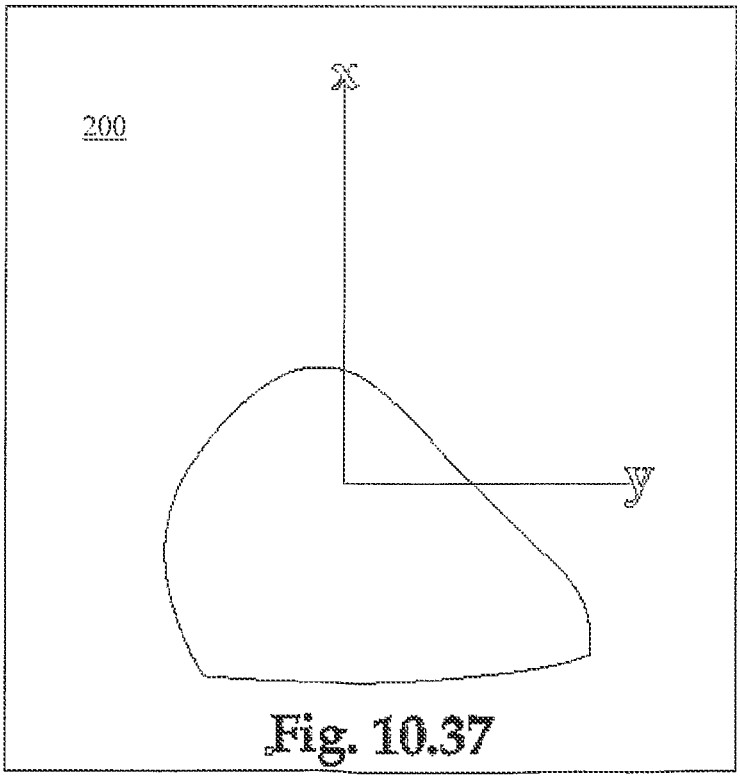
Fig. 10.37

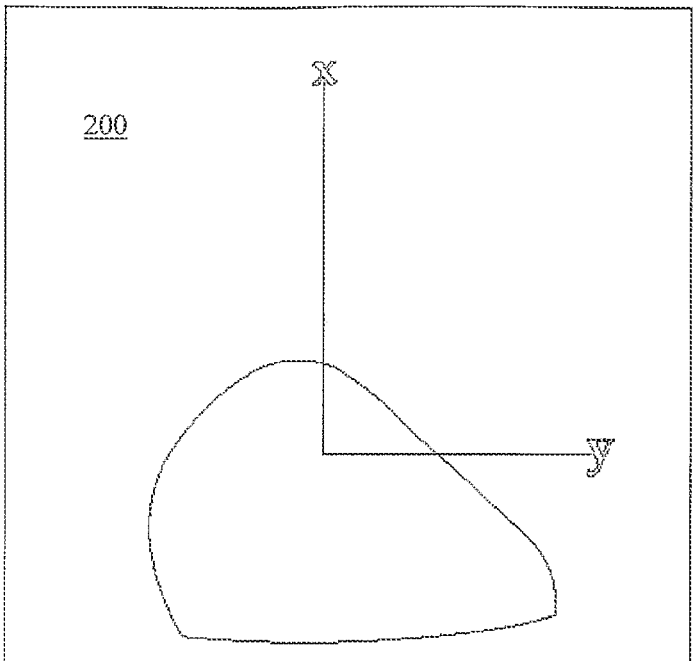
Fig. 10.38
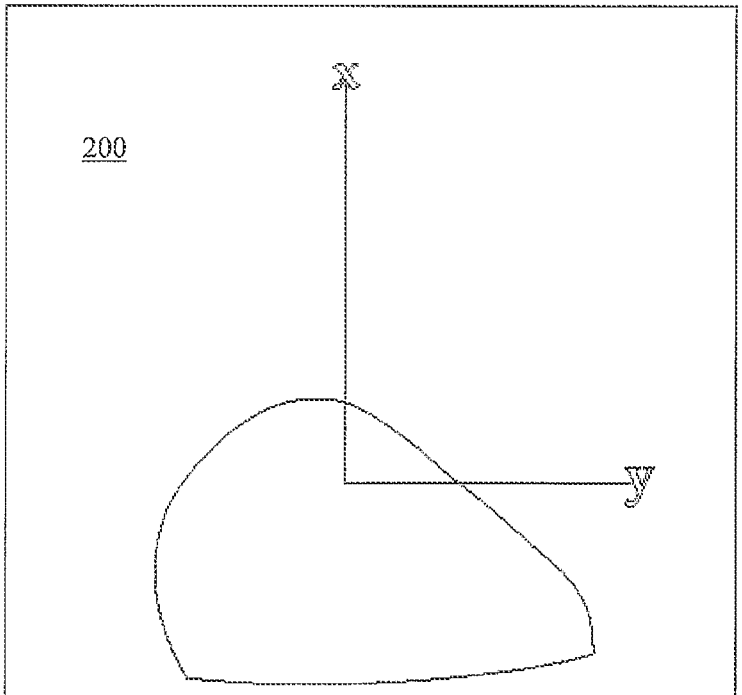
Fig. 10.39

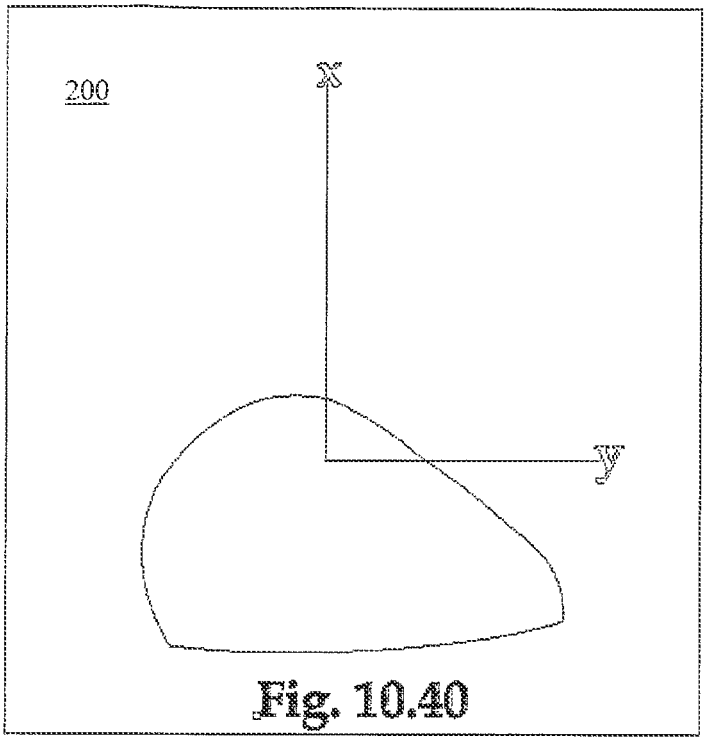
Fig. 10.40
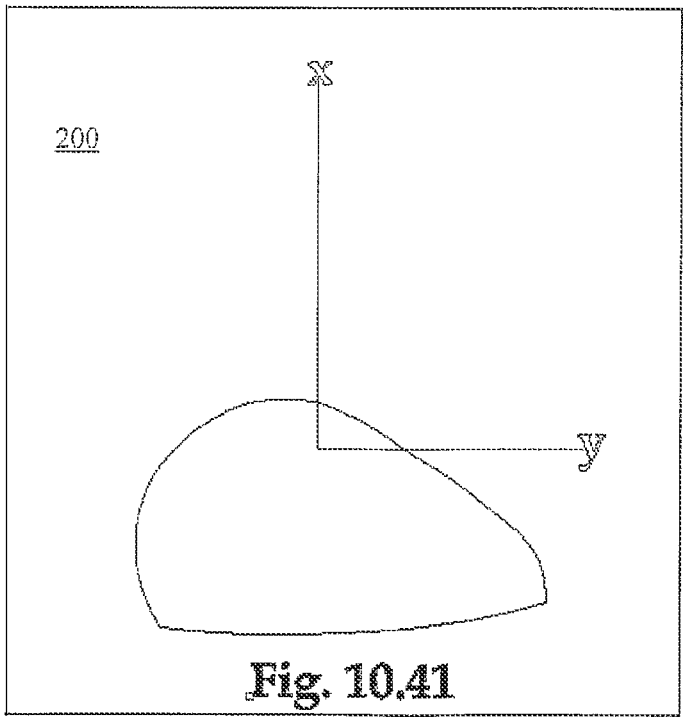
Fig. 10.41

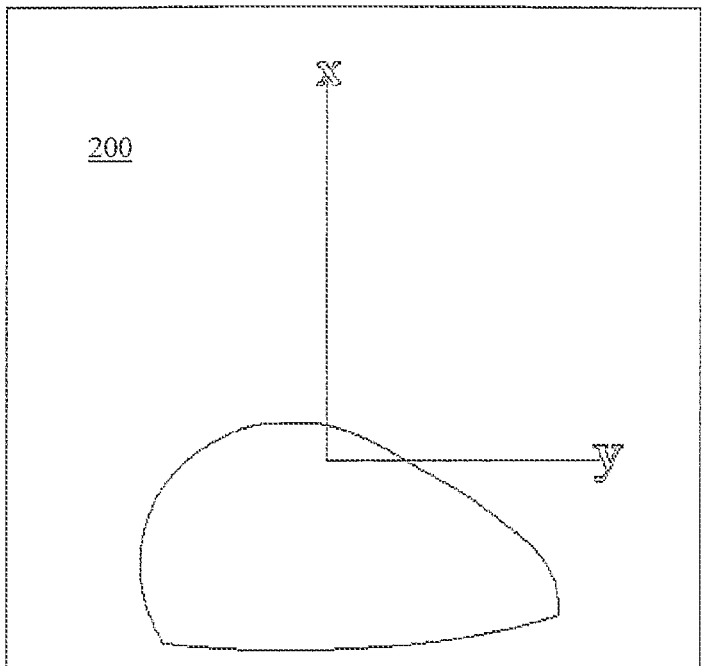
Fig. 10.42
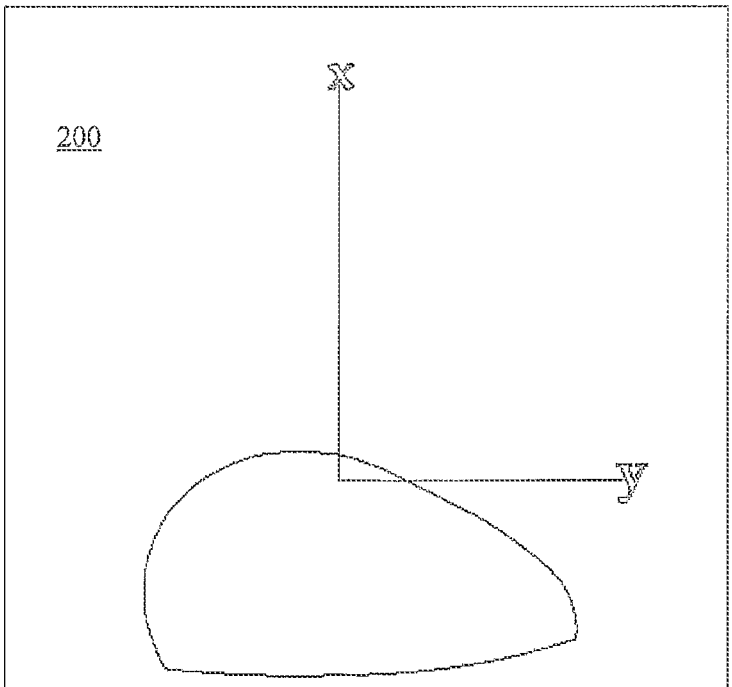
Fig. 10.43

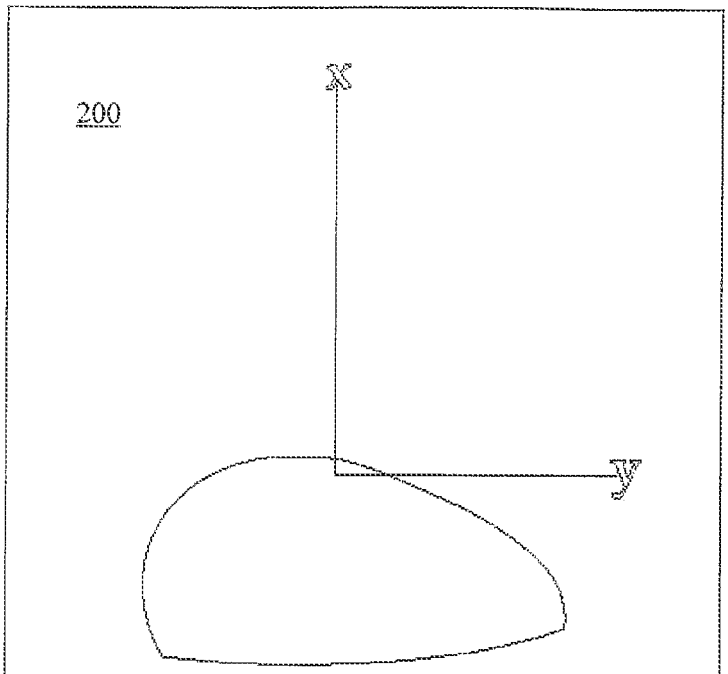
Fig. 10.44
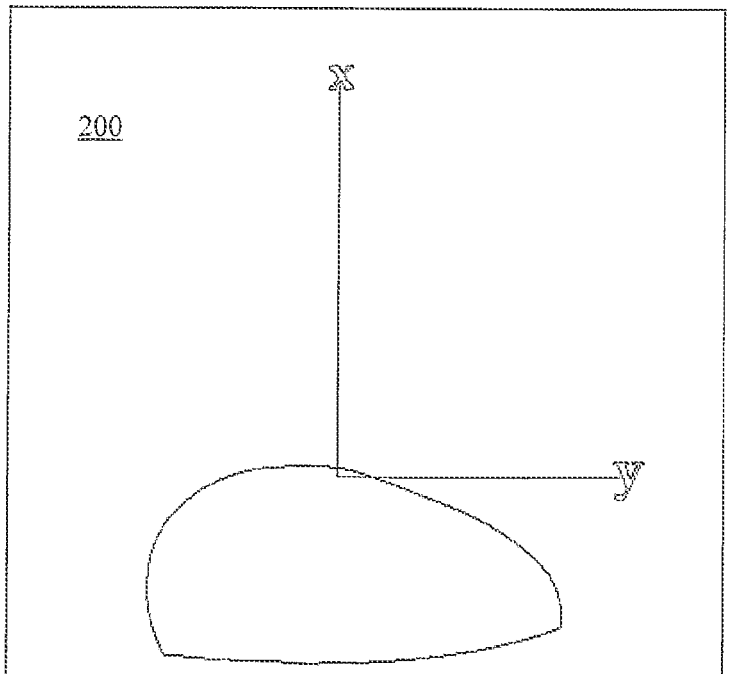
Fig. 10.45

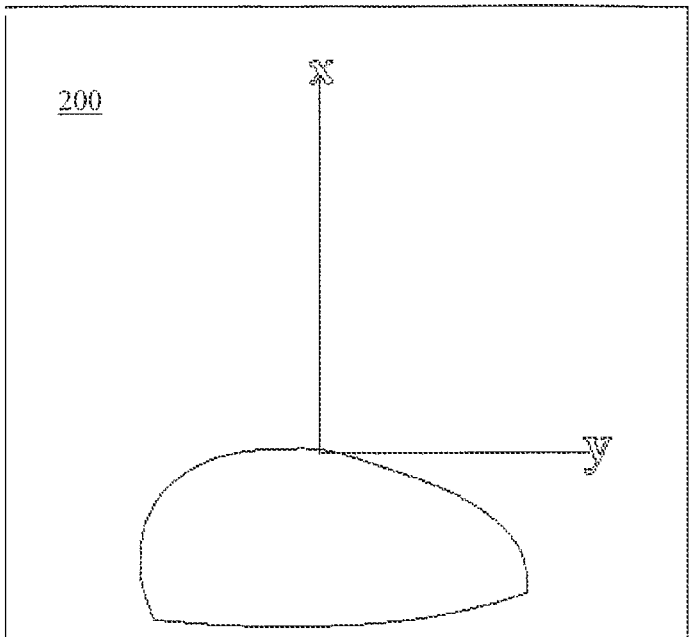
Fig. 10.46
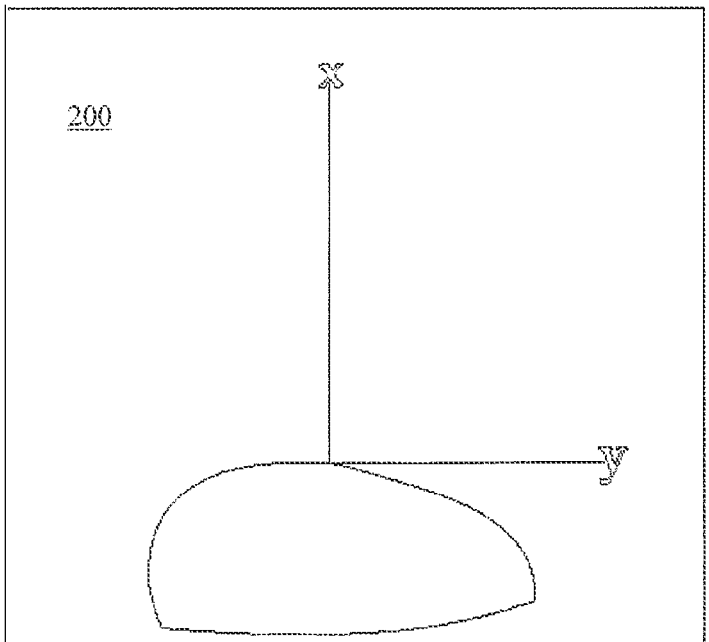
Fig. 10.47

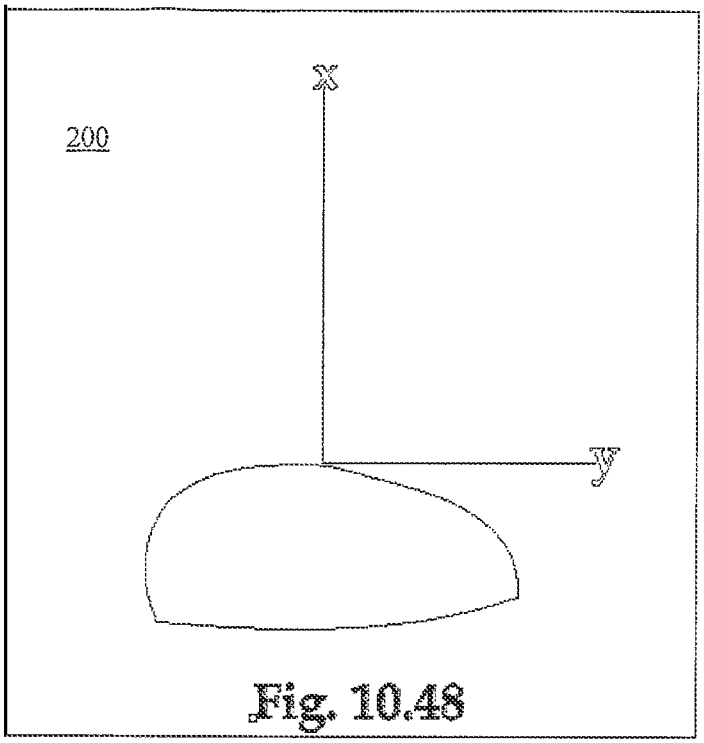
Fig. 10.48
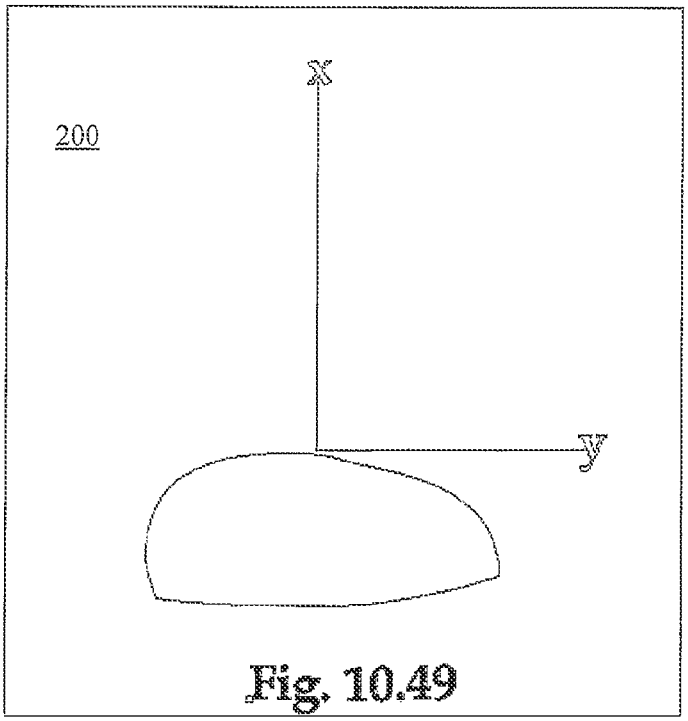
Fig. 10.49

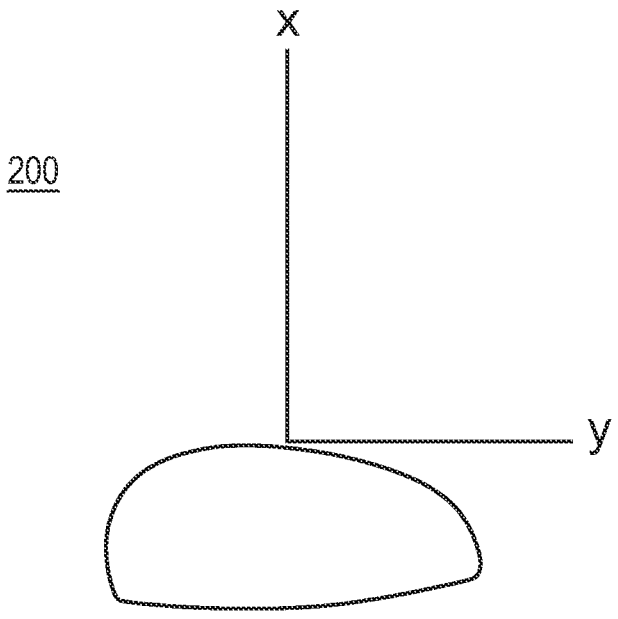
Fig. 10.50
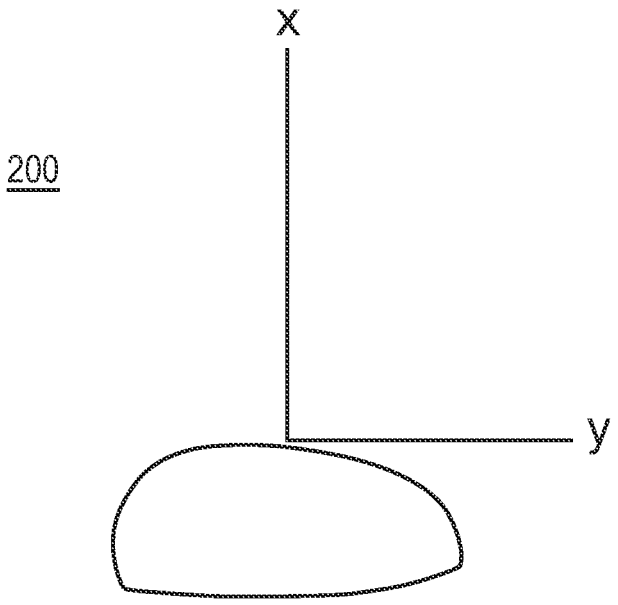
Fig. 10.51

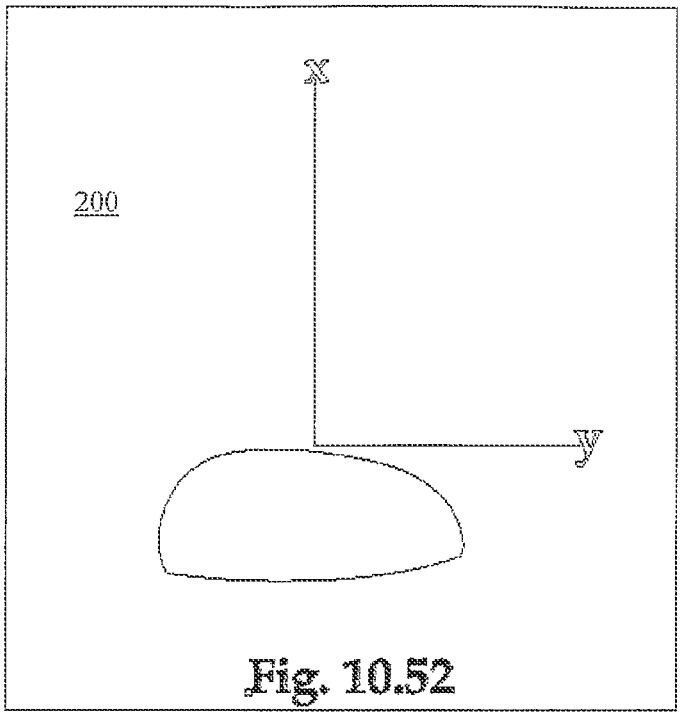
Fig. 10.52
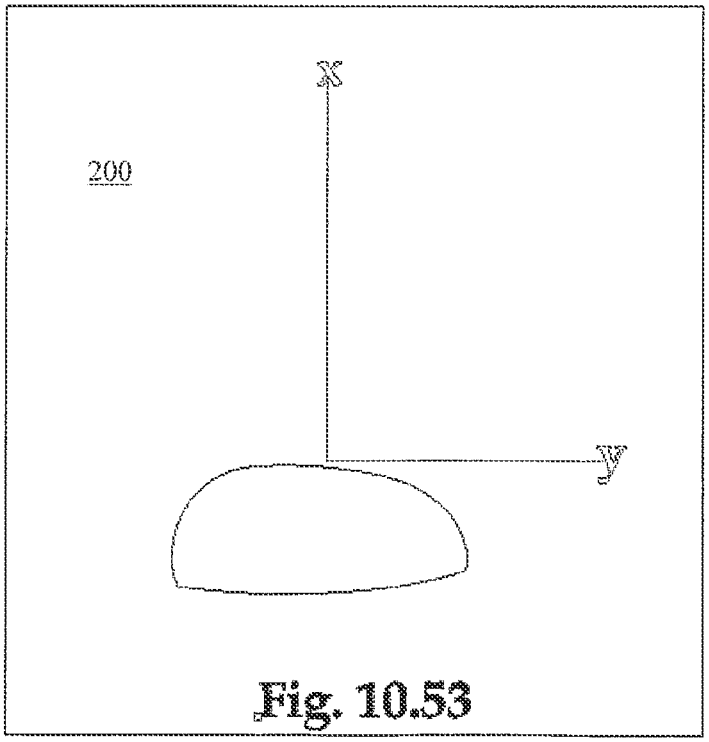
Fig. 10.53

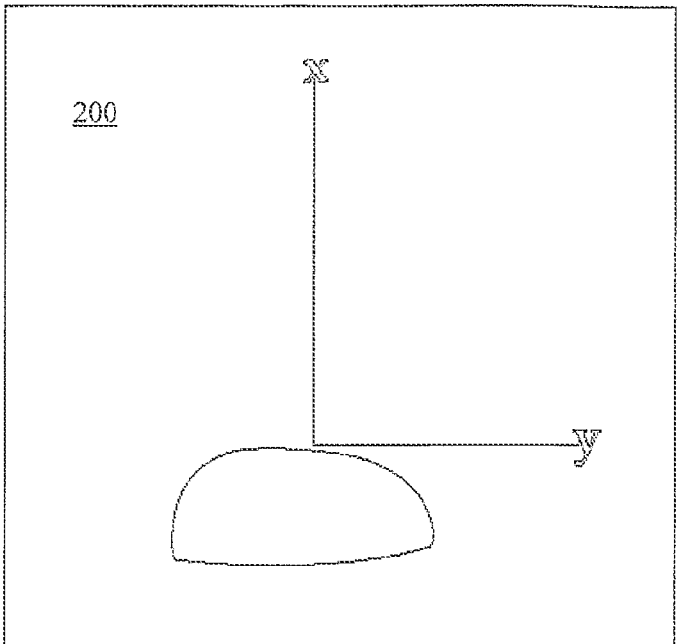
Fig. 10.54
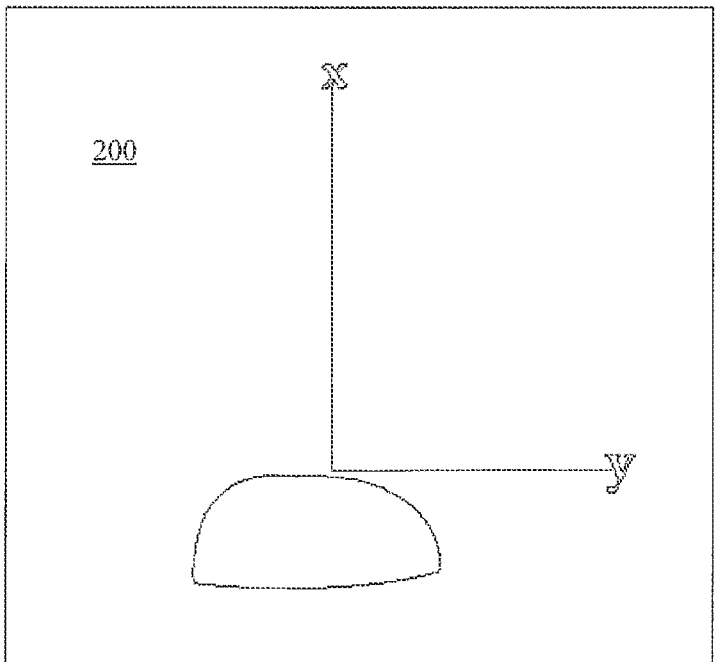
Fig. 10.55

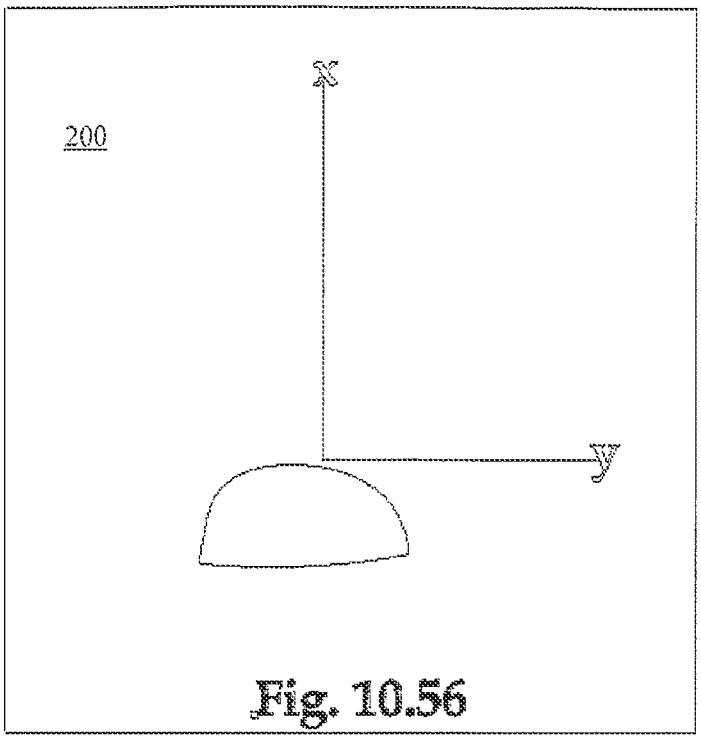
Fig. 10.56
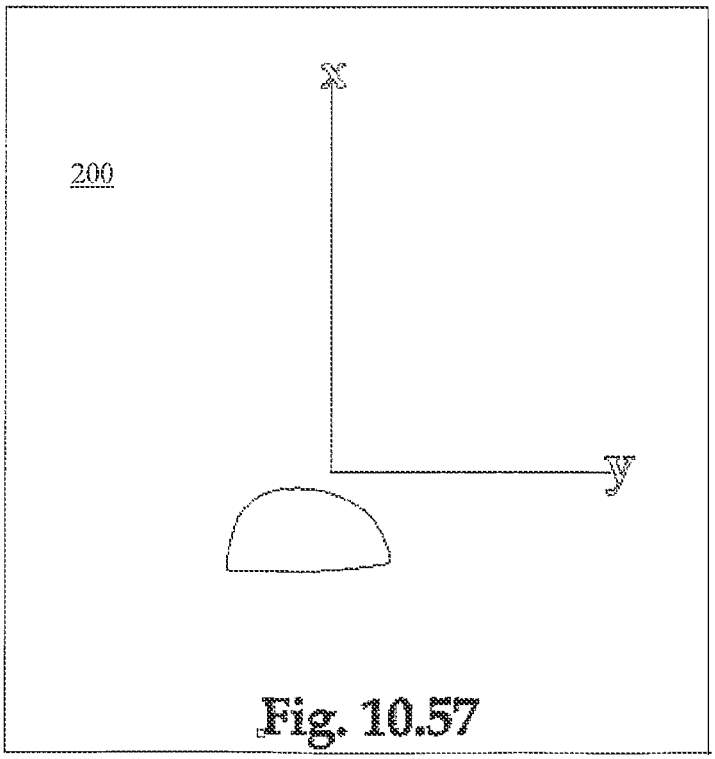
Fig. 10.57

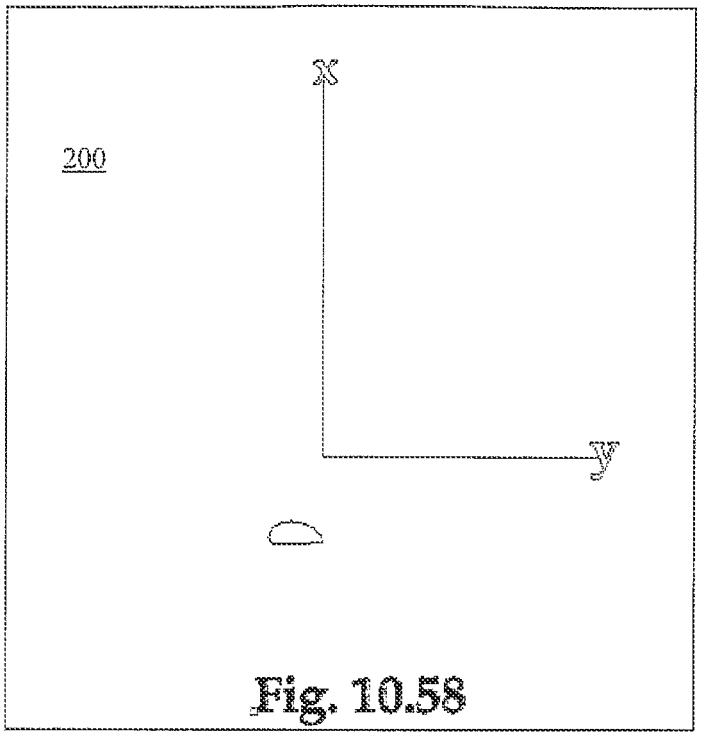
Fig. 10.58
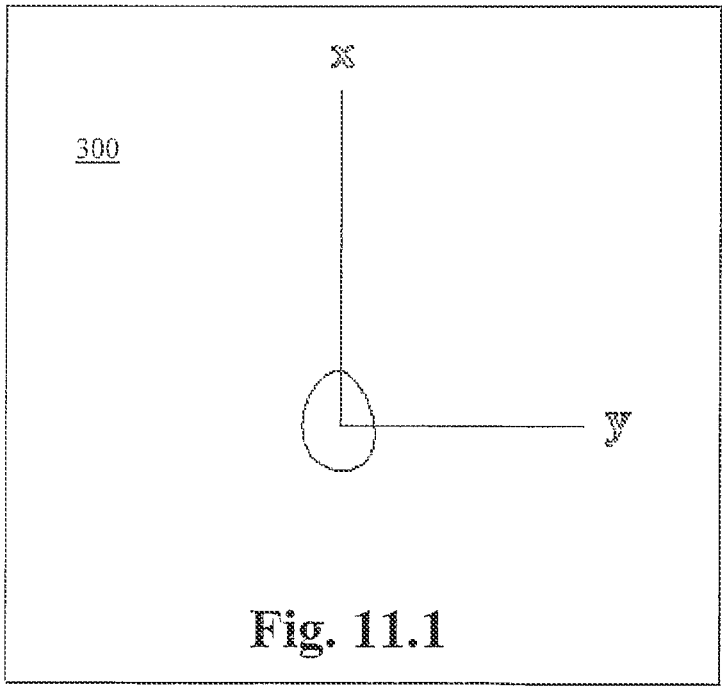
Fig. 11.1

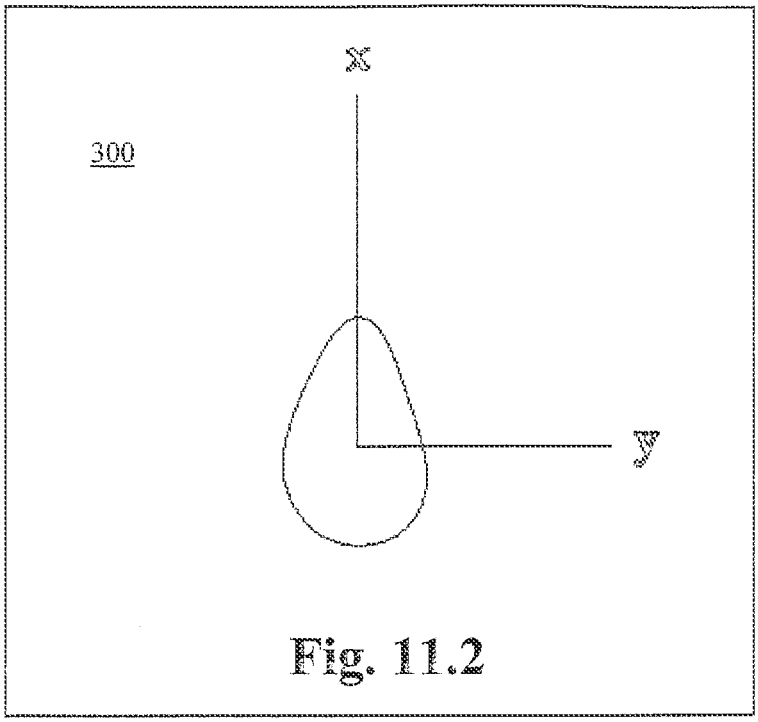
Fig. 11.2
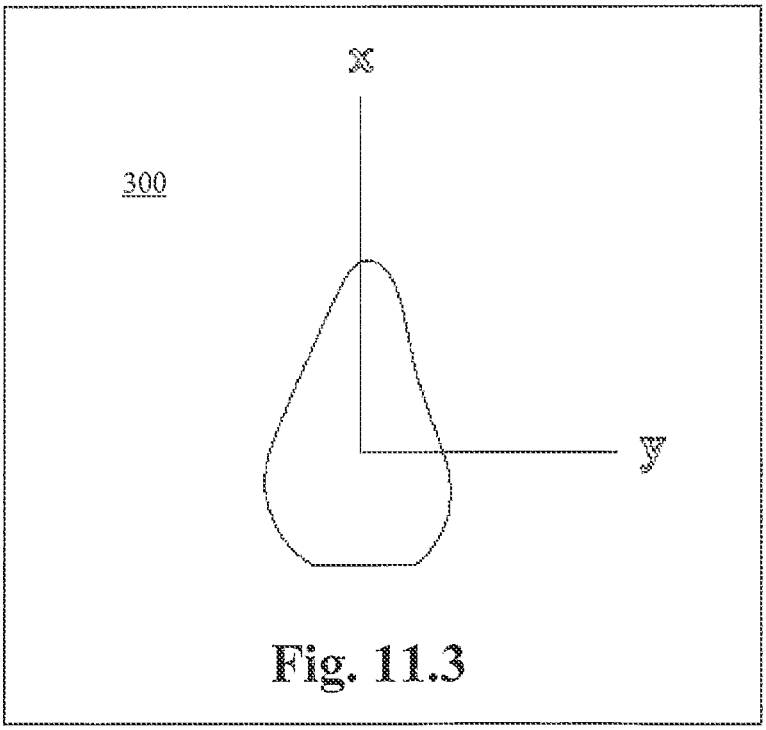
Fig. 11.3

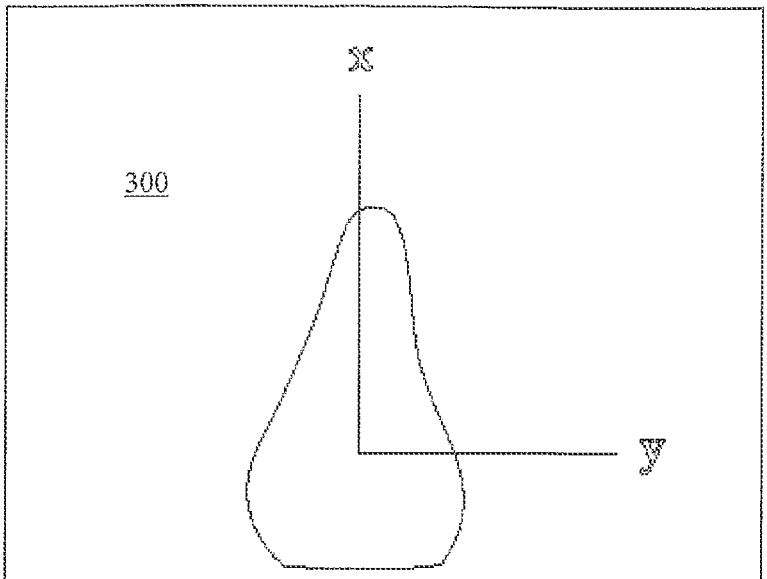
Fig. 11.4
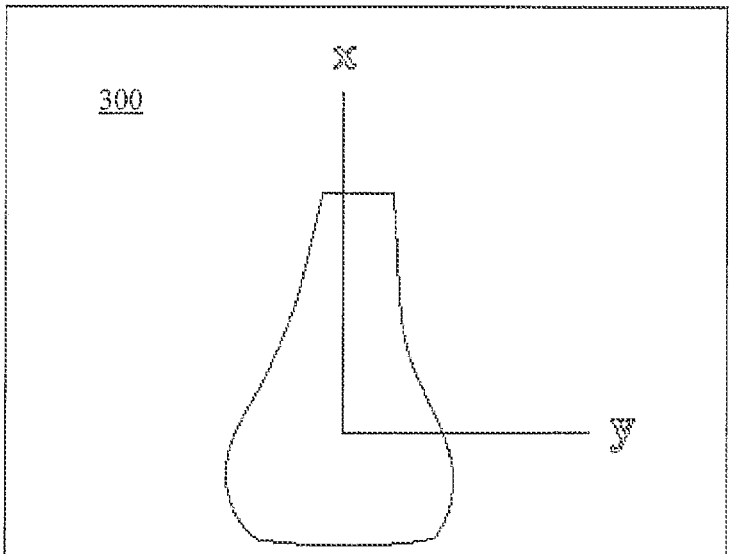
Fig. 11.5

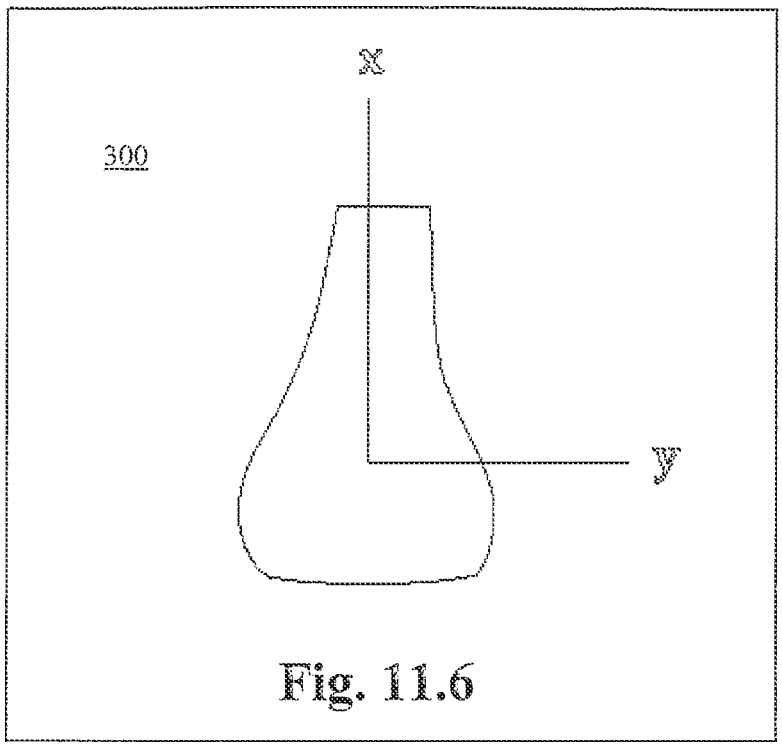
Fig. 11.6
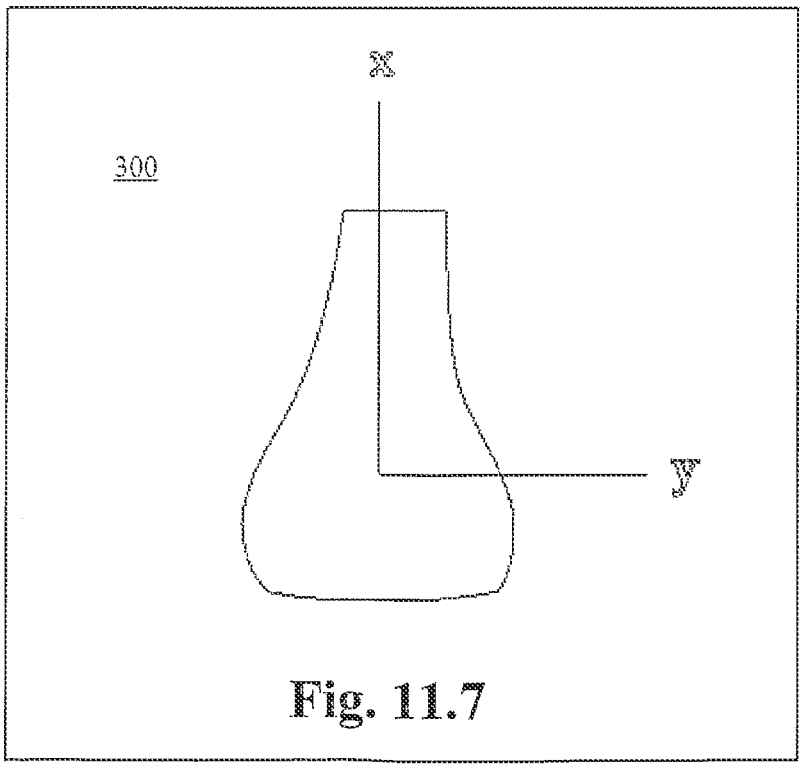
Fig. 11.7

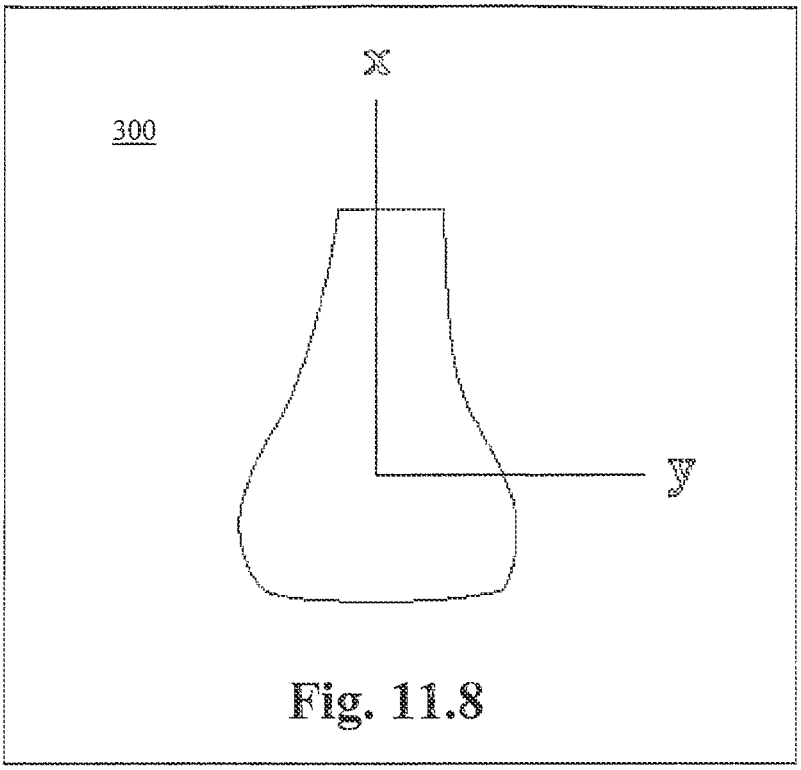
Fig. 11.8
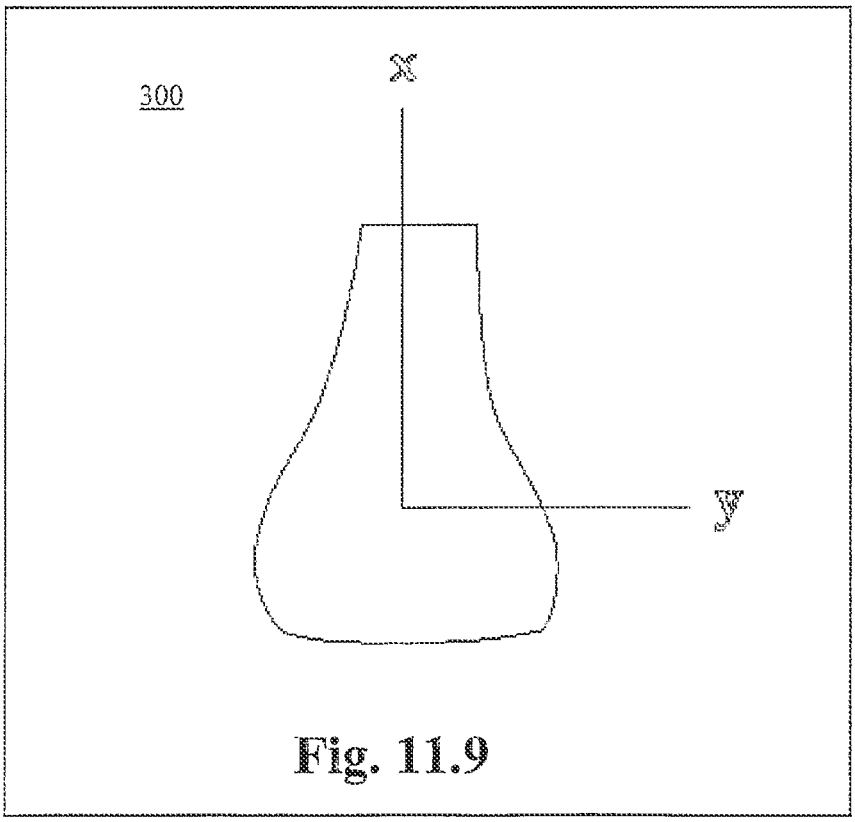
Fig. 11.9

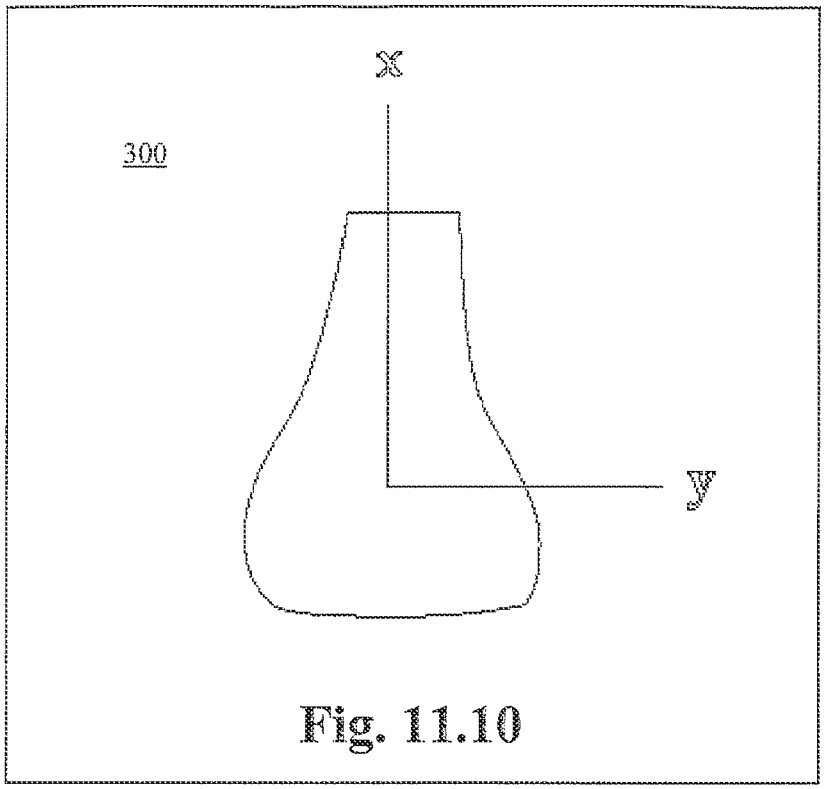
Fig. 11.10
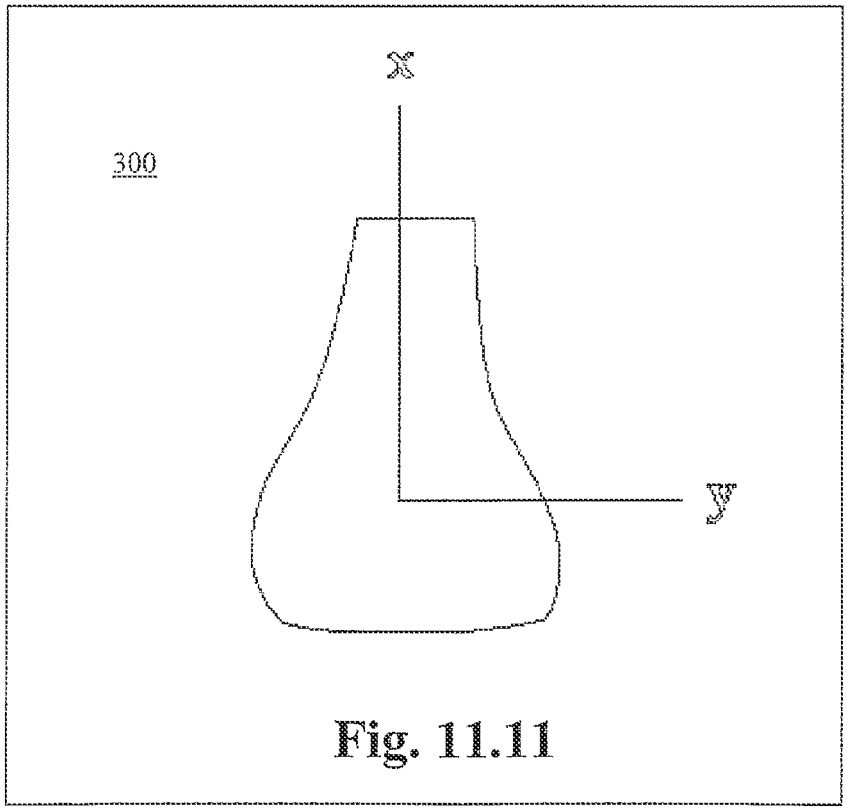
Fig. 11.11

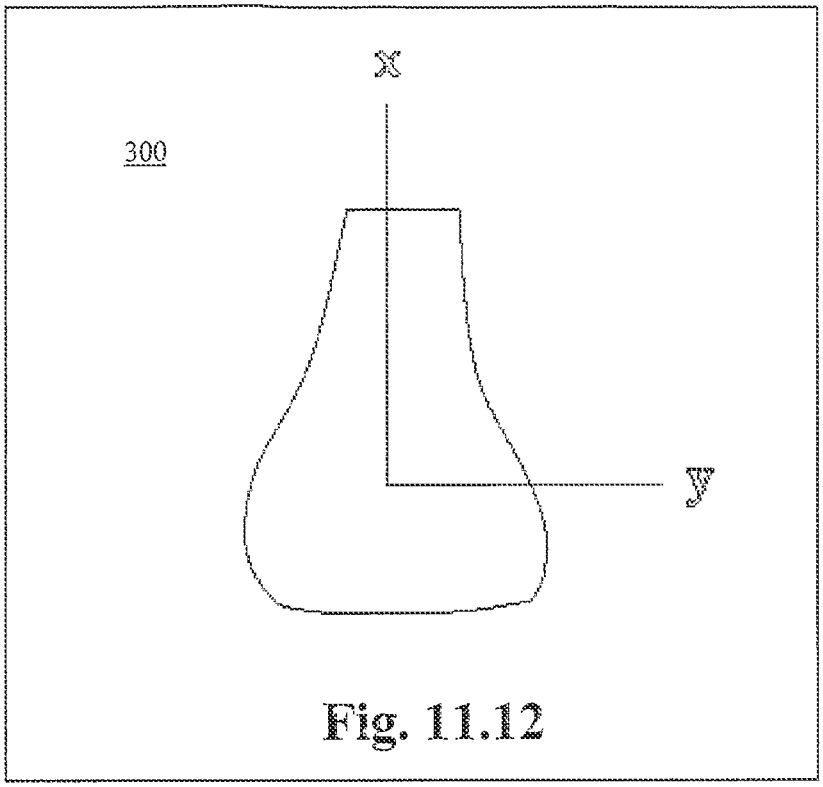
Fig. 11.12
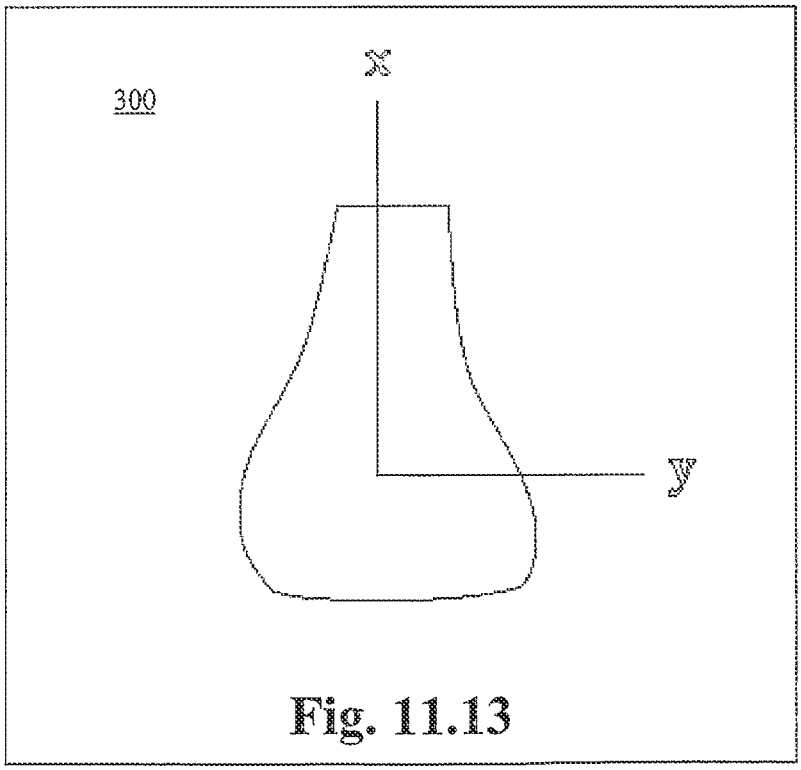
Fig. 11.13

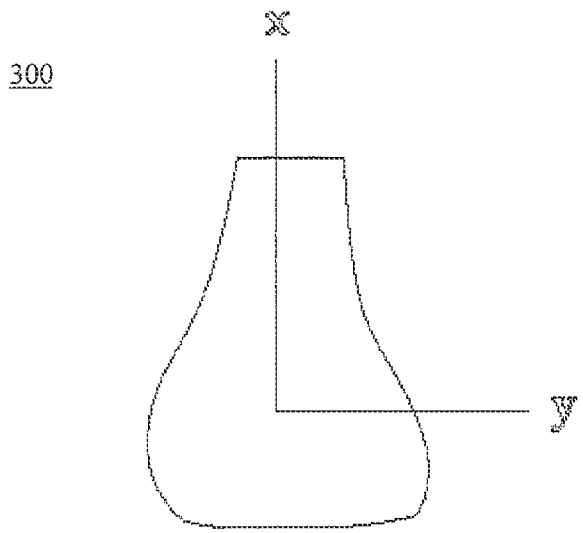
Fig. 11.14
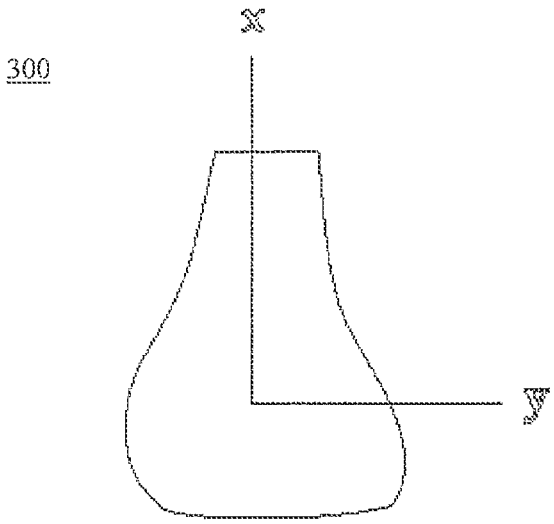
Fig. 11.15

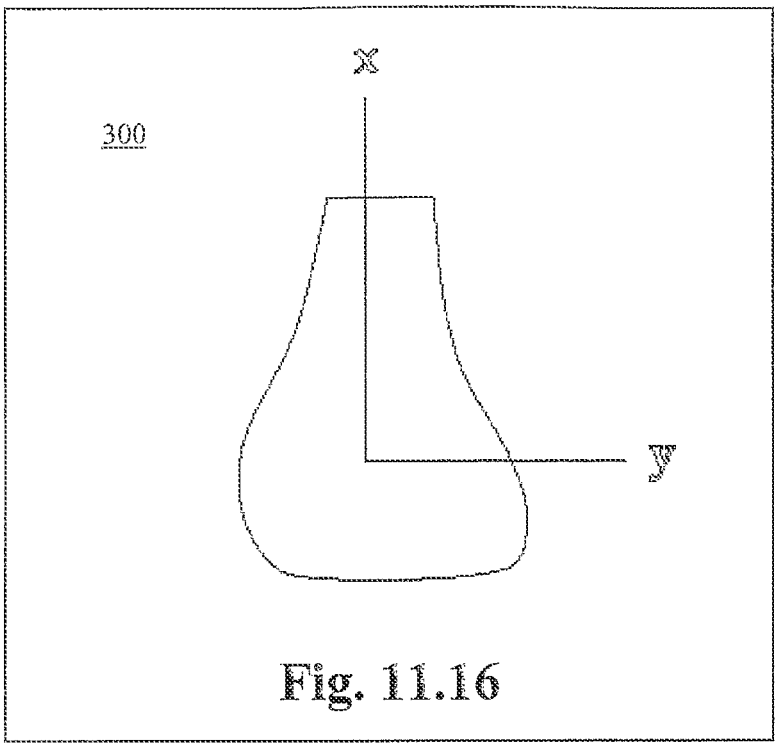
Fig. 11.16
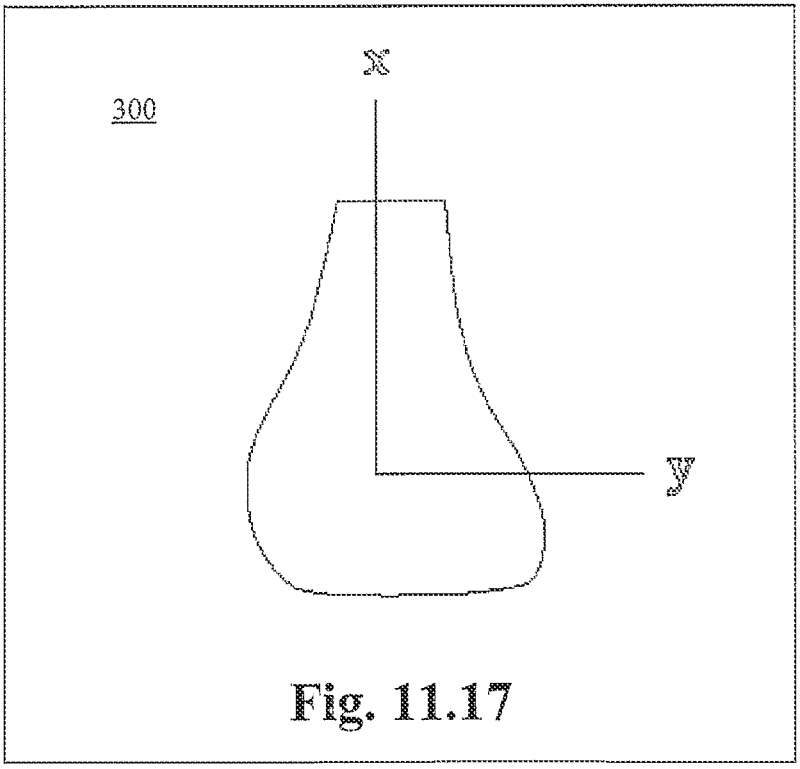
Fig. 11.17

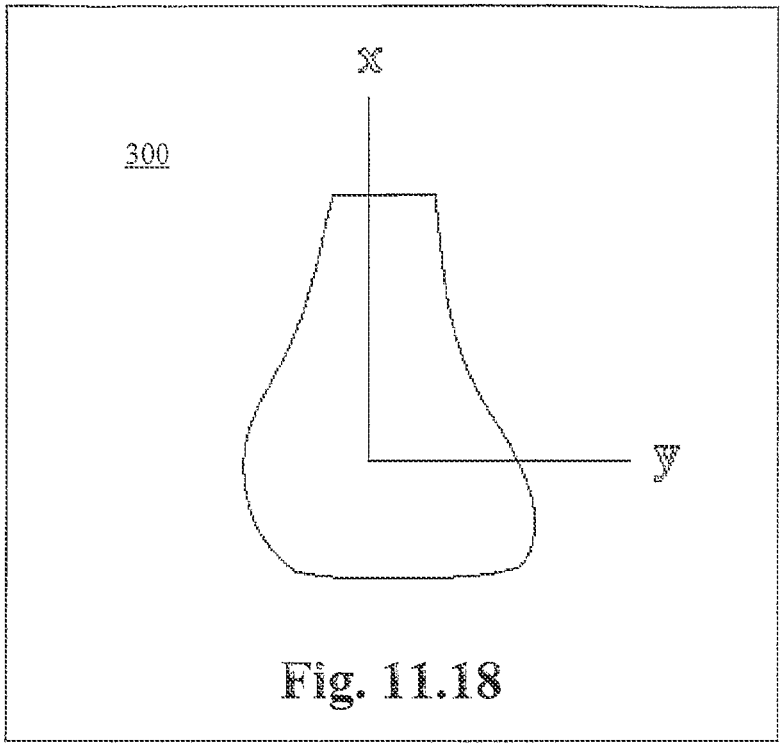
Fig. 11.18
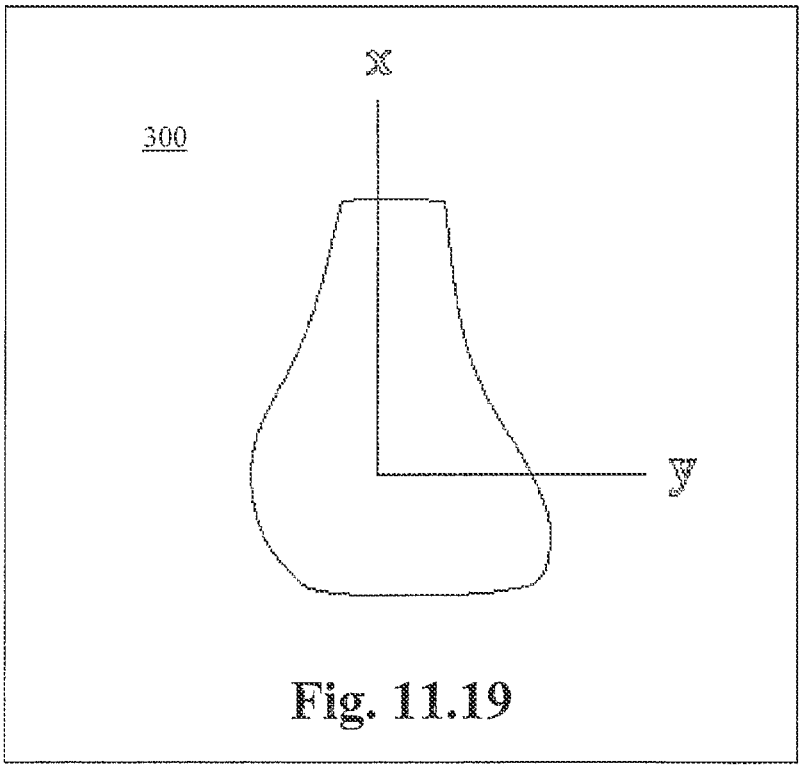
Fig. 11.19

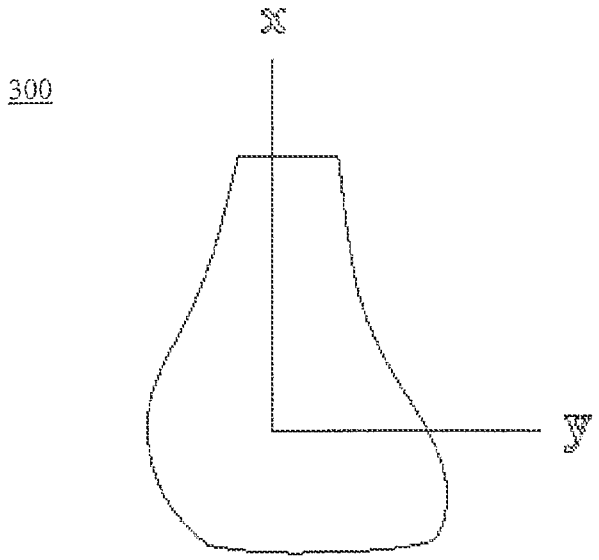
Fig. 11.20
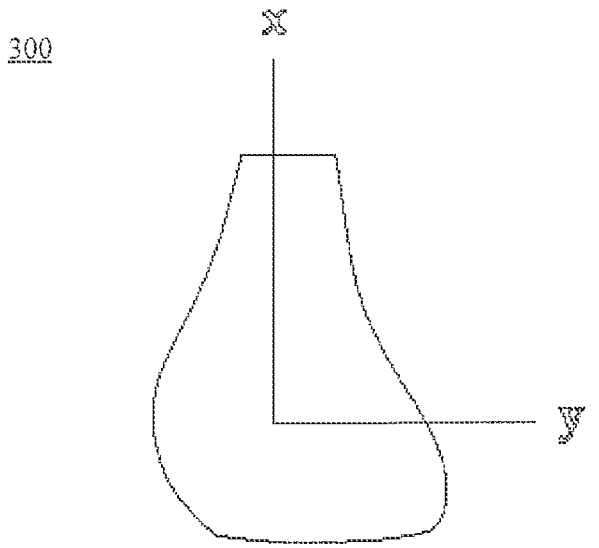
Fig. 11.21

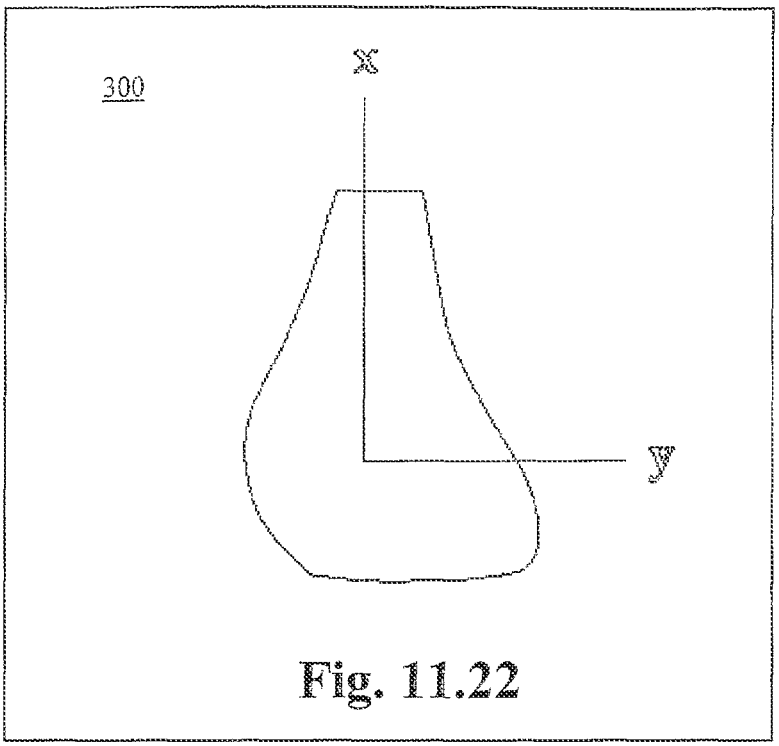
Fig. 11.22
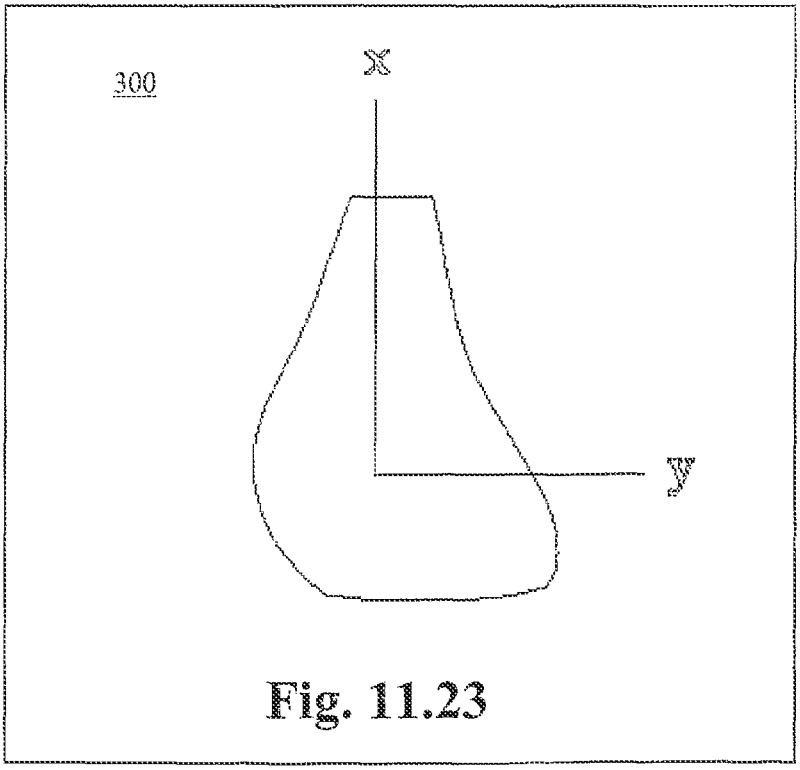
Fig. 11.23

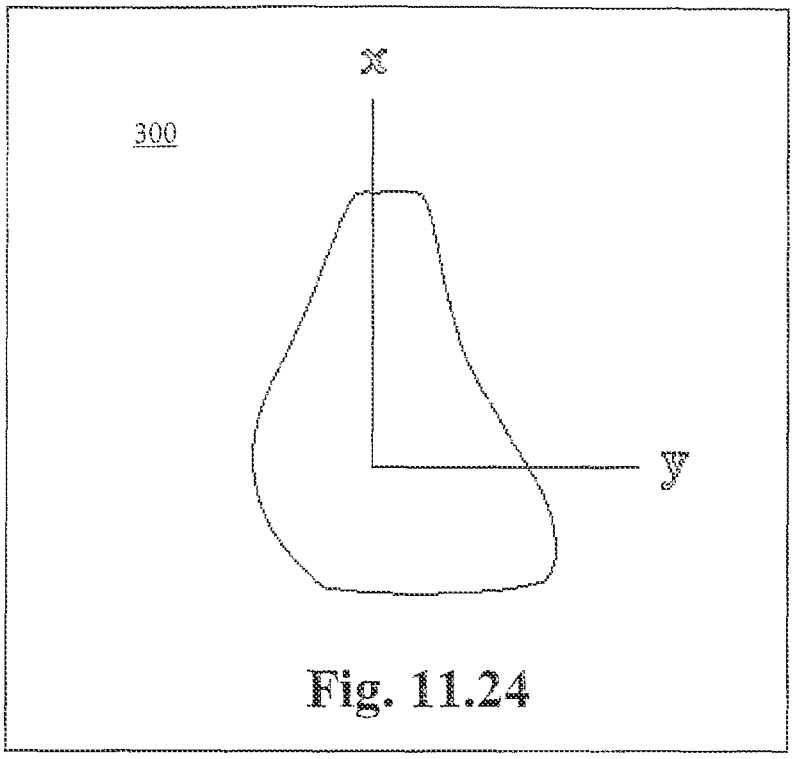
Fig. 11.24
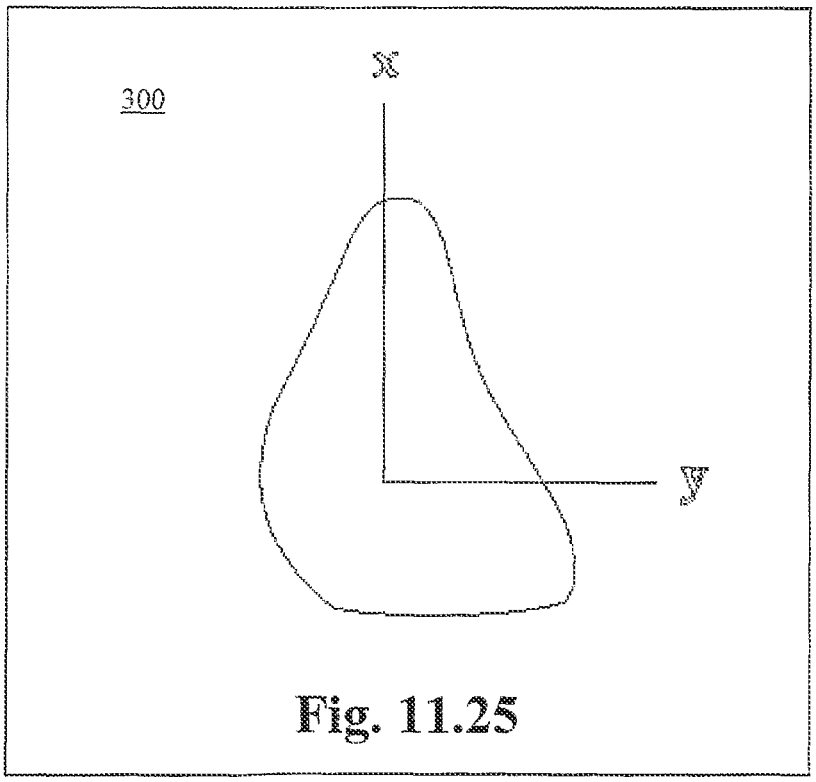
Fig. 11.25

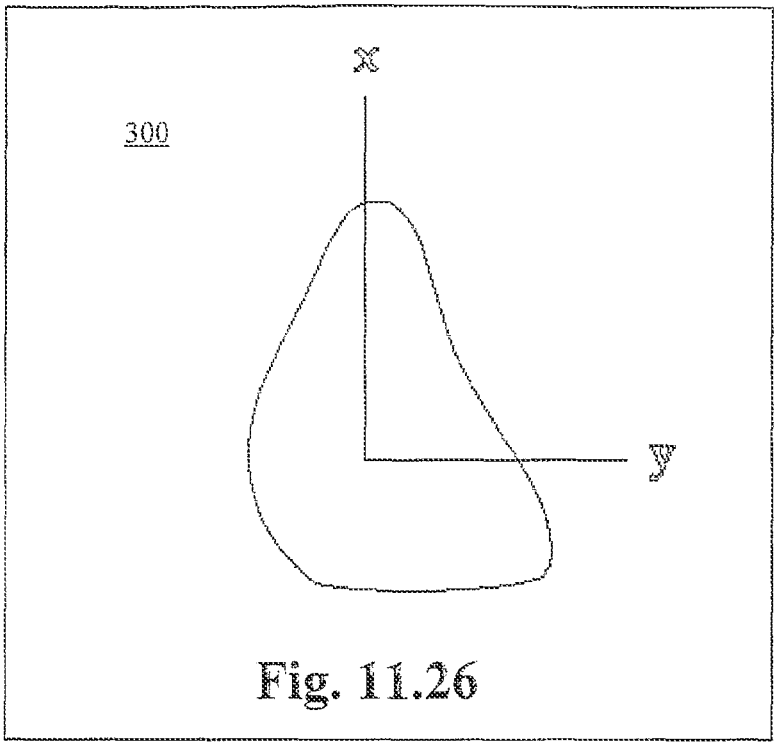
Fig. 11.26
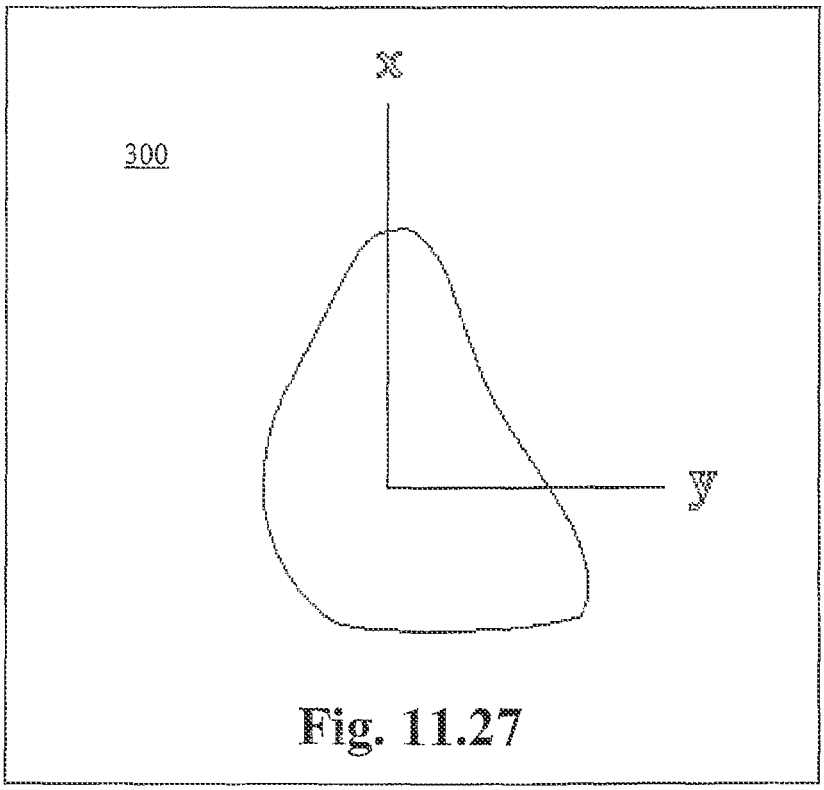
Fig. 11.27

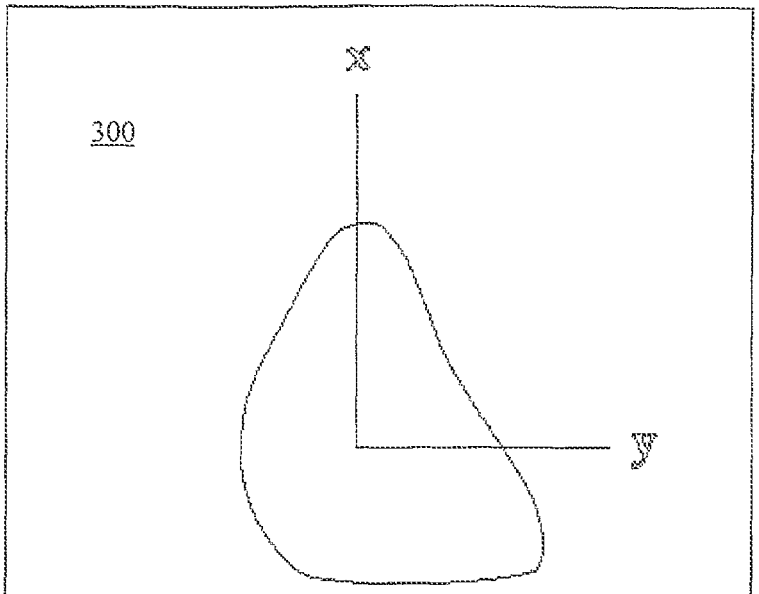
Fig. 11.28
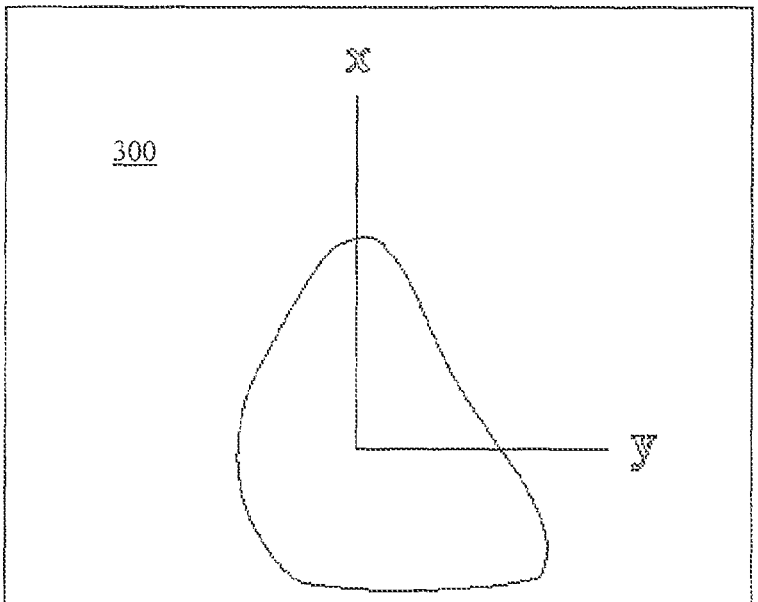
Fig. 11.29

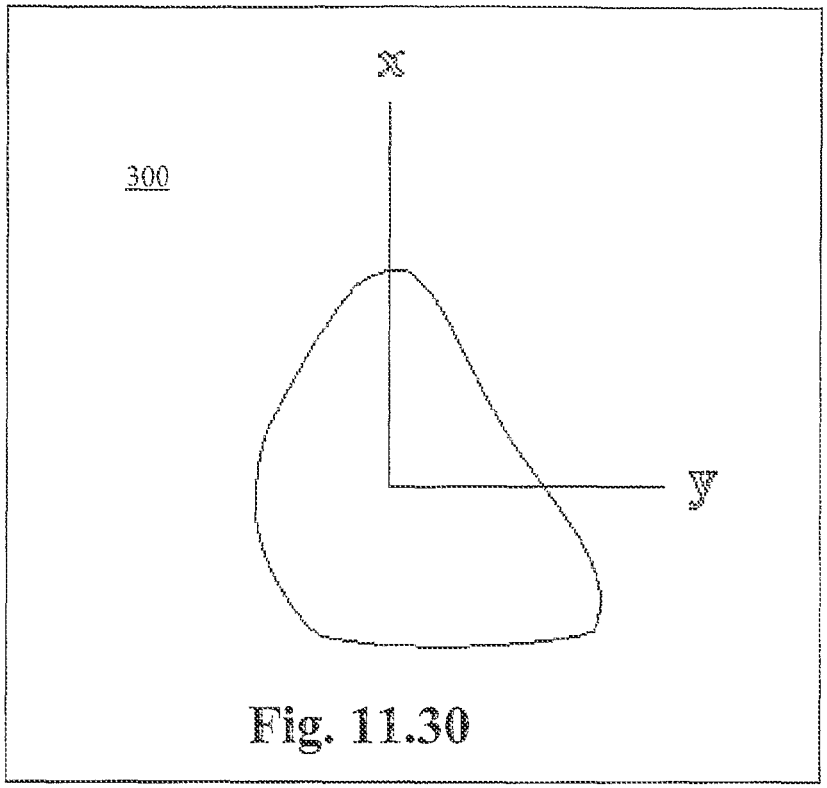
Fig. 11.30
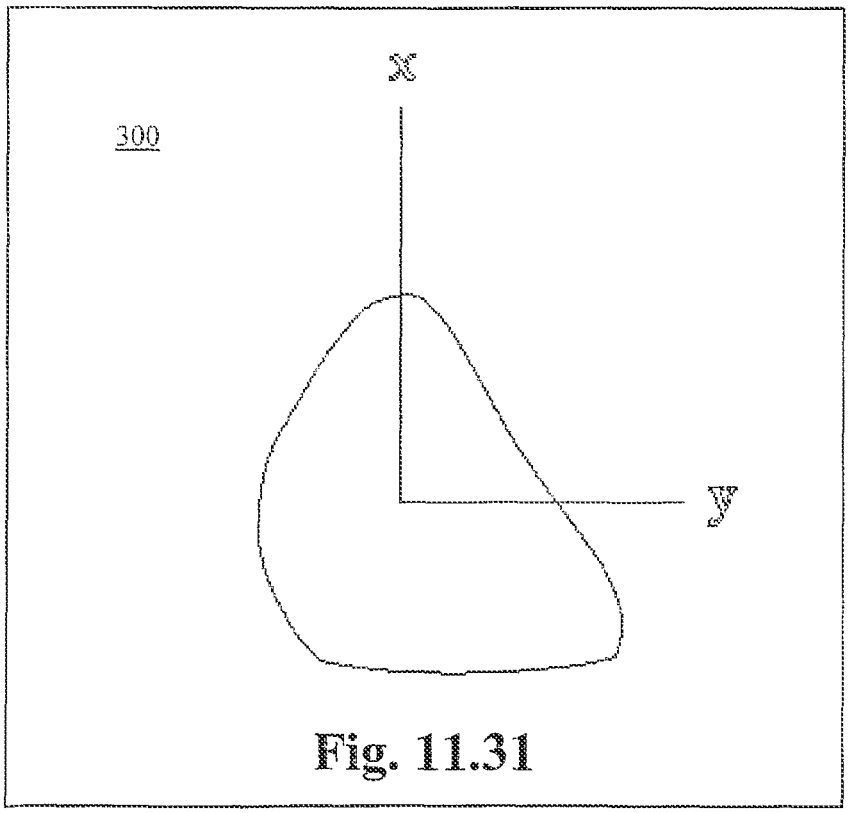
Fig. 11.31

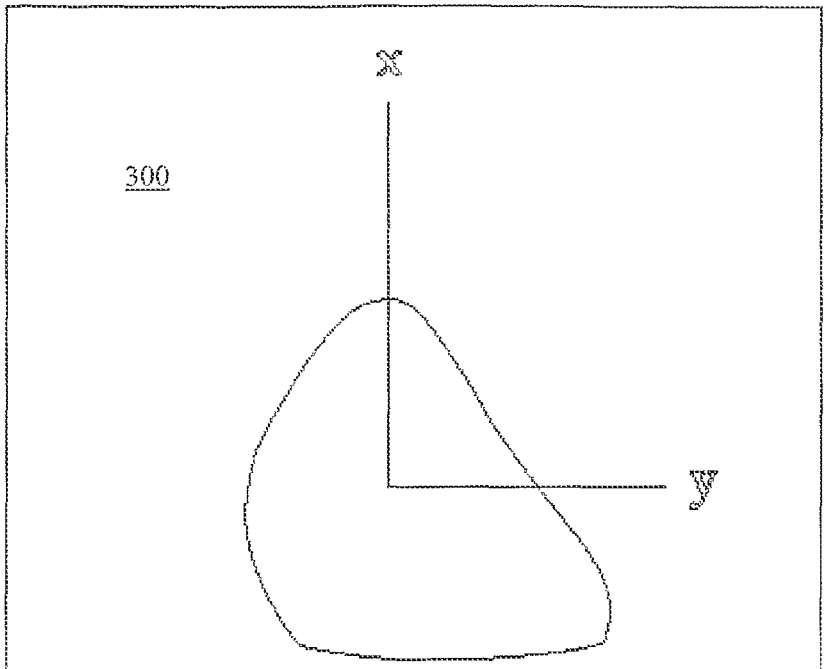
Fig. 11.32
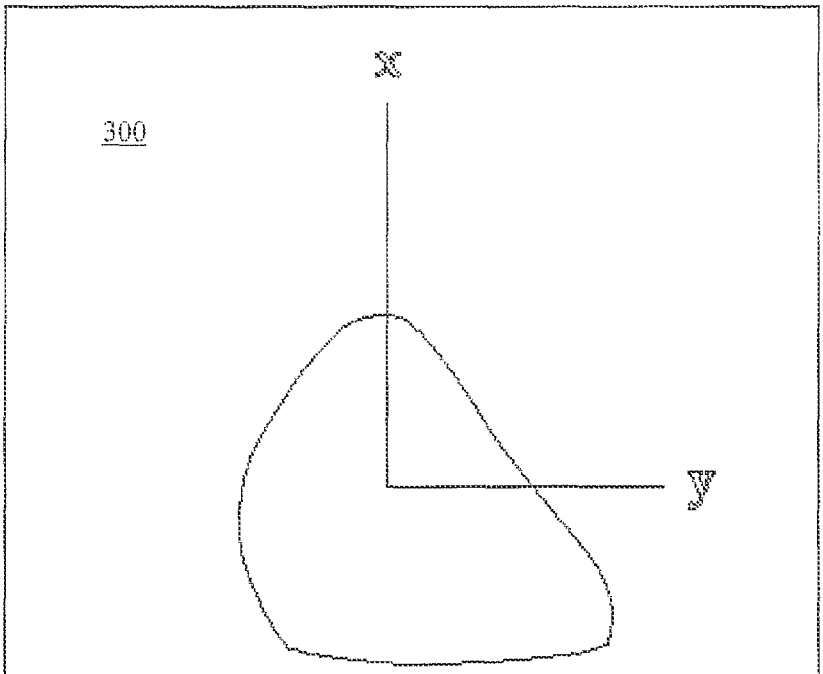
Fig. 11.33

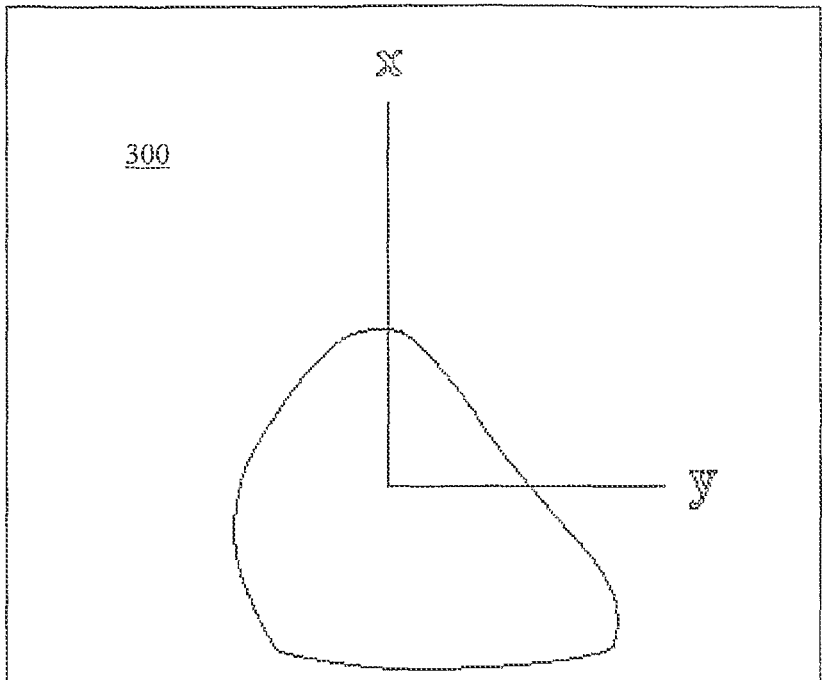
Fig. 11.34
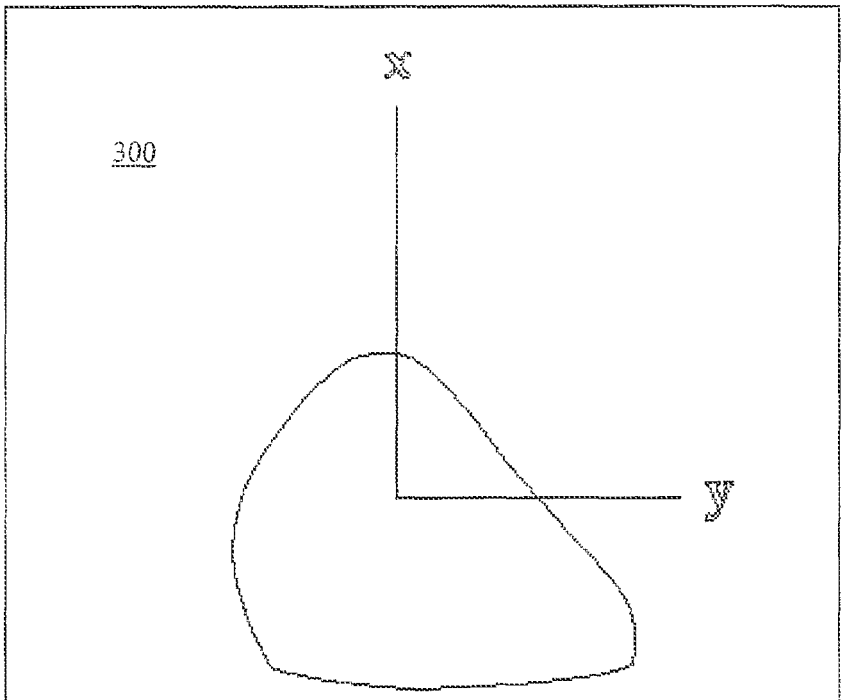
Fig. 11.35

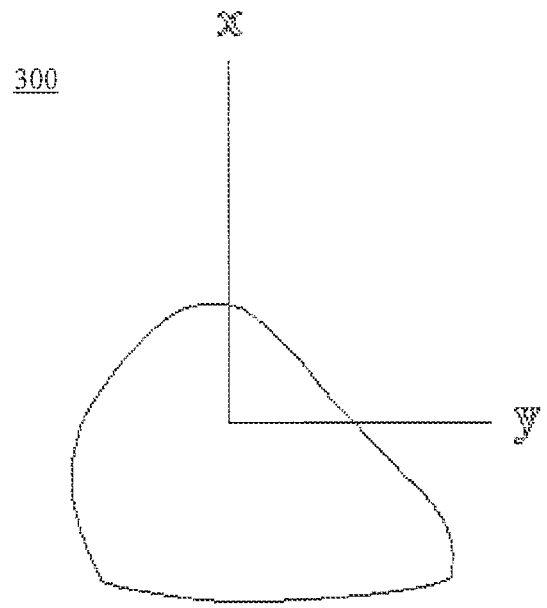
Fig. 11.36
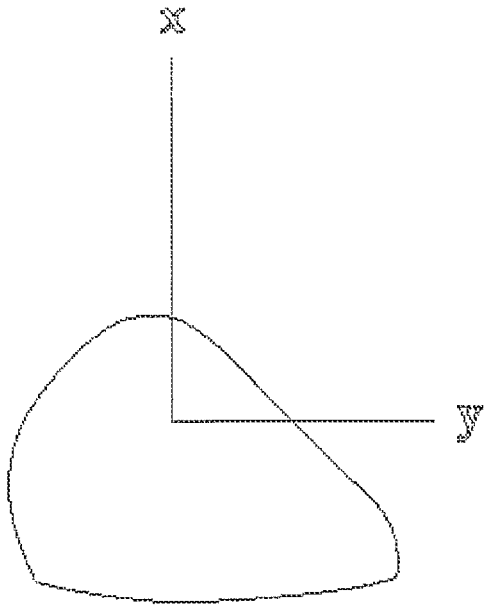
Fig. 11.37

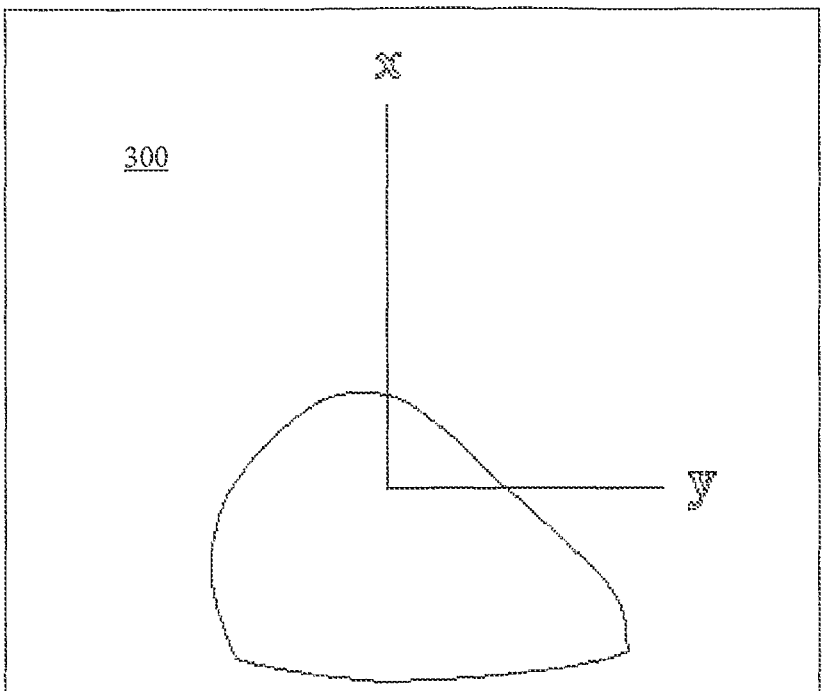
Fig. 11.38
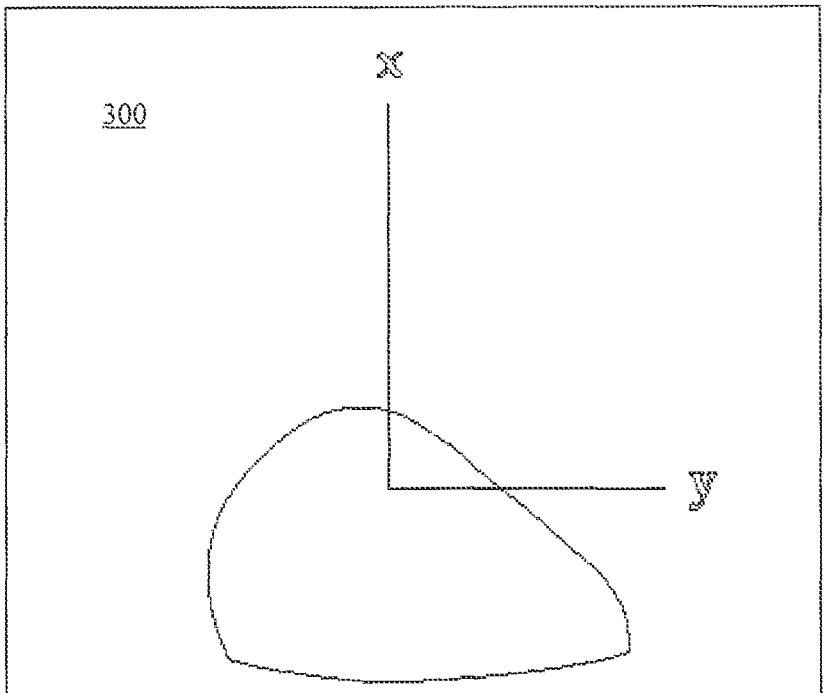
Fig. 11.39

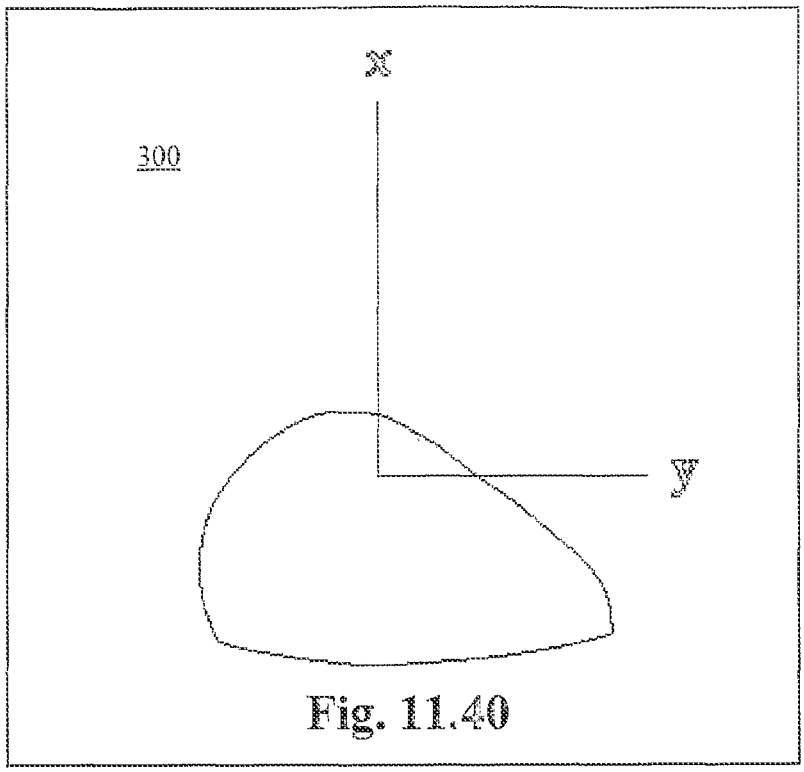
Fig. 11.40
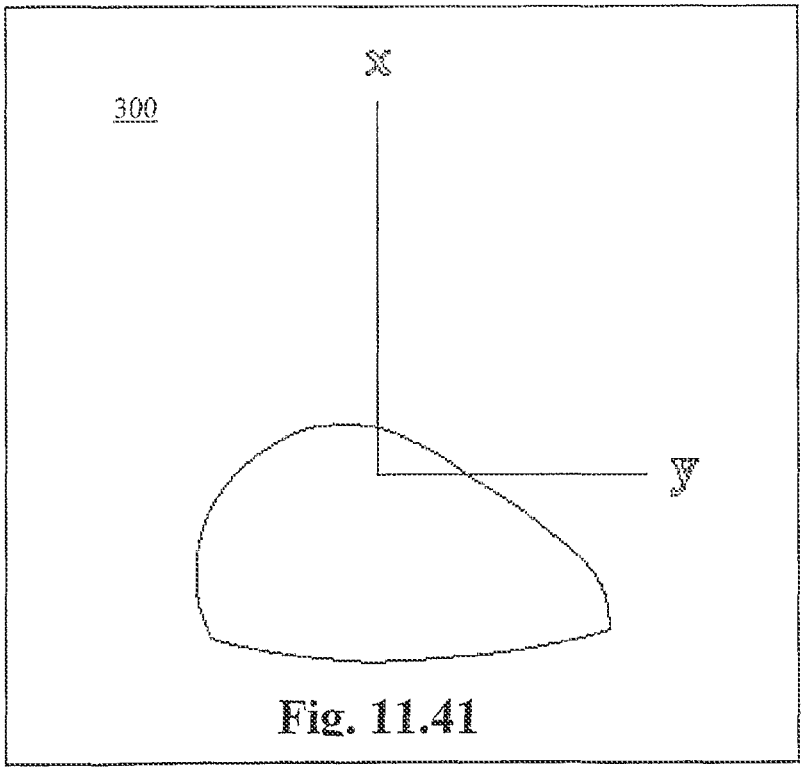
Fig. 11.41

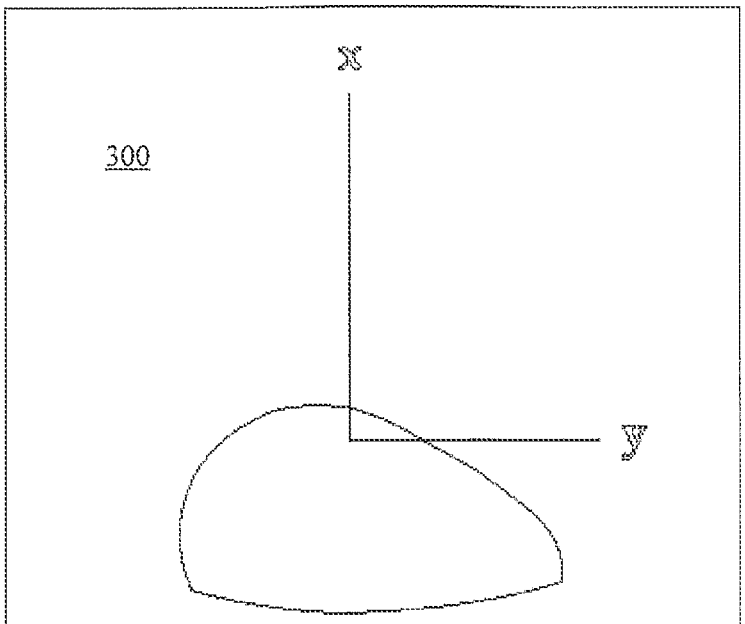
Fig. 11.42
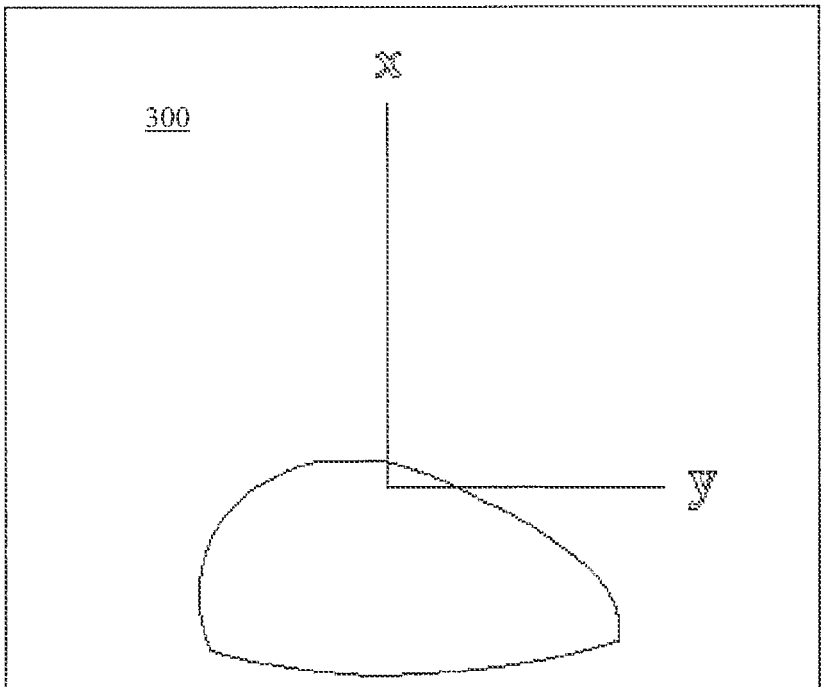
Fig. 11.43

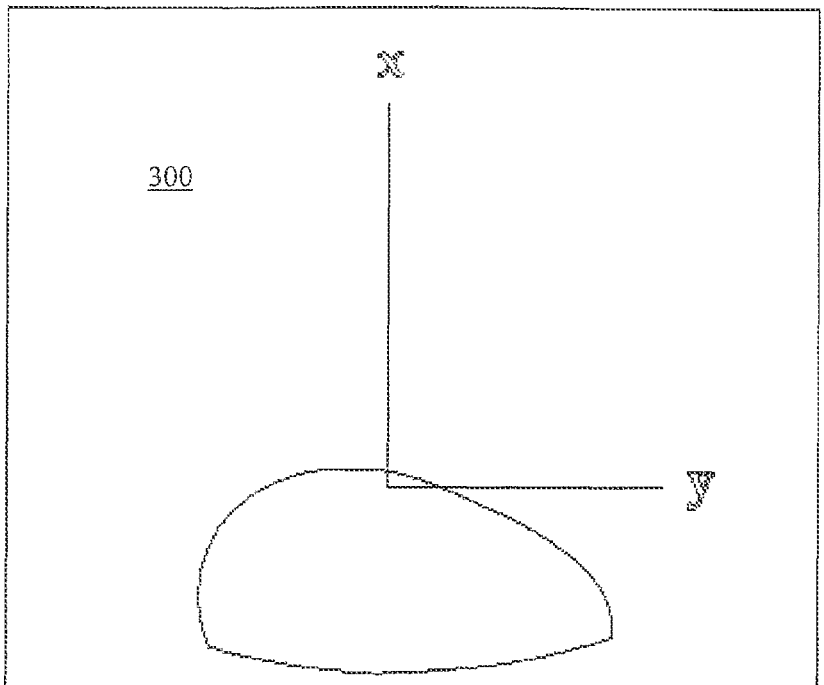
Fig. 11.44
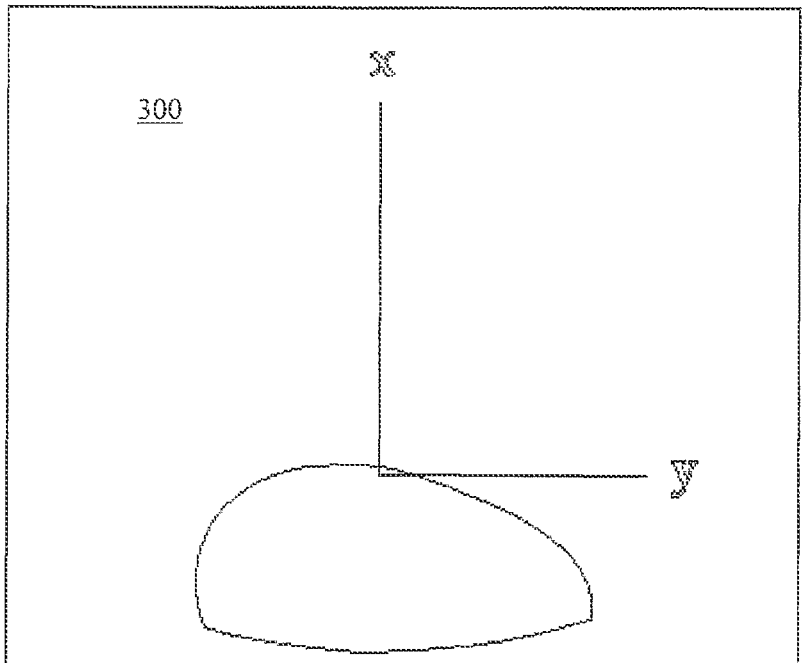
Fig. 11.45

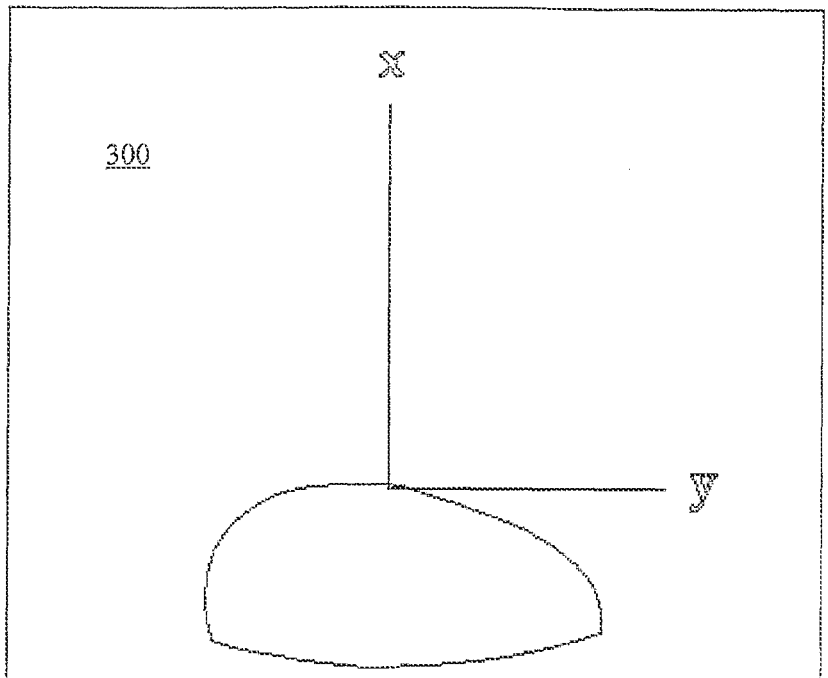
Fig. 11.46
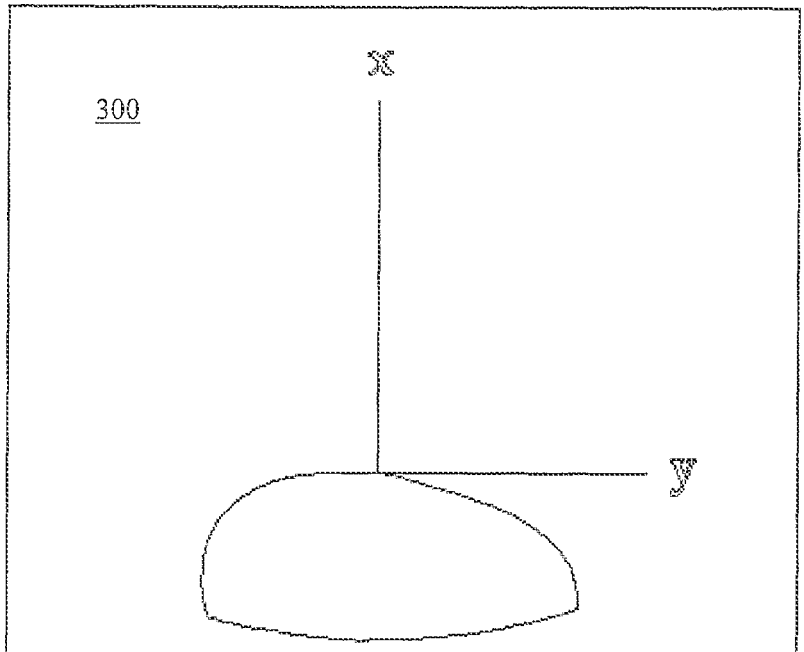
Fig. 11.47

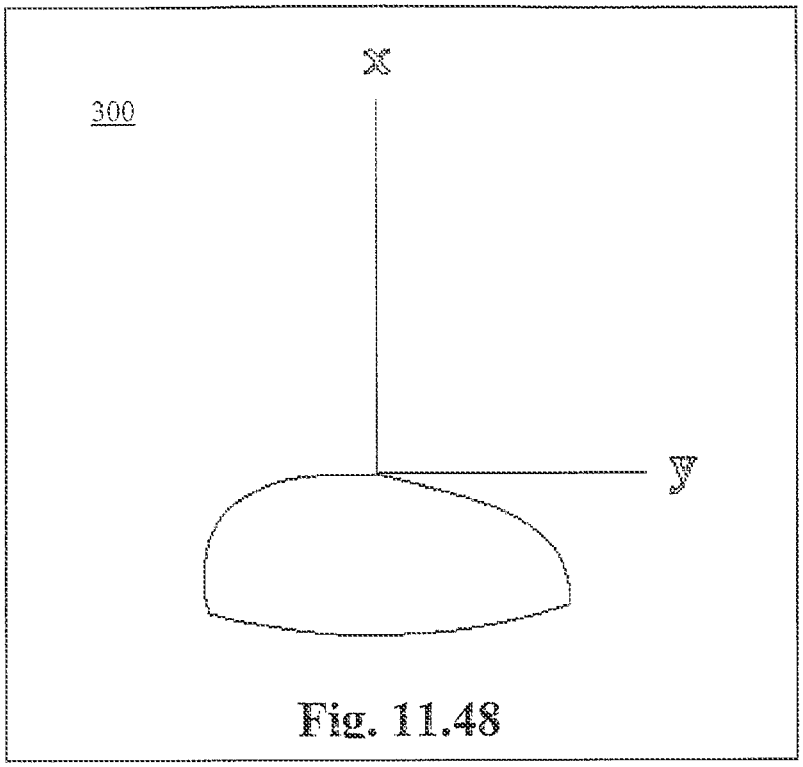
Fig. 11.48
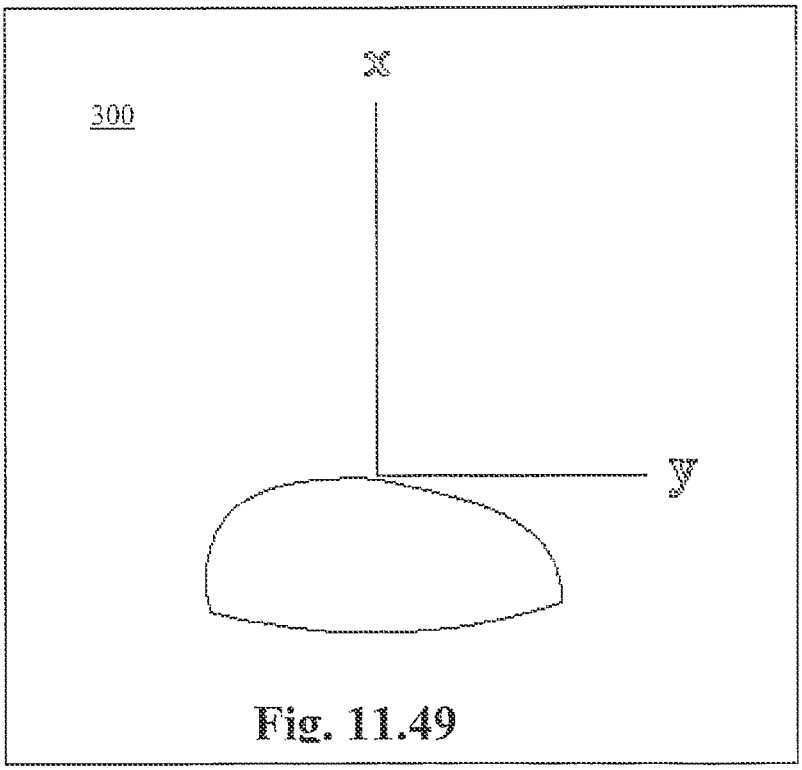
Fig. 11.49

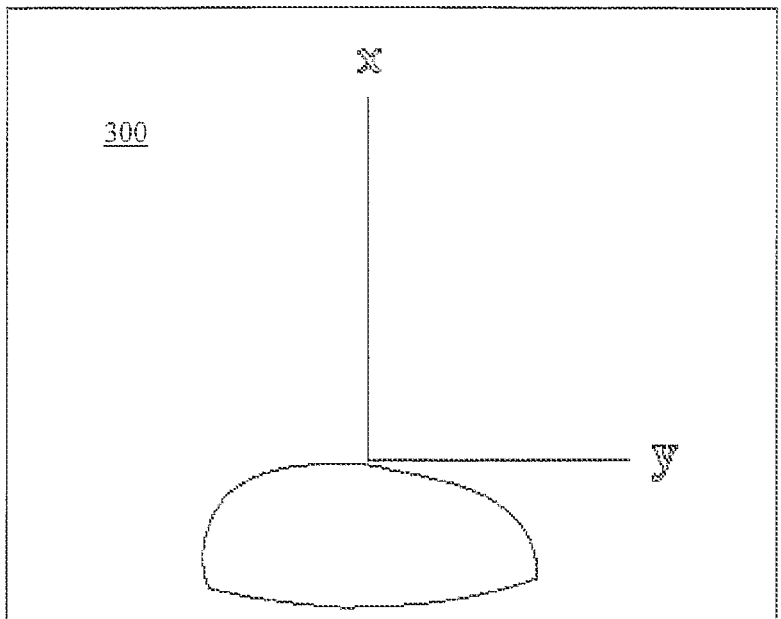
Fig. 11.50
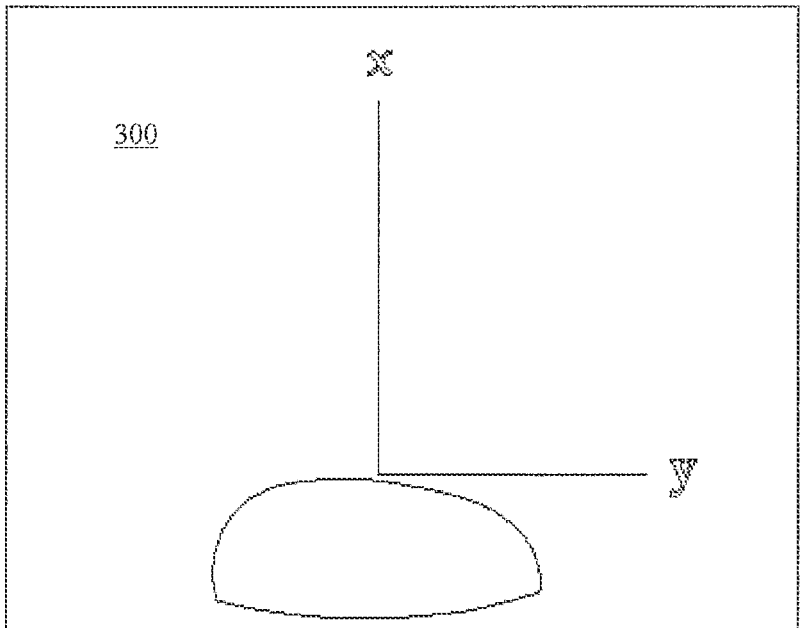
Fig. 11.51

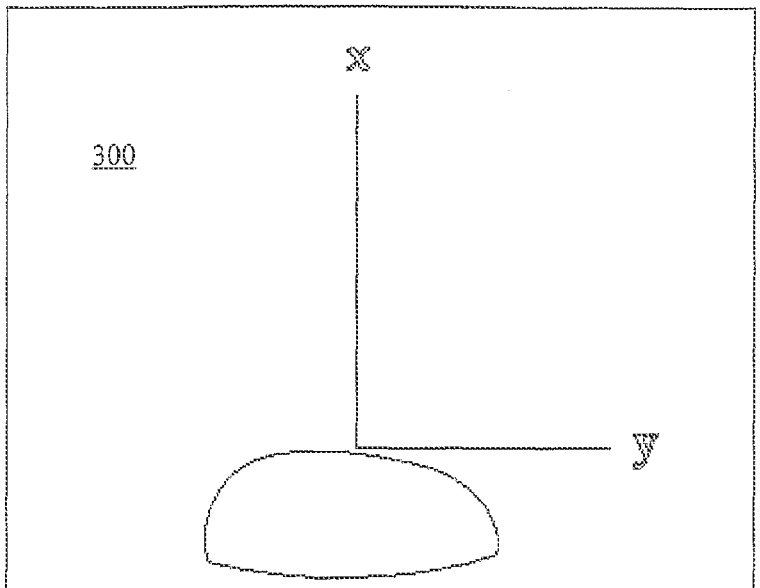
Fig. 11.52
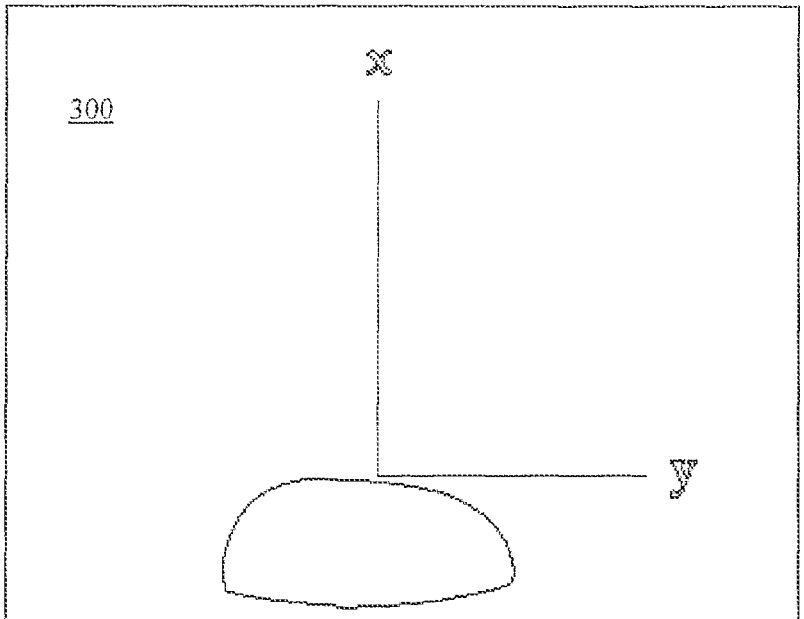
Fig. 11.53

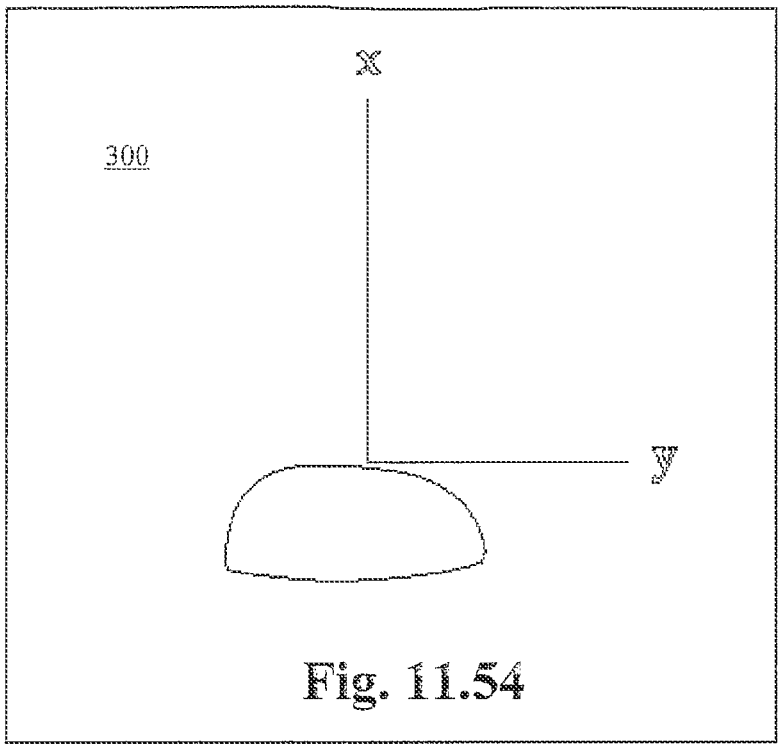
Fig. 11.54
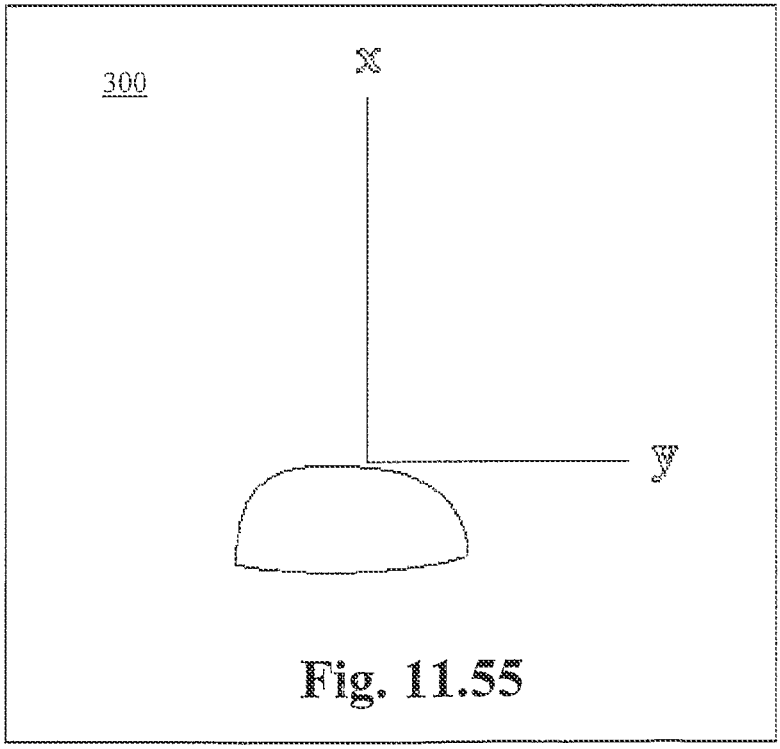
Fig. 11.55

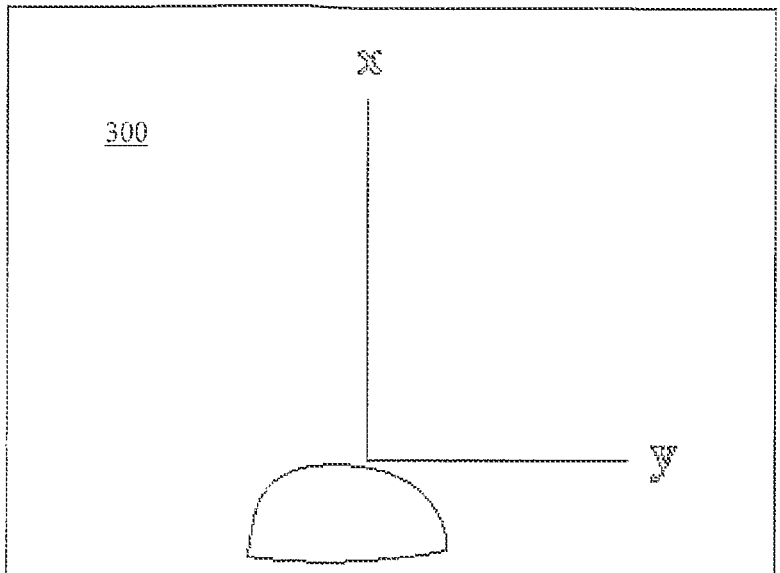
Fig. 11.56
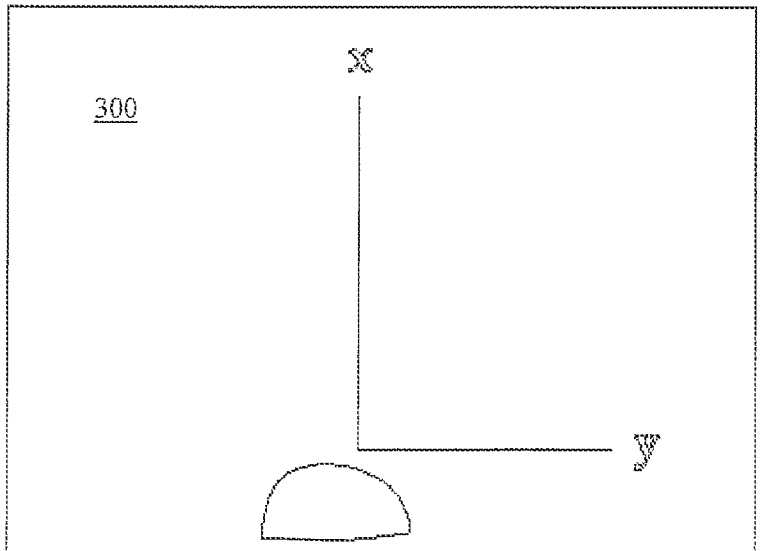
Fig. 11.57

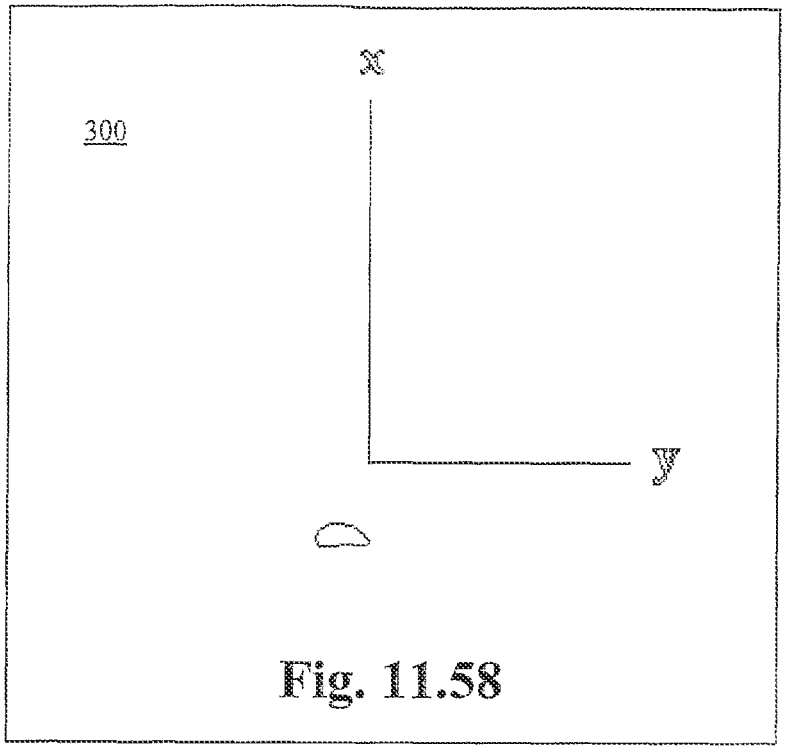
Fig. 11.58

SUPPORT SYSTEM FOR FOOTWEAR PROVIDING SUPPORT AT OR BELOW THE SUSTENTACULUM TALI

CROSS-REFERENCE TO RELATED APPLICATIONS

This application claims priority from and is a continuation of U.S. application Ser. No. 12/066,256, filed Mar. 7, 2008 now U.S. Pat. No. 8,196,318, which is a U.S. National Phase application of International Patent Application Number PCT/US06/35311, filed Sep. 11, 2006, which itself claims priority from U.S. provisional patent application No. 60/715,620, filed Sep. 9, 2005. This application is additionally related to U.S. application Ser. No. 13/458,922 filed on Apr. 27, 2012 entitled "U-Shaped Support System for Footwear"; and U.S. application Ser. No. 13/458,951 filed on Apr. 27, 2012 entitled "Shoe Last and Shoe Made Therefrom".

BACKGROUND

The foot moves in three directions: (1) sagittally, in an up and down direction similar to the pitch of an airplane; (2) transversely, in a rotational direction similar to the roll of an airplane; and (3) along the coronal or frontal plane in a left-right direction, similar to the yaw of an airplane. The central component of this motion is the talus bone, located below the tibia-fibula, and above, and anterior to the calcaneous (heel bone).

During physical activity, adverse movement or alignment of the foot translates through a person's entire kinetic chain, affecting the knee, hips, and lower back. For example, poor alignment with ground reaction during running can cause stress and induce pain in the knees, hips, and lower back. The optimal alignment during movement is for the calcaneus to remain in a neutral position and the talus to move in a midline position with the knee without excess internal or external rotation. The alignment of the talus and knee can be tested by having a person bend his or her knees. If the talus is optimally aligned with the knee, a plumb line applied to the center of the knee will fall directly over the second metatarsal ray of the foot when the person's knee is slightly bent. When most people bend their knees, however, their knees will fall medially or laterally away from the second metatarsal ray of the foot.

If the talus rotates adversely, the rest of the foot must compensate accordingly. Inward (medial) rotation of the talus causes the hindfoot to compensate with an outward (valgus) movement of the calcaneus, depression of the midfoot, and abduction of the forefoot. As a simple explanation, a foot may pronate, though excessive internal rotation of the talus causes anatomical complications much worse than simple pronation. An outward (external) rotation of the talus also requires compensation by the rest of the foot in the reverse directions—the hindfoot moves inward (varus), the midfoot arches (elevates), and forefoot adducts—that can be simply described as the foot supinating.

These compensatory movements induce strain in the entire kinetic chain of the body, and usually other parts of the kinetic chain compensate for such misalignments. For example, the knee can be pushed medially or laterally, or various parts of the hip can shift to compensate for the strain. Over time, this strain can cause medical conditions such as (but not limited to) plantar fasciitis, Achilles tendonitis, posterior tibialis tendonitis, knee pain with ligamentous and tracking problems, bunions, and hip pain. Positioning and stabilizing the tri-planar motion of the foot during movement can reduce the adverse compensatory movements of the foot and other parts of the kinetic chain, thus reducing (or even eliminating) the corresponding medical problems.

Various prior art solutions for stabilizing the foot are already known. Many types of braces and bandages exist that can be wrapped around a foot, though these corrective devices are often bulky and interfere with the proper fit of a shoe. Gel pads and shoe inserts can be added to the insole of a shoe, but these inserts also can interfere with fit and performance of the shoe. Also, these solutions add weight and bulk to a person's foot. None of these approaches acts simultaneously to stabilize the foot at the three planes described above.

Some shoe manufacturers have developed mechanisms or improved shoe designs for reducing the occurrence of injuries or medical conditions like those described above. For example, running or basketball shoes can include modified flex grooves in the sole, reinforcing laminate mid-sole designs, or pockets of air or gel to provide greater cushioning. However, none of these known solutions stabilizes motion of the foot along all three planes identified above.

The inventor of the inventive subject matter described has attempted to address the aforementioned problems on an individualized basis by creating custom orthotics that make a tri-planar correction. The customized orthotics are inserted into conventional shoes. Unfortunately the orthotics approach while helpful does not provide an optimized solution because of the inherent incompatibilities of combining a custom orthotic with a conventional shoe. For example, the orthotic adds extra height and bulk to a shoe, which can cause instability for the wearer and decreased efficiency in athletic and sports activities. The orthotic may also decrease the volume of the foot compartment of a shoe causing a poor, uncomfortable fit. Pressure points may also occur from the stitching and design of the shoe. Further conventional shoes may have conformations for their uppers and/or sole units that counteract the corrections that an orthotic are intended to make. However, because of the individualized nature of orthotics, there still remains a need for off-the-shelf shoes, as well as custom shoes, that provide an integrated system for tri-planar corrections.

Accordingly there is a substantial need for footwear systems that adjust or stabilize the tri-planar motion of a foot.

SUMMARY

The inventive subject matter disclosed herein addresses the aforementioned need by providing a footwear system that helps align and orient the kinetic chain (feet, legs, knees, hips, and lower back) by stabilizing the tri-planar movement of the foot. The system is adapted to affect three areas of the foot anatomy simultaneously, in what is referred to herein as a tri-planar adjustment or stabilization: (1) the lateral calcaneus; (2) the sustentaculum tali (abbreviated "ST"); and (3) the fifth metatarsal ray of the foot (along the small toe). For example, adverse internal rotation of the talus can be corrected by: (1) varus movement of the calcaneus; (2) vertical lift on the ST; and (3) fifth ray pressure to adduct the forefoot.

FIGS. 12A and 12B illustrate with directional arrows the areas for simultaneous applying supporting pressure to three areas.

The tri-planar adjustment or stabilization may be achieved by a shoe structure formed of one or more components that are configured to effect the tri-planar alignments, as described above, of the three relevant anatomical areas, namely the lateral calcaneus, the ST, and the fifth metatarsal region.

These and other embodiments are described in more detail in the following detailed descriptions and the figures.

The foregoing is not intended to be an exhaustive list of embodiments and features. Persons skilled in the art are capable of appreciating other embodiments and features from the following detailed description in conjunction with the drawings.

BRIEF DESCRIPTION OF DRAWINGS

In accordance with the inventive subject matter:

FIGS. 3A-3F show different views of one embodiment of the tri-planar plate for use in one possible embodiment according to the inventive subject matter; the circle indicates an attachment portion, device, or mechanism, such as a Velcro® tab, corresponding to the similar circle on the sock liner.

FIG. 9.1 is a general key to the sectional contours illustrated in FIGS. 10.1 through 11.58.

FIG. 9.2 is a heel view of the sectional contours illustrated in FIGS. 10.1 through 11.58.

FIG. 9.3 is a side view of the sectional contours illustrated in FIGS. 10.1 through 11.58.

FIGS. 10.1-11.58 are cross-sectional contours of a last that can be used to construct an embodiment of a shoe or shoe upper described herein. The contours correspond to the parallel lines illustrated in FIGS. 9.1-9.3, with the contour of FIG. 10.1 corresponding to the heel of the last and the contour of FIG. 10.58 corresponding to the toe of the last. The measurements in FIGS. 9.1-9.3 are shown in millimeters.

FIGS. 11.1-11.58 are cross-sectional contours of a last that can be used to construct an embodiment of a shoe or shoe upper described herein. The contours correspond to the parallel lines illustrated in FIGS. 9.1-9.3, as in the case of FIGS. 10.1-11.58.

DETAILED DESCRIPTION OF THE INVENTION

The inventive subject matter disclosed herein is directed to a footwear system that helps align and orient the kinetic chain (feet, legs, knees, hips, and lower back) by adjusting or stabilizing the tri-planar movement of the foot. The system is adapted to affect three areas of the foot anatomy simultaneously, in what is referred to herein as a tri-planar adjustment or stabilization: (1) the lateral calcaneus; (2) the sustentaculum tali (abbreviated "ST"); and (3) the fifth metatarsal ray of the foot (along the small toe). For example, adverse internal rotation of the talus can be corrected by: (1) varus movement of the calcaneus; (2) vertical lift on the ST; and (3) fifth ray pressure to adduct the forefoot.

Figure 12A:
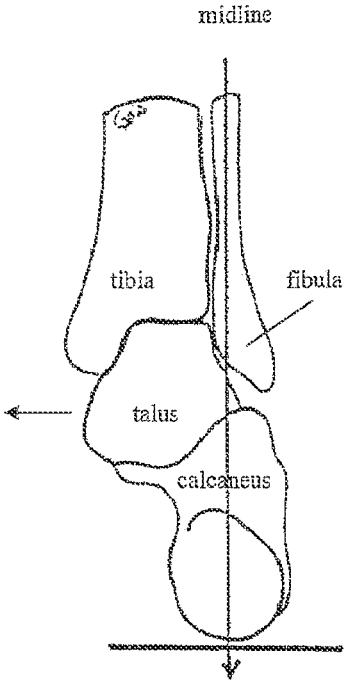
FIGS. 12A-12B show anatomical views of a foot without triplanar adjustment or stabilization. Internal rotation of the talus creates compensatory calcaneal valgus, and forefoot adduction. The rotation of the talus translates to the knee creating a genu valgus moment with medial knee strain and compensatory change throughout the kinetic chain.
Figure 12B:
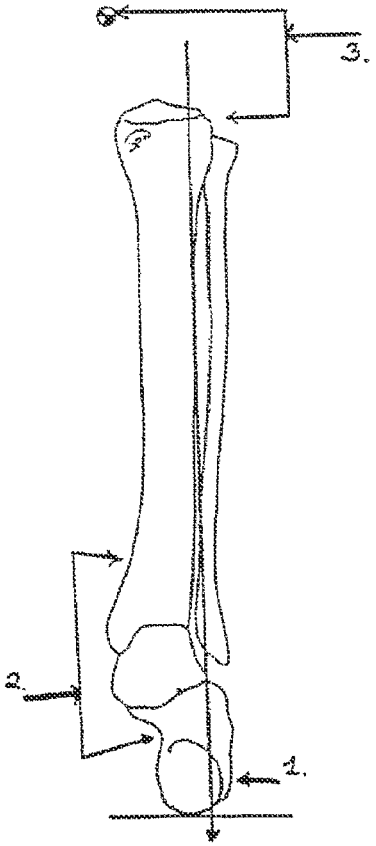
Figure 13A:
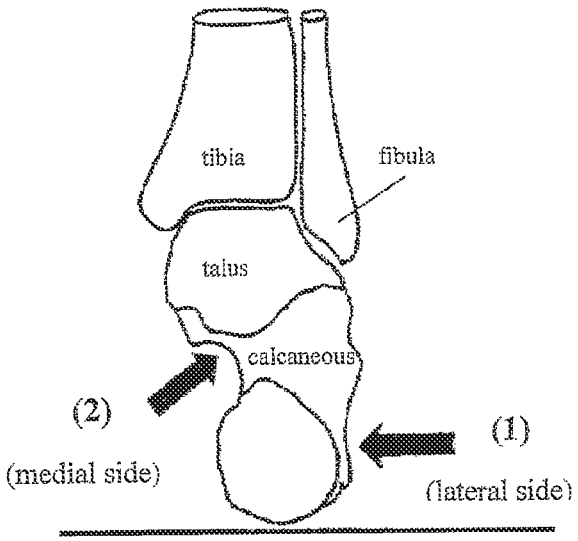
FIGS. 13A-13B show views of a foot under simultaneous correction of two tri-planar areas (FIG. 13A) and three tri-planar areas (FIG. 13B). Stabilization of the hindfoot with medially directed pressure on the lateral calcaneous (1), and lateral superior pressure medially along subtalar and sustentaculum tall (2). The third pressure point (3) along the fifth ray to redirect the forefoot.
Figure 13B:
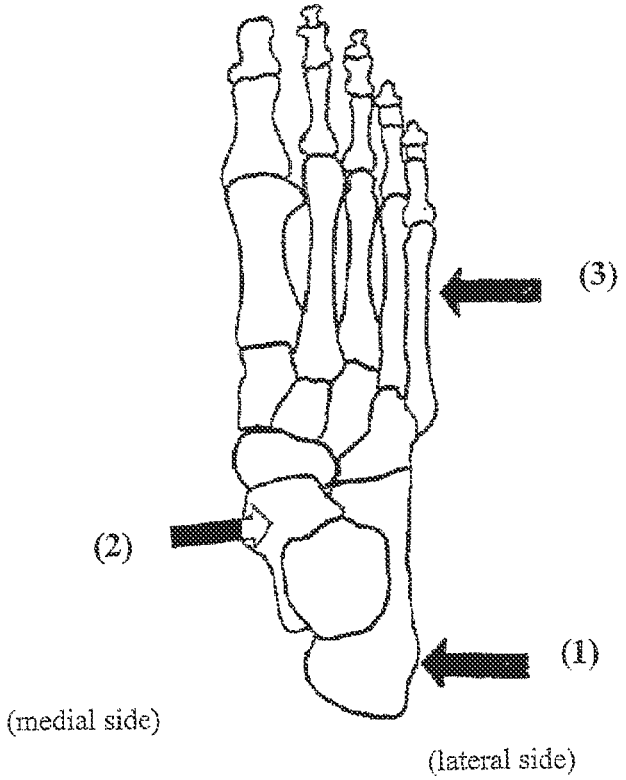

The tri-planar adjustment or stabilization may be achieved by a shoe structure formed of one or more components that are configured to effect the tri-planar alignments, as described above, of the three relevant anatomical areas, namely the lateral calcaneous, the sustentaculum tali, and the fifth ray. These adjustments or stabilizations are relative to a wearer's unshod foot standing in a natural pronated position, which reflects the natural standing position of a significant percentage of the population. FIGS. 12A and 12B show an uncorrected or condition of such a pronated foot. FIGS. 13A and 13B show a tri-planar correction of the condition. As used herein the term adjustment means changing the alignment of the foot from a natural position or kinetic. Stabilization means helping maintain a foot that already has an objective tri-planar alignment (such a foot would not be considered the norm and would naturally correspond approximately to the foot conformation represented by FIGS. 11.1-11.58, for example, which is described in more detail below). Support means to stabilize and/or adjust. Hereinafter, such a single or composite structure that is integrated into a shoe and provides an objective tri-planar alignment, as described above, is referred to as a "tri-planar system".

In certain embodiments, the inventive subject matter contemplates a shoe comprising: an assembly of a shoe upper and sole unit for supporting a foot, the assembly defining a foot compartment that orients a foot in an objective (desired) tri-planar alignment to affect three areas of the foot anatomy simultaneously: (1) the lateral calcaneus; (2) the sustentaculum tali; and (3) the fifth metatarsal ray of the foot. In certain embodiments the shoe compartment is configured to correct an adverse internal rotation of the talus by: (1) varus movement of the calcaneus; (2) vertical lift on the ST; and (3) fifth ray pressure to adduct the forefoot. The shoe upper may be any known upper construction that extends upwardly from the sole unit and (typically) over the top of a foot. An upper may be structure that completely covers the top of the foot, as well as uppers that partially cover the top of the foot, such as may be constructed from straps or bands for sandal shoes and similar shoes. As persons skilled in the art will appreciate, a sole unit may be any combination of outsole structure, midsole structure and insole, sock liner, or other shoe insert structure.

Representative embodiments of shoes, shoe components and lasts for configuring a shoe for tri-planar adjustment or stabilization are shown in FIGS. 1-11.58. In a basic form, a tri-planar system is composed of a shoe configured to adjust or stabilize a foot into a corrected, better supported, and more stable position according to more optimal tri-planar axes of the foot, as described above. These adjustments or stabilizations are typically performed by a combination of a sole unit with an upper that conforms the foot to the objective alignment.

A tri-planar system may be implemented as an assembly of one or more components that form (1) a sole unit that is disposed between a wearer's foot and the ground and (2) an upper for at least securing the sole unit to the foot. Referring to FIGS. 2-8, the inventive subject matter will be discussed in terms of a modular shoe 10 assembly formed of an upper 12, a three dimensional semi-rigid plate 14 that helps the foot conform to an objective tri-planar alignment, and an optional shoe insert 16 that may also help facilitate the foot into the objective tri-planar alignment, a sole unit 14, such as a midsole and/or outsole unit 24. This presentation of this embodiment is intended to be illustrative and not limiting, and persons skilled in the art will appreciate from the teachings herein how other embodiments of one or more components may be assembled into a shoe that defines an objective tri-planar alignment for a foot. For example, instead of a modular assembly, the functions and features of the modular components may be implemented into a single unit, by, for example co-molding processes.

Typically, a last 100 (FIG. 1 and FIGS. 9.1-9.3) is created that represents the objective or desired foot alignment and the upper and sole unit components are assembled around the last, creating a foot compartment for receiving a foot that corresponds to the shape of the last. However, while the inventive subject matter is illustrated in terms of a lasted construction, any other known or developed technique for creating a three-dimensional space that represents a foot compartment may be used.

The inventive lasts represent a form of a tri-planar alignment of the foot and alternatively may be considered a representation of a typical foot itself, as adjusted or stabilized. The lasts according to the inventive subject matter may contemplate one or more of the following features to help achieve tri-planar support in a shoe: a last cone with an offset in the lateral direction measured from the anatomical midline of the corresponding foot; a last cone, as above, where the offset is preferably about seven degrees; a forefoot adduction in the medial direction measured from the horizontal plane of the last heel centerline; a forefoot adduction, as above, where the offset is preferably about seven degrees; a neutrality or pronation in the forefoot area; and/or about seven degrees calcaneal varus.

Figures 1A, 1B, 1C:
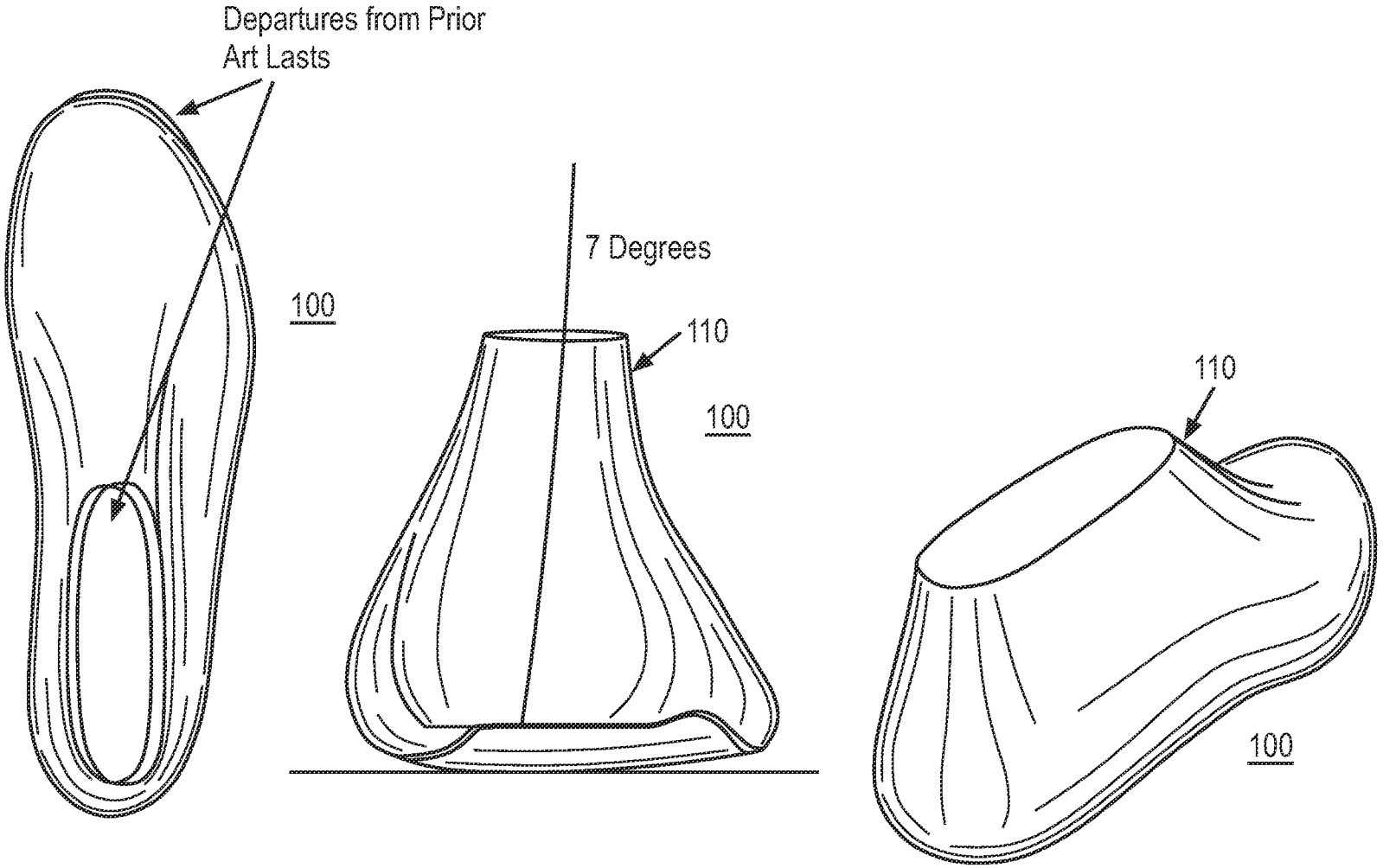
FIGS. 1A-1C show views of one embodiment of an inventive last with about a seven degree offset of the last cone and flatter underside, with a comparison to prior art lasts.
Figure 2B:
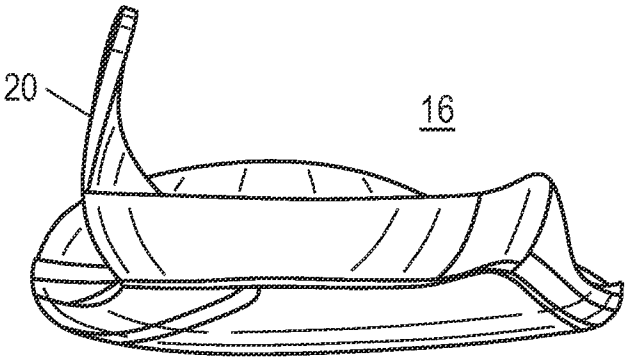
FIGS. 2A-2D show views of an embodiment of a sock liner for use in one possible embodiment according to the inventive subject matter; the circle on the shark fin projection indicates an attachment portion, device, or mechanism, such as a Velcro® tab.
Figure 2D:
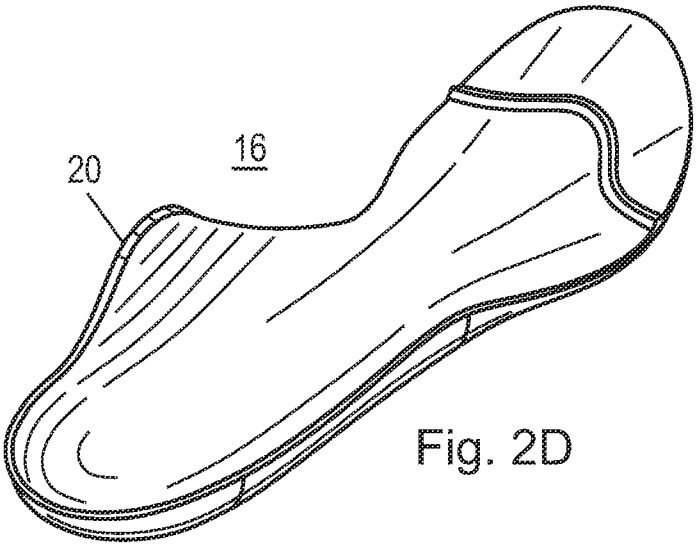
Figure 2A:
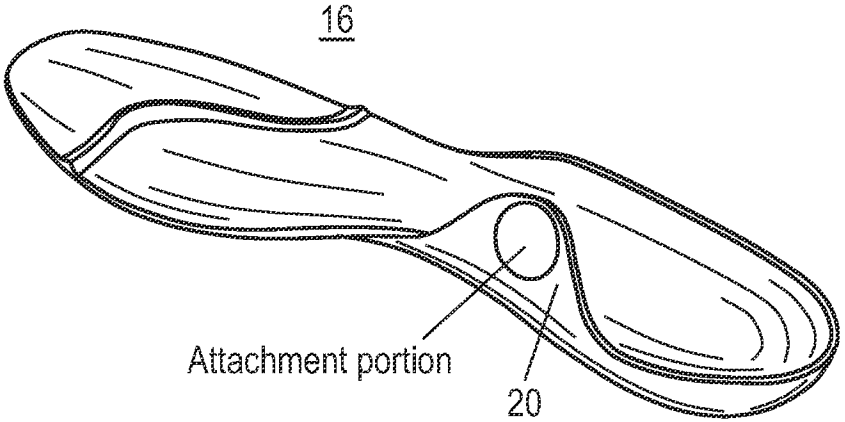
Figure 2C:
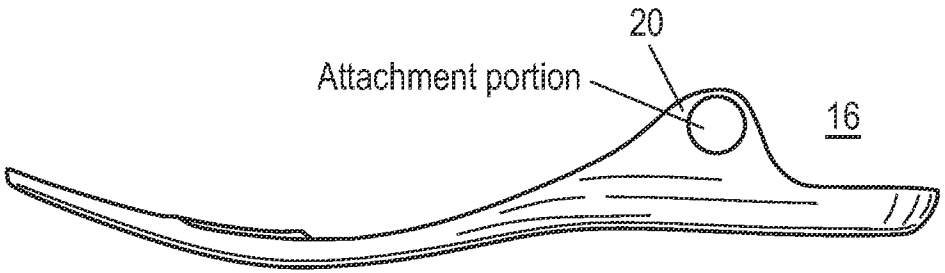
Figure 3E:
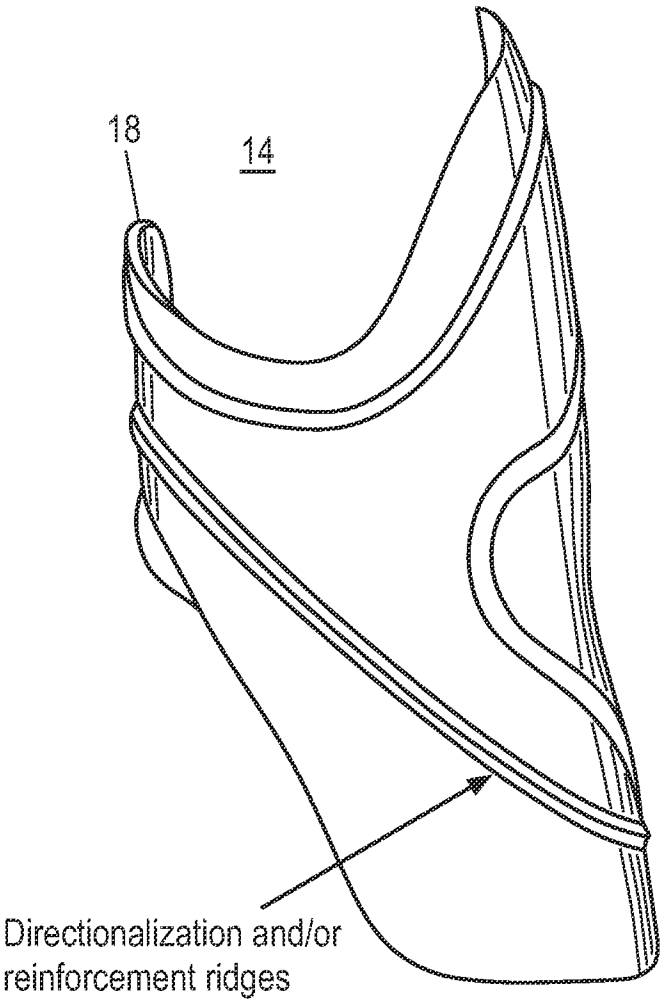
Figure 3F:
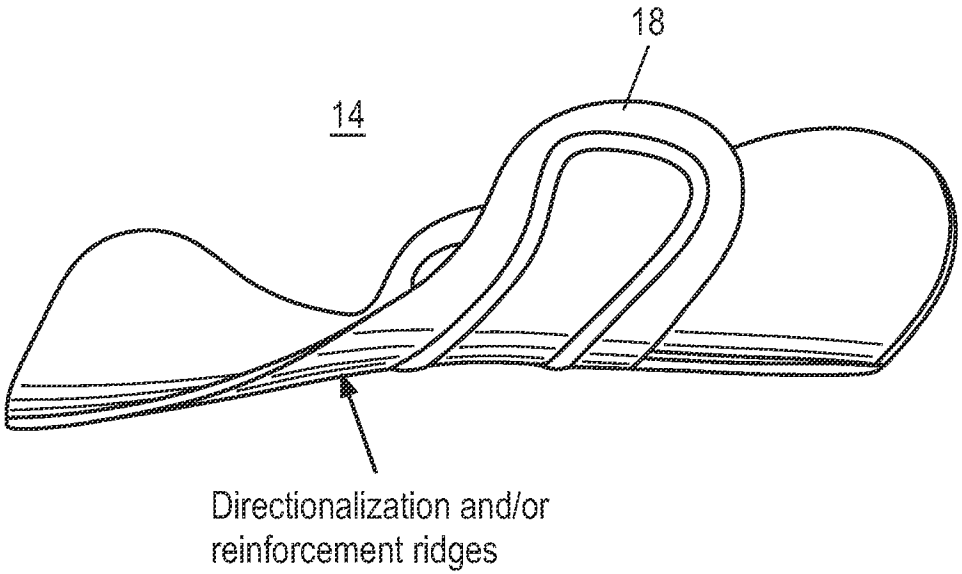
Figures 4A, 4B, 4C:
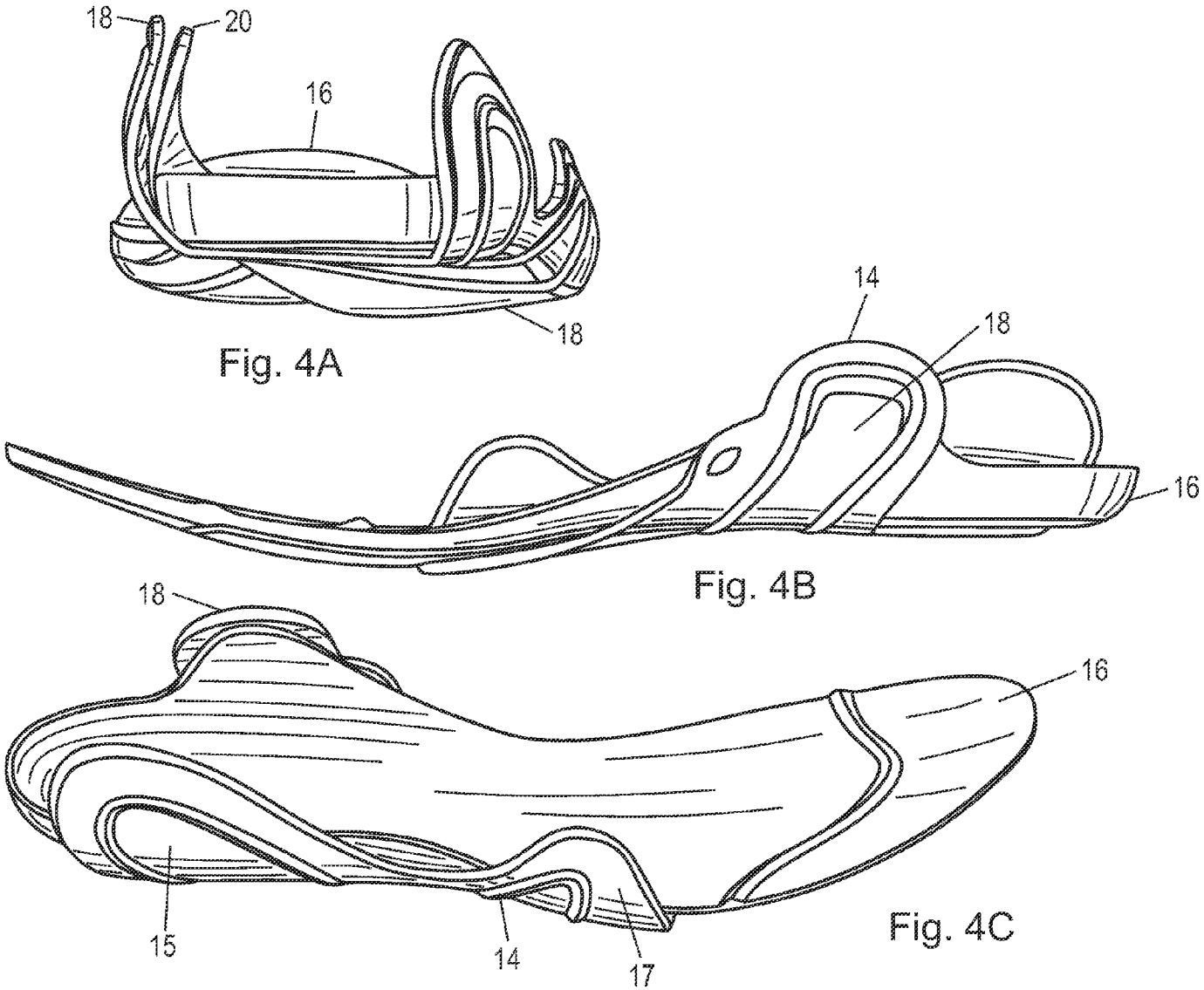
FIGS. 4A-4C show views of an arrangement of the sock liner and tri-planar plate.
Figure 5A:
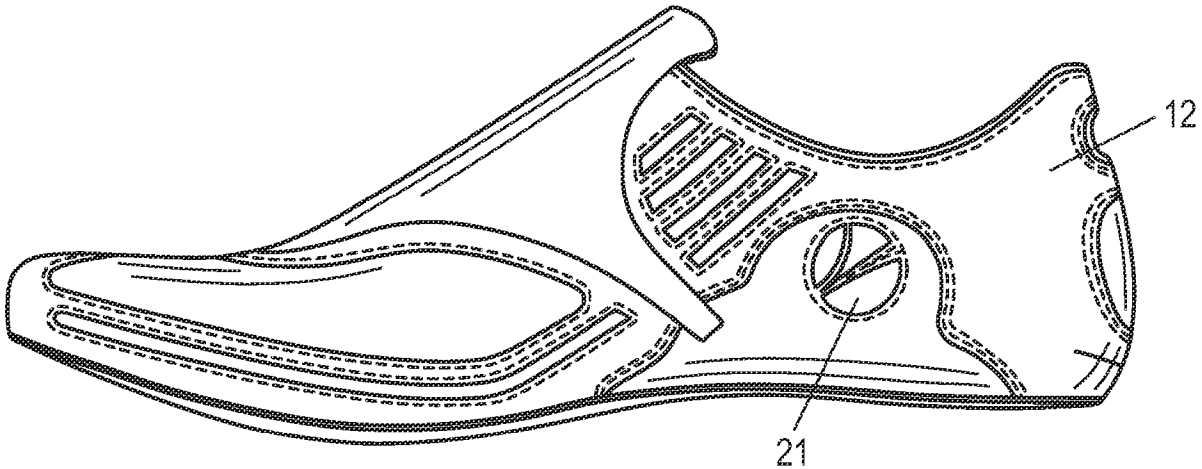
FIGS. 5A-5B show views of one possible embodiment of the shoe upper for use in one possible embodiment according to the inventive subject matter. The opening that allows the tri-planar plate and sock liner to attach to each other is shown.
Figure 5B:
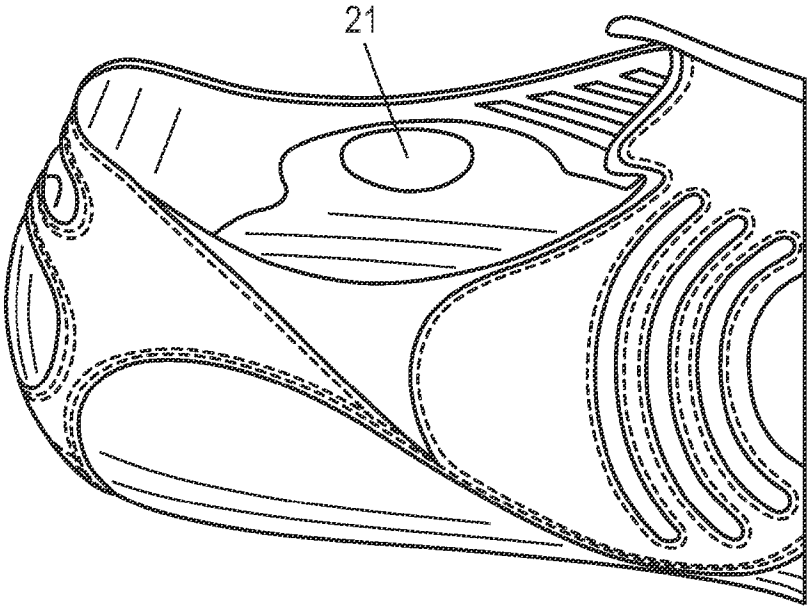
Figure 6B:
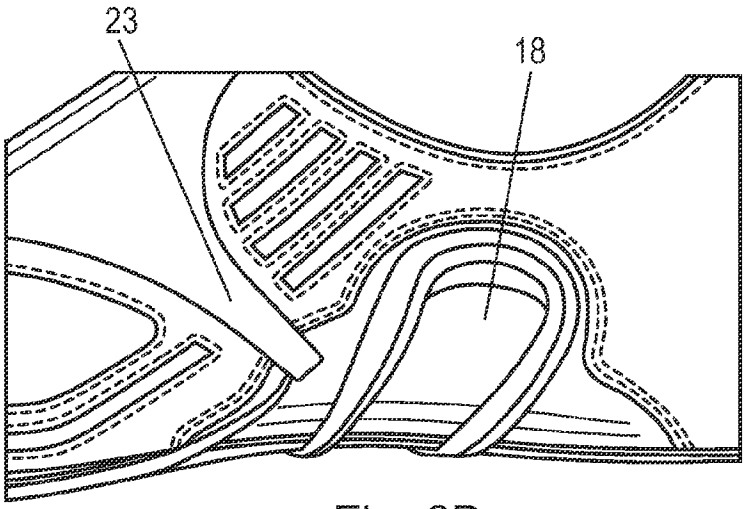
FIG. 6A-6C show views of the arrangement of the sock liner inside the upper before and after the tri-planar plate is attached. An adjustment strap connects to the tri-planar plate.
Figure 6A:
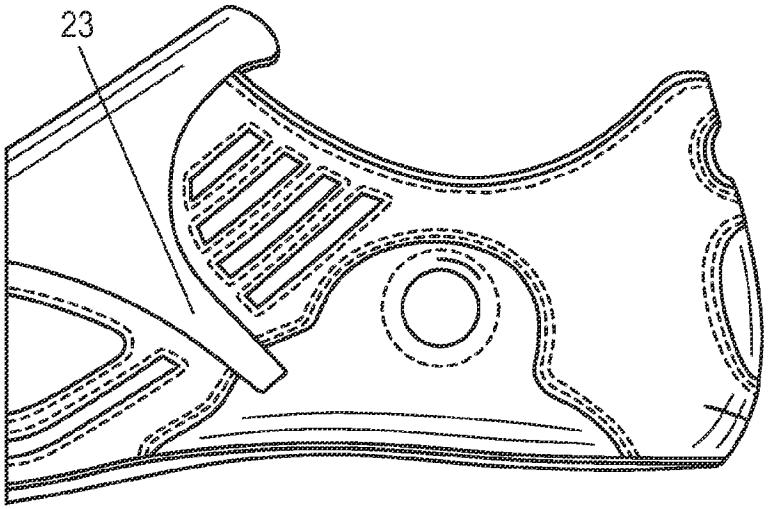
Figure 6C:
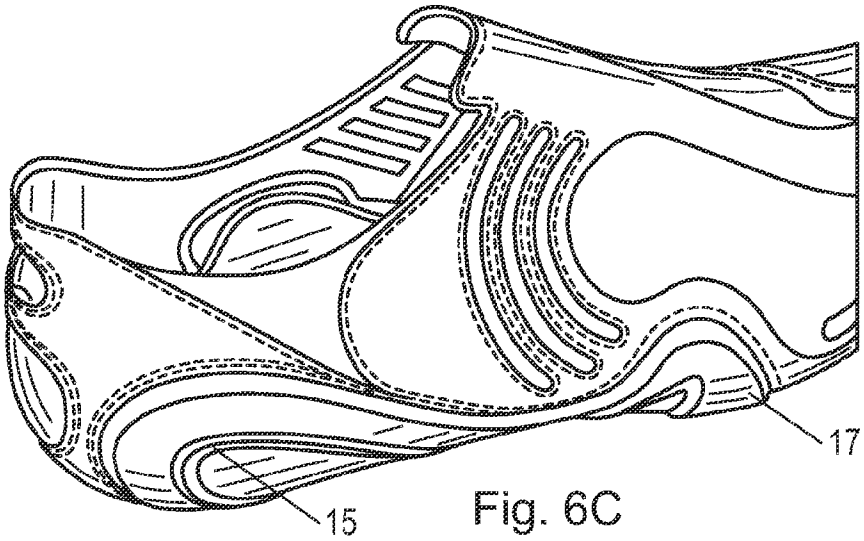
Figure 7B:
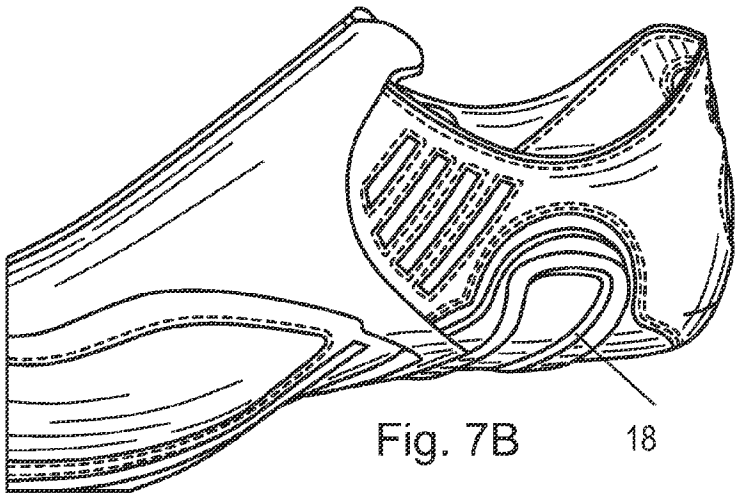
FIGS. 7A-7D show a few different views of the arrangement of the sock liner, tri-planar plate, and upper. A fully assembled shoe with a sole is also shown.
Figure 7D:
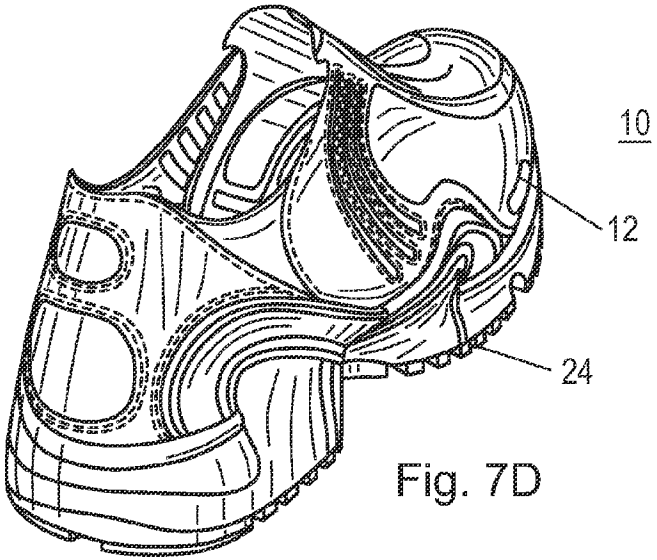
Figure 7A:
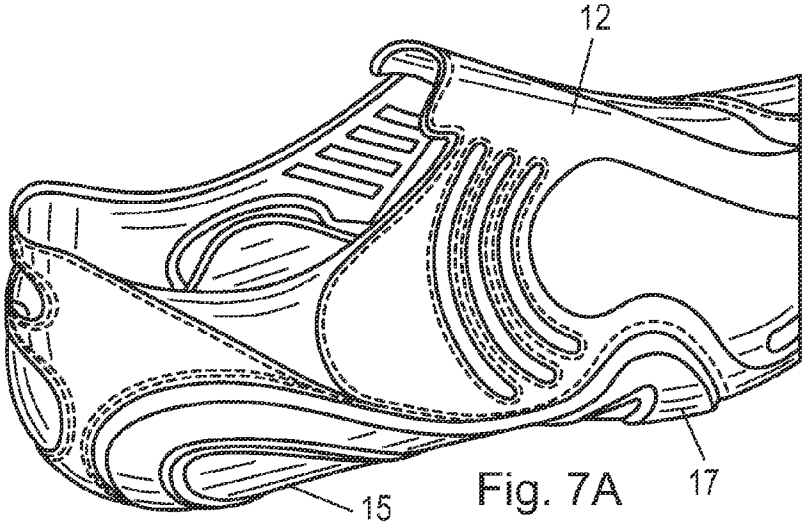
Figure 7C:
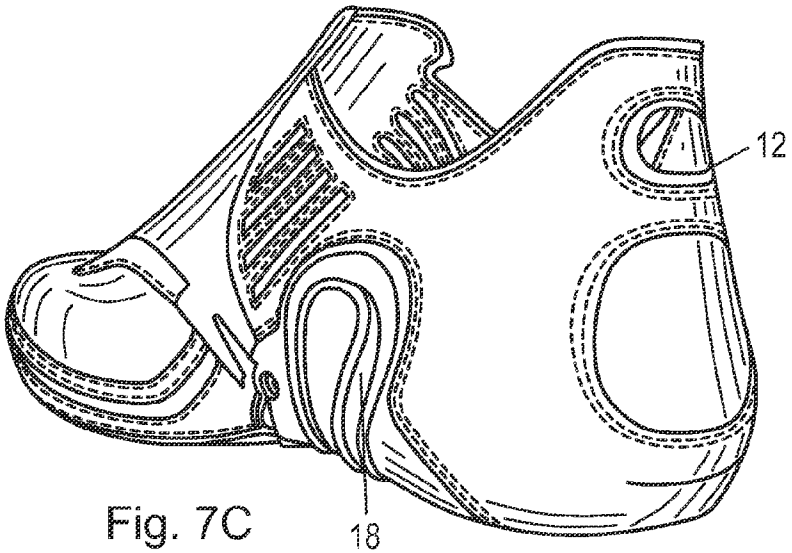
Figure 8B:
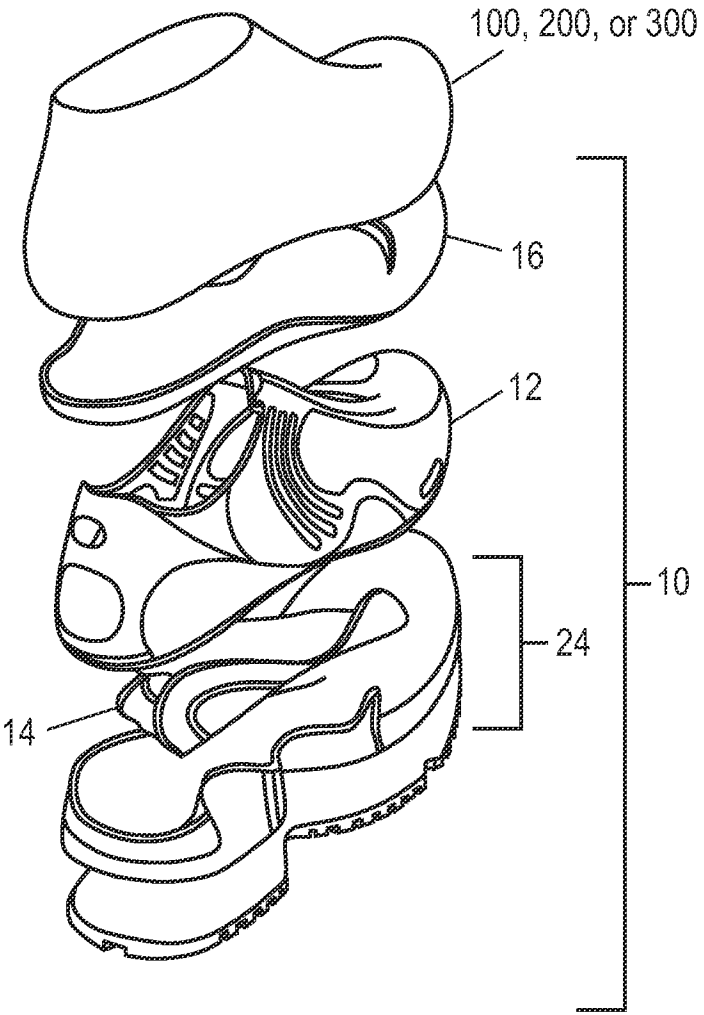
FIGS. 8A-8B show views of the different parts of the shoe and tri-planar system.
Figure 8A:
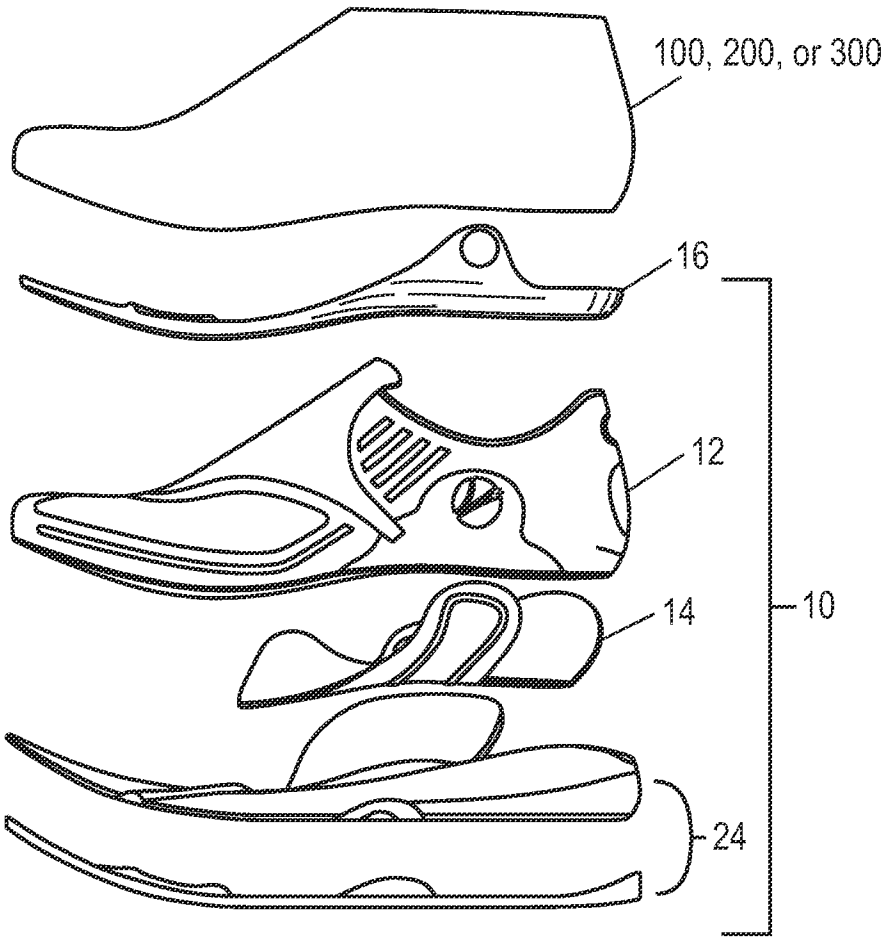

In the embodiments of FIGS. 1, 10.1-10.58 and 11.1-11.58, the last cone, 110 is configured in a more lateral direction (i.e., to a corrected position). In selected embodiments of the last, the cone 110 of the last has about a seven degree lateral offset from the midline and the area of the last; correspondingly the forefoot has about a seven degree planar rotation (forefoot adduction) toward the medial side (rather than the industry standard three degree rotation), though these offsets can be greater or lesser in other embodiments. For example, in some alternative embodiments, the last has a lateral offset of from about one degree to about twelve degrees from the midline, while the area of the last corresponding to the forefoot has rotation toward the medial side of from about one degree to about twelve degrees. The lateral offset of the cone from the midline and the rotation of the forefoot toward the medial side can be an equivalent number of degrees, such as both being from about one to about twelve degrees, or from about three to about ten degrees, or about seven degrees. However, the lateral offset of the cone from the midline and the rotation of the forefoot toward the medial side also can be a different number of degrees. As just one, non-limiting example, a tri-planar system last can have a seven degree angle lateral offset from the midline and the area of the last corresponding to the forefoot can have about a nine degree rotation toward the medial side.

In some embodiments, the front underside of the last may be substantially flatter than the industry standard, but the overall dimensions of the last remain almost the same. For example, in one such embodiment of a last 200 shown in FIGS. 10.1-10.58: (1) about 4 mm of material was added to the underside medial metatarsal area of the last; and (2) a compensatory amount of material was shaved off the medial ball area of the topside of the last. Thus, though the last was substantially modified, it retained the same overall dimensions for around the ball of the foot for the resulting upper formed from the last. This embodiment is intended to correct a significant supination or external rotational deviation.

FIGS. 9.1-9.3 generally represent a last 200 or 300, with parallel contour lines defining cross-sections through the last. Each of these cross-sectional contours is then shown in FIGS. 10.1-10.58 for last 200 and in FIGS. 11.1-11.58 for last 300. A person of ordinary skill in the art can duplicate the last, for example, through the use of conventional computer-assisted design software capable of scanning FIGS. 10.1-11.58 and constructing a three-dimensional model from those scans. The embodiment shown in FIGS. 10.1-10.58 represents an objective tri-planar foot alignment for supporting a foot that is naturally prone to marked or significant supination, or for a significant rotational deviation. The embodiment shown in FIGS. 11.1-11.58 represents an objective tri-planar foot alignment for supporting a foot that is naturally prone to mild supination, neutrality, or pronation. The two embodiments are the same in the hindfoot but one forefoot has a 4 mm drop of the first ray to stabilize a strong suprinator. The other has a flat neutral first ray to ensure neutral roll-off at mid stance. This works for all feet but a strong suprinator.

Industry-standard lasts are typically made from a plastic for manufacturing purposes. Some smaller specialty shops cater to individual clients that utilize wooden handmade lasts specific to each customer. The lasts described herein can be constructed from any commonly-used material in the shoe industry, or any specialty material.

A three-dimensional tri-planar plate 14 (see FIGS. 3A and 3B) is configured and constructed of materials to help adjust, stabilize and/or direct objective tri-planar motion of the foot at one or more of the tri-planar points. Typically, the plate will be constructed of semi-rigid material that provides support but which does not unduly restrict required foot movement or causes discomfort.

In some embodiments, the tri-planar plate wraps under the rear portion of the arch of the foot, from the lateral calcaneus to the ST, and continues to support the lateral side of the foot by wrapping from the lateral calcaneus to just behind the fifth metatarsal on the lateral forefoot. Projection 15 upwardly extends from the support plate area of the lateral calcaneous. Projection 17 upwardly extends from the plate for support at the area of the fifth metatarsal ray. Unlike traditional orthotic modifications, the tri-planar plate does not always sit on top of the midsole of a shoe. Instead, it is intended to be placed into the midsole of footwear or formed as part of the midsole or other sole unit structure. For example, the tri-planar plate can be attached to the outside of the shoe upper via bonding, gluing, or some other process, such as co-molding with the shoe's midsole. The tri-planar plate may include optional engineered convex grooves or ridges on the exterior surface that provide additional directional and functional stiffness and reinforcement. These engineered grooves or ridges also can directionalize the adjusting or stabilizing forces imparted by the tri-planar plate, which counteract or otherwise modify the motion forces of the wearer's foot. The plate can be constructed from any suitable material. Specific embodiments may employ a plastic or composite material providing a durometer in the range of about 10 to 60 (Shore A). Any number of modern nylons, urethanes, fiberglass products, or even carbon fibers can be crafted, manufactured, or injected to these specific durometers.

In some embodiments, the tri-planar system may include a shoe insert 16 in the nature of a sock liner. One particular inventive sock liner (see FIG. 2) is similar to prior art, with an anatomical heel cup and corresponding flex groove. However, this new sock liner includes an optional projection 20 that engages the ST on the medial side of the calcaneous bone when the shoe is worn. This projection pushes up under the ST and into the medial side of the foot, causing the arch of the foot to elevate upward and in a lateral direction. This projection 20 and/or a corresponding projection 18 on the triplanar plate 14 may be in the form of a "shark fin" conformation, but other conformations in various size may be constructed to engage to some desired degree the ST on the medial side of the calcaneous bone when the shoe is worn.

The sock liner projection 20 also may include some type of device or mechanism for creating a zone of pressure at the ST. The sock liner may do this in combination with the tri-planar plate or instead of the tri-planar plate. For example, the sock liner may include a portion that engages the tri-planar plate in the area of the ST to create a pressure zone. The sock liner may be fixedly or removably coupled to the tri-planar plate or simply be adjacent the tri-planar plate. For example, to create a removable coupling, a Velcro® tab can be mounted on the outside (exterior, medial side) of the projection and partially inserted through a corresponding port of the shoe upper to engage or attach to a corresponding Velcro® tab on the interior or medial side of the tri-planar plate. Of course, alternative coupling mechanisms could be used in place of the Velcro®, such as (but not limited to) a snap, clip, tab and slot conformation, or other mechanical fastener; glue, adhesive, or other temporary or permanent chemical bonding agent; or some type of electromechanical attachment, such as a magnetic fastener. Traditional sock liners use ethyl vinyl acetate (EVA) as a construction material, but any suitable material can be used. For example, in specific embodiments, the sock liner is constructed using polyurethane (PU) to provide longer wear.

The tri-planar system of the illustrated embodiment may employ a conventional or modified upper 12 based on known, traditional shoe uppers. In some embodiments, an upper 12 is modified to couple with the triplanar plate 14 and/or sockliner 16. The sockliner may contain a hole or port 21 on its medial side near the ankle that allows passage of the attachment device on the sock liner through the upper to engage the tri-planar plate (or a corresponding device on the tri-planar plate). For example, if the sock liner and tri-planar plate can be attached to each other via Velcro®, then the opening would allow the two sides of the Velcro® to contact each other. In other embodiments, such an opening or port is not necessary for the sock liner to engage the tri-planar plate through the upper, such as with a magnetic attachment used to engage the sock liner and tri-planar plate.

In some embodiments, the upper 12 also may include an adjustable strap 23 along its medial side allowing it to be connected to the tri-planar plate and anchored elsewhere on the upper. The wearer can adjust the fit of the entire tri-planar system using this strap, particularly the fit of the medial side of the tri-planar system. Other embodiments may include a similar strap allowing adjustment of the tri-planar plate just behind the fifth metatarsal head.

Additionally, the upper 12 may include optional receptive areas for engaging the tri-planar plate 14. These receptive areas can be constructed from particular materials, or with particular recesses or other conformations, that facilitate engagement between the tri-planar plate 14 and the upper 12.

The upper 12 can be constructed from traditional materials, including (but not limited to) natural or synthetic leather; nylon, polyester, Lycra, and other fabrics; plastics and other polymers; natural or synthetic rubbers; or various combinations of these materials. Additionally specially-constructed molded parts can be employed to provide a unique function or design, as well as increased consumer benefit.

Footwear 10 with one embodiment of a complete tri-planar system including a sole unit 24, tri-planar plate 14, sock liner 16, and upper 12, as described above, is shown in FIGS. 7 and 8.

The tri-planar system can be used or constructed in virtually any type of shoe for almost any type of activity. In particular embodiments, the tri-planar system is used as part of athletic footwear, such as (but not limited to) shoes for running, basketball, tennis, hiking, American football, soccer, baseball, and other sports involving repetitive motion of the foot and leg. The tri-planar system can be resized accordingly to different footwear sizes, but a manufacturer would need to slightly modify the structure of the tri-planar plate in relationship to the type of corrected last that would be used for athletic, casual, work, or medical applications. The tri-planar system can simply be scaled or graded to different sizes for a wide range of footwear relating to particular activities. The tri-planar system also can be adapted for applications other than athletic, orthotic, or medical footwear, such as (but not limited to) shoes for particular business, trade, military, or professional uniforms or dress-such as police or nursing uniforms, shoes for chefs and restaurant workers, military boots and shoes, or boots for skiing, motocross, or horseback riding.

Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein.

What is claimed is:

1. A support system for a foot, the foot having a medial side, a lateral side, a sustentaculum tali, a lateral calcaneus, a heel, a fifth metatarsal ray and a forefoot, an upper portion of the foot being connected to an ankle bone, the support system comprising:

a generally planar base having a first end proximate the heel of the foot and an opposing second end proximate the forefoot of the foot, a longitudinal axis of the base extending from the first end to the opposing second end;

a first projection extending upwardly from the base, the first projection having a first end and an opposing second end, the first end of the first projection being closer to the first end of the base than the second end of the first projection as measured along the longitudinal axis, the first projection supporting the sustentaculum tali on the medial side of the foot, the first projection providing an upward and outward force on the sustentaculum tali, the first projection not supporting the longitudinal arch;

a second projection extending upwardly from the base, the second projection supporting the lateral calcaneus on the lateral side of the foot; and a third projection extending upwardly from the base, the third projection having a first end and an opposing second end, the first end of the third projection being closer to the first end of the base than the second end of the third projection as measured along the longitudinal axis, the third projection supporting the fifth metatarsal ray on the lateral side of the foot, wherein the base, the first projection, the second projection and the third projection combine to form a first support, wherein the first and second projections, in combination with the base, define an approximated U-shape with inwardly arching sidewalls, wherein the first projection does not extend upwardly to the ankle bone when the foot is placed on the base and the foot is not rotated, and wherein the second end of the first projection is spaced-apart from the first end of the first end of the third projection as measured along the longitudinal axis.

2. The support system of claim 1, further comprising a second support including a first portion, in use and in combination with the first projection of the first support, providing a force to an underside portion of the sustentaculum tali on the medial side of the foot to provide an upward and outward force on the sustentaculum tali.

3. The support system of claim 2, wherein the second support further includes a base; and wherein the first portion of the second support is a first projection.

4. The support system of claim 3, wherein the first projection of the second support extends upwardly from the base thereof and has a distal end which arches inwardly.

5. The support system of claim 3, wherein the base of the second support overlies the base of the first support.

6. The support system of claim 3, further comprising a shoe upper coupled to at least one of the first and second supports.

7. The support system of claim 6, wherein the shoe upper is coupled to the second support.

8. The support system of claim 6, wherein the first projection of the first support has an interior surface and an exterior surface, and the first projection of the second support has an interior surface and an exterior surface, and wherein the interior of the first projection of the first support is coupled to the exterior of the first projection of the second support.

9. The support system of claim 8, wherein the second support is fixedly coupled to the first support.

10. A support system for a foot, the foot having a medial side, a lateral side, a sustentaculum tali, a lateral calcaneus, a fifth metatarsal ray and a forefoot, the support system comprising:

a first support having:

a first portion supporting the sustentaculum tali on the medial side of the foot, the first portion providing an upward and outward force on the sustentaculum tali;

a second portion supporting the lateral calcaneus on the lateral side of the foot;

a third portion supporting the fifth metatarsal ray on the lateral side of the foot; and a base, the first, second and third portions being first, second and third projections attached to the base, the first, second and third projections extend, in use, upwardly from the base, the first and second projections defining an approximated U-shape with inwardly arching sidewalls, the first projection of the first support having an interior surface and an exterior surface;

a second support removably coupled to the first support, the second support having:

a first portion, in use and in combination with the first portion of the first support, providing a force to an underside portion of the sustentaculum tali on the medial side of the foot to provide an upward and outward force on the sustentaculum tali; and a base, wherein the first portion of the second support is a first projection, the first projection of the second support having an interior surface and an exterior surface, the interior surface of the first projection of the first support being coupled to the exterior surface of the first projection of the second support;

a shoe upper coupled to at least one of the first and second supports.

11. The support system of claim 10, further comprising a first fastener on the interior surface of the first projection of the first support and a second fastener on the exterior surface of the first projection of the second support removably coupling the second support to the first support.

12. The support system of claim 11, wherein the shoe upper has a medial side and a lateral side, and further includes a hole disposed on the medial side of the shoe upper.

13. The support system of claim 12, wherein the first fastener is engages the second fastener through the hole in the shoe upper.

14. The support system of claim 13, wherein the first and second fasteners are corresponding hook and loop fasteners.

15. The support system of claim 11, wherein the shoe upper has a medial side and a lateral side, and further includes an adjustable fastener disposed on the medial side of the shoe upper and connectable to the first support for adjusting the fit of the support system.

16. The support system of claim 1, wherein the first projection extends upwardly from the base less than three inches when the foot is placed on the base and the foot is not rotated.

17. The support system of claim 1, further comprising at least one convex groove or ridge on an exterior surface of at least a portion of the support system, the at least one groove or ridge providing directional and functional stiffness and reinforcement.

18. The support system of claim 1, wherein at least a portion of the second end of the base extends in a straight line.

19. A support system for a foot, the foot having a medial side, a lateral side, a sustentaculum tali, a lateral calcaneus, a heel, a fifth metatarsal ray and a forefoot, an upper portion of the foot being connected to an ankle bone, the support system comprising:

a first support comprising:

a generally planar base having a first end proximate the heel of the foot and an opposing second end proximate the forefoot of the foot, a longitudinal axis of the base extending from the first end to the opposing second end;

a first projection extending upwardly from the base, the first projection having a first end and an opposing second end, the first end of the first projection being closer to the first end of the base than the second end of the first projection as measured along the longitudinal axis, the first projection supporting the sustentaculum tali on the medial side of the foot, the first projection providing an upward and outward force on the sustentaculum tali, the first projection not supporting the longitudinal arch;

a second projection extending upwardly from the base, the second projection supporting the lateral calcaneus on the lateral side of the foot; and a third projection extending upwardly from the base, the third projection having a first end and an opposing second end, the first end of the third projection being closer to the first end of the base than the second end of the third projection as measured along the longitudinal axis, the third projection supporting the fifth metatarsal ray on the lateral side of the foot, wherein the base, the first projection, the second projection and the third projection combine to form a first support, wherein the first and second projections, in combination with the base, define an approximated U-shape with inwardly arching sidewalls, wherein the first projection does not extend upwardly to the ankle bone when the foot is placed on the base and the foot is not rotated, and wherein the second end of the first projection is spaced-apart from the first end of the first end of the third projection as measured along the longitudinal axis; and a second support comprising:

a first portion, in use and in combination with the first projection of the first support, providing a force to an underside portion of the sustentaculum tali on the medial side of the foot to provide an upward and outward force on the sustentaculum tali.

* * * * *